US005909609A

United States Patent [19]

Yahata et al.

[11] Patent Number: 5,909,609

[45] Date of Patent: Jun. 1, 1999

[54] IMAGE FORMING APPARATUS WITH PROVISIONS FOR SUPPLYING TONER THEREIN

[75] Inventors: Masasumi Yahata, Kamakura; Shunji Kato, Sagamihara; Yuji Kitajima, Kawasaki; Satoshi Takano, Tokyo; Nobuo Kikuchi, Kawagoe; Shinichi Kawahara, Tokyo; Ryo Tanoue, Yokohama, all of Japan

[73] Assignee: Ricoh Company, Ltd., Tokyo, Japan

[21] Appl. No.: 08/877,558

[22] Filed: Jun. 17, 1997

[30] Foreign Application Priority Data

| | | | |
|---|---|---|---|
| Jun. 18, 1996 | [JP] | Japan | 8-177559 |
| Jul. 5, 1996 | [JP] | Japan | 8-176611 |
| Jul. 8, 1996 | [JP] | Japan | 8-178182 |
| Jul. 26, 1996 | [JP] | Japan | 8-197409 |
| Oct. 4, 1996 | [JP] | Japan | 8-263982 |
| Oct. 7, 1996 | [JP] | Japan | 8-265808 |
| Apr. 1, 1997 | [JP] | Japan | 9-82529 |

[51] Int. Cl.[6] ..... G03G 15/08

[52] U.S. Cl. ..... 399/258; 399/30; 399/81; 399/262; 399/263

[58] Field of Search ..... 399/238, 258, 399/61, 27, 30, 260, 262, 263, 256, 224, 223, 225, 81

[56] References Cited

U.S. PATENT DOCUMENTS

| | | | |
|---|---|---|---|
| 4,987,449 | 1/1991 | Katoh . | |
| 5,202,732 | 4/1993 | Yahata . | |
| 5,227,847 | 7/1993 | Motohashi et al. . | |
| 5,260,749 | 11/1993 | Yahata . | |
| 5,287,161 | 2/1994 | Matsuo et al. | 399/262 X |
| 5,315,362 | 5/1994 | Fuji et al. | 399/224 |
| 5,414,499 | 5/1995 | Yahata . | |
| 5,512,708 | 4/1996 | Takahashi et al. . | |
| 5,561,506 | 10/1996 | Kasahara | 399/256 |
| 5,570,170 | 10/1996 | Muranyi et al. | 399/262 |
| 5,585,899 | 12/1996 | Palumbo et al. | 399/263 X |
| 5,648,840 | 7/1997 | Ikunami et al. | 399/262 |

FOREIGN PATENT DOCUMENTS

| | | |
|---|---|---|
| 0 282 223 | 9/1988 | European Pat. Off. . |
| 0 627 556 | 12/1994 | European Pat. Off. . |
| 0 662 647 | 7/1995 | European Pat. Off. . |
| 61-116369 | 7/1986 | Japan . |
| 63-78185 | 4/1988 | Japan . |
| 7-20702 | 1/1995 | Japan . |
| 2 289 143 | 11/1995 | United Kingdom . |

*Primary Examiner*—S. Lee

*Attorney, Agent, or Firm*—Oblon, Spivak, McClelland, Maier & Neustadt, P.C.

[57] ABSTRACT

An image forming apparatus includes a toner bank that is configured to hold a large-volume of toner that is ultimately used to develop a latent image formed on a latent image carrier. A developing apparatus develops the latent image into a visible image. The toner is supplied to the toner bank, which need not be located adjacent to the developing apparatus, using a mechanism that prevents the toner from becoming clogged while being transported to the developing apparatus from the toner bank. In the toner bank, more than one toner bottles are vertically set. The toner bottles are individually opened and closed at respective opening portions thereon with an opening/closing mechanism and are rotated so as to discharge toner therefrom. Toner discharged from the toner bottles is dropped into the toner bank and is supplied to a developing apparatus by a flexible toner delivering mechanism having a powder pump unit and a flexible toner supplying pipe.

28 Claims, 44 Drawing Sheets

| Fig. 20A |
| --- |
| Fig. 20B |

$\phi d_1 \leqq \phi d_2$

IMAGE FORMING APPARATUS WITH PROVISIONS FOR SUPPLYING TONER THEREIN

BACKGROUND OF THE INVENTION

1. Field of the Invention

This invention relates to an image forming apparatus included in an electrophotographic system such as a copying machine, a printer, a facsimile apparatus and the like. More particularly, the present invention relates to an image forming apparatus including a developing apparatus in which two-component developer or one-component developer is used as is a toner supplying apparatus for supplying toner to a developing section of the developing apparatus.

Furthermore, the present invention relates to an image forming apparatus having a toner delivering apparatus for delivering toner in a way such that the toner may be reused or discarded.

2. Discussion of the Background

Selected conventional image forming devices include a toner delivering apparatus in which toner remaining on a photosensitive body is recovered by a photosensitive body cleaning apparatus and then delivered to a developing apparatus so as to be reused. This type of apparatus is equipped with a toner transmitting mechanism A and a powder pump B, for example, as shown in FIGS. 48 and 49. If toner recovered by the photosensitive body cleaning apparatus 501 (FIG. 48) is reused, the recovered toner is then discharged from a discharging tube 501*a* of the body cleaning apparatus 501, as shown in FIGS. 48 and 49, and is dropped into a transfer guide case 502 via a connection case 503. All the while, a rotation of a driving motor causes a horizontal delivery screw 504 to rotate in the transfer guide case 502. The screw 504 rotates integrally with a rotor 507 in a stator 506 of the powder pump B, so that the recovered toner is transmitted into the stator 506 through a rotation of the horizontal delivery screw 504.

Furthermore, the toner is pressed out, by the rotation of the rotor 507, through the toner outlet 505 from an inside of the stator 506 into a toner transfer pipe 508 connected to a toner outlet 505*a*, and air is blown into the powder pump B via an air transfer pipe 509*a* by an air pump 509 so as to be transmitted into the toner transfer pipe 508. The toner passing through the toner transfer pipe 508 is thus moved along via an air flow so as to be delivered to the developing apparatus.

In addition, in an image forming apparatus in an electrophotographic system such as a copying machine, a printer, and a facsimile, a developing apparatus contained therein makes visible a static latent image formed on a latent image carrier such as a photosensitive body by supplying toner thereto. The developer is supplied so as to maintain an image density if two-component developer or one-component developer is consumed as a result of making previous images. As part of the new developer, toner is generally used, and a toner supplying apparatus used for supplying the toner is, for example, disclosed in Japanese Unexamined Patent Publication No. 2-277083.

As shown in FIG. 50, the toner supplying apparatus disclosed in the above patent publication includes a toner tank 521 for storing toner supplied to a developing section 522 arranged near a photosensitive body 541, a toner residue detector (i.e., a toner sensor) 523 for detecting residue of toner in the toner tank 521, and a toner server 524 for supplying toner to the toner tank 521 arranged so as to be adjacent to the toner tank 521. The toner server 524 includes a toner server body 525, a rotating member 526 having a number of extending portions which radially extend therefrom and are spaced nearly equally apart from one another in a circumferential direction and being rotatably supported by the toner server body 525, a plurality of cartridge supporting member 527 supported so as to be rotatably movable at a tip of each of said extending portions, a plurality of toner cartridges 528 containing toner removably installed in each cartridge supporting member 527, a first driving motor 529 for rotating the rotating member 526, and a second driving motor 530 for rotating the cartridge supporting members 527, in which the first and second driving motors are controlled to be driven by a controlling mechanism 531 based on a result of a detection obtained by the toner residue detector 523. The toner supplying apparatus having the above configuration is characterized by that, when the rotating member 526 and the cartridge supporting member 527 rotate or rotatably move and then stop at a fixed position, an opening portion so as the toner cartridge 528 for discharging toner is opposed on the top surface of the toner tank 521 by each toner cartridge 528 falling down and then toner contained in the cartridge is made to fall out from the opening portion so as to supply the toner to the toner tank 521.

According to the above described toner supplying apparatus, the toner server 524 has a plurality of toner cartridges 528 and the toner cartridges 528 are automatically displaced in a circumferential direction a specific number of times, so that a frequency with which the toner cartridge 528 must be exchanged is decreased.

In addition, in the above described conventional toner supplying apparatus, the toner sensor 523 is used for detecting a residual amount of toner in the toner tank 521 which is a toner collecting section, after toner being supplied from each toner cartridge 528, but not used for detecting the amount of residual toner in each toner cartridge 528. Accordingly, when the toner sensor 523 indicates a toner end, every toner cartridge 528 in the toner server 524 must be empty. Moreover, when the toner sensor 523 detects the toner end, there is no toner in the image forming apparatus and therefore the image forming apparatus cannot continue an image forming operation without being halted so that more toner can be added thereto.

Further, the toner server 524 has a sealed structure. Also from this viewpoint, the conventional devices has a configuration in which toner cartridge cannot be exchanged while the image forming apparatus continues to operate. As described above, there is a problem that the image forming apparatus must be temporality stopped for replacing a toner containing member such as a toner cartridge when supplying toner in the conventional image forming apparatus.

Furthermore, in another conventional technology, there is a toner supplying apparatus which includes a toner tank for storing toner to be supplied to a developing section, a toner residue detecting sensor for detecting residue of toner in the toner tank, and a toner bottle for supplying toner to the toner tank, arranged so as to be adjacent to the toner tank. Although the toner bottle must be replaced by new toner bottle when empty, it is known that there is a toner supplying apparatus having more than one toner bottle so that an exchanging frequency of the toner bottles can be decreased. This type of a toner supplying apparatus discharges toner from a toner bottle to a toner tank by an appropriate amount by using a known approach, and if a toner residue detecting sensor detects a reduction of the toner residue in the toner tank, it determines that the toner bottle is empty and starts to use another new toner bottle.

As recognized by the present inventors, in the above conventional toner delivering apparatus, there is provided a thin toner outlet 505*a* (FIG. 48) in a tip side of the pump case 505 as described above so that the toner transfer pipe 508 having a relatively small diameter can be connected to the powder pump B. However, this approach has a problem in that heat generated by friction is easily generated between the stator 506 and the rotor 507 during delivering toner in the powder pump B, whereby the toner is aggregated with an effect of frictional heat being generated and the aggregated toner remaining therein when attempting to pass through the narrow toner outlet 505*a*, and ultimately the outlet 505*a* becomes clogged.

Furthermore, in a developing apparatus of the conventional image forming apparatus, the present inventors have recognized problems in that a large amount of toner storage (containing amount) makes the configuration of the developing apparatus larger than desired because a toner storage section and a developing apparatus are integrally configured. As a consequence, the conventional configuration of the image forming apparatus is more complicated than necessary, and reduces operability and ease of maintenance of the apparatus. Additionally, a layout of the body of the conventional apparatus is restricted by these problems and therefore it also causes a problem that a larger area is required for hosting the apparatus. For example, also in a case of the above toner supplying apparatus, the toner server for supplying toner to the toner tank in the developing apparatus is arranged so as to be adjacent to the developing apparatus and its arrangement position is restricted, whereby it cannot avoid the problems associated with having a complicated apparatus configuration, a larger size, and restricted component layout.

Further, the above described problems of the conventional toner supplying apparatus cause an increase in apparatus down-time, and thus increase copying or printing cost for a user who copies or prints a large amount of data. Naturally, in apparatuses with a large capacity toner supply, the apparatus that delivers the toner must be reliable. However, conventional system achieve higher reliability by using larger systems at great expense, but such systems are not practical in small, lower cost systems that require low power consumption and simple toner delivery mechanisms.

According to conventional wisdom in devices in which a plurality of toner cartridges are circumferentially rotated so as to be moved while being sequentially directed toward predetermined positions (e.g., such as in the toner supplying apparatus disclosed in the above discussed patent publication), a structure for enabling a movement of the cartridges is indispensable. However, as recognized by the present inventors, this approach leads to an increase in a size of the apparatus. In addition, a body of the toner server must reserve a sufficient amount of toner by containing a plurality of toner cartridges and therefore it requires a larger volume than that required to host the toner cartridges themselves.

To supply toner from one of the toner cartridges, the toner cartridges must be moved. Additionally, the toner cartridge to be moved must be filled with toner inside. Therefore, when toner is supplied from the toner cartridge, a particular sequence of cartridges must be selected and is not practical to select the cartridges in an arbitrary manner.

In the toner supplying apparatus disclosed in the above discussed patent publication, toner is discharged when the toner cartridge, which has arrived at the position where toner is to be supplied, falls down over top of a toner tank. In this configuration, however, if the toner cartridge is attempted to be replaced when in a position where the cartridge can spill toner and create a mess, the toner cartridge must be moved again to another position where toner will not spill from the toner cartridge. Accordingly, replacing toner cartridges is a challenge for an operator.

Furthermore, if a toner cartridge in a toner bottle configuration is simply enlarged, the toner supplying apparatus becomes larger and the amount of space allocated for the toner supplying apparatus is restricted. Thus, this is yet another reason why a cartridge in the conventional apparatus results in undesirable down-times.

If it is determined that a toner bottle is empty by using a sensor for detecting toner residue in a toner tank like the above toner supplying apparatus, there is a problem regarding how precisely the sensor can act based on a variability of a sensitivity of the sensor or a speed of discharging toner from the toner bottle. If a bottle is misinterpreted as being empty, a subsequent toner bottle must be used wastefully though toner still remains in the first toner bottle. Further, if a toner discharging aperture of the toner bottle which becomes empty is opened when exchanging the toner bottle, toner in the toner bottle is scattered, whereby a peripheral portion is contaminated undesirably. Still further, in a toner supplying apparatus of a type in which a capped toner bottle is automatically uncapped with the cap being held when the toner bottle is started to be used, there is a disadvantage that, if it is forgotten to be replaced, the removed cap from the empty toner bottle prevents a cap from the new toner bottle from being removed.

In addition, as disadvantages of an image forming apparatus equipped with a conventional large-volume toner tank, there have been the following problems, as recognized by the present inventors:

1) It is difficult to supply toner to the toner tank, and thus, is not user-friendly; and 2) Since toner blocking in the toner tank (due to compressed toner at the bottom) occurs, a mechanism for preventing this blocking is required.

SUMMARY OF THE INVENTION

Accordingly, one object of this invention is to provide a novel system for supplying toner that overcomes the above-mentioned limitations of existing systems, and in particular, to prevent an occurrence of toner clogging at a toner outlet thereof Another object of the present invention is to provide an image forming apparatus including a toner supplying apparatus equipped with a toner tank having a large volume for holding toner that can be arranged in any number of different locations about the image forming apparatus, thereby enabling significant freedom in where to locate specific components of the image forming apparatus, enhance an operability of the apparatus and achieve a higher reliability than conventional systems.

It is still another object of the present invention to provide an image forming apparatus having a developing apparatus and a toner supplying apparatus which reduces a down-time of the machine while solving the above described, maintenance, size, cost and complexity problems of conventional devices.

Another object of the present invention to provide an image forming apparatus that supplies toner simply and quickly without halting an image forming operation, but rather allows an operator to add toner while latent images or toner images are being formed.

Another object of the present invention is to provide an image forming apparatus which can easily recognize a specific position of an empty toner bottle that is to be replaced.

A further object of the present invention is to provide an image forming apparatus which can easily recognize in advance the number of the toner bottles to be replaced and their positions.

Still a further object of the present invention to provide an image forming apparatus which prevents the apparatus from being enlarged, as is the case with conventional devices, and improve the ease with which toner cartridges may be replaced.

It is yet another object of the present invention to provide a toner supplying apparatus which prevents a toner bottle still containing toner therein from being replaced with new one. Such an apparatus prevents toner from being scattered from an opening portion of the toner bottle, and which achieves an assured withdrawal of a cap of the toner bottle.

To achieve the above objects, a first aspect of the invention, includes in an image forming apparatus in an electrophotographic system in which toner is delivered by using a powder pump, a stirring member which rotates with a rotor of the powder pump, where the stirring member is installed in the rotor in a position of an outlet of the powder pump.

According to a second aspect of the invention, in an image forming apparatus as discussed with respect to the first aspect, there is provided a wire, that is wound in spiral in a toner delivering direction, as the above stirring member.

According to a third aspect of the invention, in an image forming apparatus in an electrophotographic system, the image forming apparatus includes a developing apparatus for making a latent image on a latent image carrier with toner visible, a toner bank for storing toner to be supplied to the developing apparatus, the toner bank being arranged in a position apart from the developing apparatus, and a toner delivering mechanism for delivering toner from the toner bank to the developing apparatus, wherein the toner bank includes two or more toner bottles containing toner.

In other words, the image forming apparatus according to the third aspect of the invention includes the toner bank for storing toner being arranged in the body side apart from the developing apparatus and a toner delivering mechanism for delivering toner from the toner bank to the developing apparatus, whereby its layout is not restricted and a degree of freedom is considerably increased on its design. For example, it becomes possible to arrange a toner bank in a position completely independent from a peripheral portion around a fixed portion to improve a degree of allowance for toner blocking caused by heat or to arrange the toner bank in a position where a user handles a toner bottle most easily when exchanging toner bottles. In addition, a difference is made for a toner volume which depends on a copy volume (a large-volume class or a medium-volume class, etc.) of a copying machine by way of the number of common toner bottles which can be arranged in the toner bank, a problem being conventionally resolved in that conventionally there have been bottles of different volumes for each machine (resource protection and recycling become more easy).

According to a fourth aspect of the present invention, in an image forming apparatus as described with respect to the third aspect, a plurality of toner bottles in the toner bank with their opening portions are capped individually, all caps are directed in the same direction and a plurality of toner bottles are vertically arranged, and there is provided a mechanism for opening or closing the cap of each toner bottle individually.

In other words, in an image forming apparatus of the fourth aspect of the present invention, a plurality of toner bottles are vertically arranged and individual caps installed in the opening portions of the toner bottles are opened or closed independently, whereby the toner bottles can be sequentially used. Consequently, it is possible to prevent a copying operation from being suspended by a tone depletion event after a toner bottle becomes empty by using another toner bottle while the empty toner bottle is replaced with a full toner bottle. In addition, even when there is a delivery section at the bottom of the toner bank, a certain or greater amount of toner is not delivered to the delivery section (a certain or greater amount of compressive force is not applied to the delivery section), thereby it is possible to prevent blocking of toner in the toner bank (near the delivery section).

According to a fifth aspect of the present invention, in an image forming apparatus as discussed with respect to the third or fourth aspects, there is provided only a single path at the bottom of the toner bank as a toner delivery path from the toner bank for containing the plurality of toner bottles to the developing apparatus.

In other words, in the image forming apparatus according to a fifth aspect of the present invention, a simple (high maintainability and low failure probability) configuration of the apparatus can be provided by arranging only a single delivery path without arranging a plurality of independent delivery paths in respective toner bottles.

According to a sixth aspect of the present invention, in an image forming apparatus as discussed with respect to the fourth or fifth aspects of the invention, a powder pump is used as a mechanism for delivering toner from the toner bank to the developing section.

In other words, in the image forming apparatus described in accordance with the sixth aspect of the present invention, by applying a powder pump system to the toner delivering mechanism, a flexible pipe can be used for a delivery path from the toner bank to the developing section, and therefore a further simple and lower-cost apparatus can be provided.

According to a seventh aspect of the present invention, in an image forming apparatus having a configuration as discussed with respect to a sixth aspect of the present invention, there is provided a stirring member which rotates with a rotor of the powder pump, being installed in the rotor in a position of an outlet of the powder pump.

According to an eighth aspect of the present invention, there is provided an image forming apparatus having a developing apparatus for making a latent image on a latent image carrier visible with toner and a toner supplying apparatus for supplying the toner to the developing apparatus, wherein the toner supplying apparatus includes a toner bank having a plurality of toner bottles with opening portions for supplying the toner to the developing apparatus and a flexible toner delivering mechanism for delivering the toner from the toner bank to the developing apparatus.

The image forming apparatus according to a ninth aspect of the present invention includes a developing apparatus having a developing container including a developing mechanism for making a latent image on a latent image carrier visible with toner, a toner supplying section for storing toner to be supplied to the developing container, and a toner residue detecting mechanism for detecting toner residue in the toner supplying section, a toner bank to which can be set a plurality of toner containers which are cylindrical containers containing toner each having an opening portion at an end of each cylinder, and a flexible toner delivering mechanism for delivering toner from the toner bank to the toner supplying section of the developing apparatus, wherein the toner delivering mechanism is controlled by the toner residue detecting mechanism.

In other words, the image forming apparatus described in reference to the ninth aspect of the present invention has the toner bank to which the plurality of toner containers containing toner can be set and a flexible toner delivering mechanism for delivering toner from the toner bank to the toner supplying section of the developing apparatus as a toner containing apparatus and a toner supplying apparatus, whereby a toner bank arrangement position is not restricted, an extremely simple operability can be achieved for supplying toner to the toner bank, and further a large volume toner bank is obtained. Accordingly, it becomes possible to provide a large-volume toner containing/supplying apparatus having a higher degree of freedom on a layout of the body of the apparatus.

According to the image forming apparatus of a tenth aspect of the present invention, in an image forming apparatus as discussed with respect to the ninth aspect of the invention, there is no opening portion of another toner container in a position where toner is dropped for supplying to the toner bank from an opening portion of the above-described toner container. In other words, in the image forming apparatus of the tenth aspect, the opening portions of respective toner containers are arranged so as not to interfere with each other, whereby toner containers are not contaminated with toner at supplying toner from any toner container to the toner bank.

According to the image forming apparatus of an eleventh aspect of the present invention, in an image forming apparatus as described with respect to the ninth aspect, the opening portions of the toner containers are sealed with removable caps with a mechanism for removing or fitting the caps. In other words, in this apparatus, the opening portions of the toner containers are sealed with removable caps and there is provided a mechanism for opening or closing the caps, whereby the toner containers can be easily exchanged and further toner contamination can be avoided at exchanging the containers.

According to a twelfth aspect of the present invention, there is provided an image forming apparatus having a developing apparatus for making a latent image on a latent image carrier visible with toner and a toner supplying apparatus for supplying the toner to the developing apparatus, wherein the toner supplying apparatus includes a plurality of toner bottles with opening portions for supplying the toner to the developing apparatus and a detecting mechanism for detecting toner residue and wherein, if a toner end is detected for a first toner bottle in the above described toner bottles by the above described detecting mechanism, a toner supply is started from a second toner bottle for which a toner end is not detected.

According to a thirteenth aspect of the present invention, there is provided an image forming apparatus in an electrophotographic system, having a developing apparatus for making a latent image on a latent image carrier visible with toner, a toner bank for storing toner to be supplied to the developing apparatus, the toner bank being arranged apart from the developing apparatus, and a toner delivering mechanism for delivering toner from the toner bank to the developing apparatus, the toner bank having a plurality of toner containing members containing toner, wherein the toner containing members include toner bottles individually removable from the image forming apparatus during driving of the image forming apparatus, wherein a toner-end detecting mechanism for detecting a toner end for each toner bottle is arranged in a toner bottle containing section for containing respective toner bottles, and wherein, if a toner end is detected for a toner bottle that is currently supplying toner, a toner supply is started to be fed from another toner bottle for which a toner end is not detected yet.

According to a fourteenth aspect of the present invention, in an image forming apparatus as described in reference to the thirteenth aspect, there is provided a toner-end indicating mechanism for indicating a toner end for each toner bottle contained in a corresponding toner bottle containing section near each toner bottle containing section described above.

According to a fifteenth aspect of the present invention, in the image forming apparatus as described in reference to the thirteenth aspect, there is provided an empty bottle indication mechanism for displaying a location of a toner bottle for which a toner end is detected and an indication thereof is displayed on an operator screen of the image forming apparatus.

According to a sixteenth aspect of the present invention, there is provided an image forming apparatus having a developing apparatus for making a latent image on a latent image carrier visible with toner and a toner supplying apparatus for supplying the above toner to the developing apparatus, wherein the above developing apparatus includes a plurality of toner bottles with opening portions for supplying the toner and wherein a toner containing section of each of the toner bottles is rotated around its axis to supply the toner from the toner bottles to the developing apparatus.

According to a seventeenth aspect of the present invention, there is provided an image forming apparatus having a developing apparatus for making a latent image on a latent image carrier visible with toner and a toner supplying apparatus for supplying the toner to the developing apparatus, equipped with a plurality of toner bottles vertically arranged in an upper portion of the developing apparatus with opening portions for discharging the toner and an opening mechanism for opening or closing the opening portions arranged so as to be opposite to the opening portions of the toner bottles, wherein a toner discharging mechanism for discharging the toner from each of the toner bottles includes a mechanism for rotating the toner bottle around its axis and a mechanism for driving the above opening mechanism and wherein the above toner discharging mechanism discharges the toner in the toner bottle by rotating the toner bottle with its opening portion being opened.

According to an eighteenth aspect of the present invention, in the image forming apparatus as discussed with respect to the seventeenth aspect of the invention, the toner discharging mechanism is set to operate according to a timing sequency for discharging the toner in the above toner bottle from the opening portion by rotating the toner bottle corresponding to a signal from a toner residue detecting sensor arranged in a moving path of the toner.

According to a nineteenth aspect of the present invention, in an image forming apparatus as discussed with respect to the seventeenth aspect of the invention, the toner discharging mechanism arbitrarily selects one of the above plurality of toner bottles and drives the toner bottle rotation mechanism and the opening mechanism to set a single toner bottle independently among the plurality of toner bottles in a toner supply state.

According to a twentieth aspect of the present invention, in the image forming apparatus as discussed with respect to the eighteenth or nineteenth aspects of the invention, the toner discharging mechanism is able to indicate externally a toner bottle in which contained toner is used up based on a signal from a toner-end detecting mechanism arranged in the toner moving path.

According to a twenty-first aspect of the present invention, there is provided an image forming apparatus having a developing apparatus for making a latent image on a latent image carrier visible with toner and a toner supplying apparatus for supplying the toner to the developing apparatus, equipped with a plurality of toner bottles with opening portions for supplying the toner to the developing apparatus and a detecting mechanism for detecting toner residue, wherein the toner residue of a first toner bottle that supplies toner among the above toner bottles is detected by the detecting mechanism so as to start supplying toner from a second toner bottle based on the detection signal.

According to a twenty-second aspect of the present invention, there is provided an image forming apparatus having a plurality of toner bottles having opening portions for supplying toner to a developing apparatus for development with toner, a toner sensor arranged in the developing apparatus, an opening mechanism for opening or closing the opening portions, a toner discharging mechanism for discharging toner in the toner bottles to supply the toner to the developing apparatus, and a controlling mechanism for driving and controlling the opening mechanism and the toner discharging mechanism based on a signal from the toner sensor, the controlling mechanism driving the opening mechanism to open the opening portions of the toner bottles and the discharging mechanism being driven so as to supply toner to the developing apparatus, wherein the controlling mechanism starts to supply toner from a second toner bottle in addition to toner supplied from a first toner bottle based on a signal from the toner sensor indicating that the first toner bottle, supplying toner among the above toner bottles, becomes completely or almost empty.

According to a twenty-third aspect of the present invention, in the image forming apparatus as discussed with respect to the twenty second aspect, the toner bottles have spiral projections on their inner walls for transmitting toner to the opening portions with a rotation of the toner bottles and the toner discharging mechanism discharges toner in the toner bottles by driving the toner bottles rotatively to supply the toner to the developing apparatus.

According to a twenty-fourth aspect of the present invention, in the image forming apparatus as discussed with respect to the twenty-second or twenty-third aspects, the controlling mechanism stops supplying toner from the first toner bottle by halting the discharging mechanism after an elapsed certain period of time beginning from when toner is begun to be supplied from the second toner bottle.

According to a twenty-fifth aspect of the present invention, in the image forming apparatus as discussed with respect to the twenty-fourth aspect, the controlling mechanism closes the opening portion of the first toner bottle by using the opening mechanism after the elapsed certain period of time.

According to a twenty-sixth aspect of the present invention, in the image forming apparatus as discussed with respect to the twenty-second to the twenty-fifth aspects, there is provided a mechanism for restricting a removal of the toner bottle unless the opening mechanism closes the opening portion of the toner bottle.

According to a twenty-seventh aspect of the present invention, in the image forming apparatus as discussed with respect to the twenty-sixth aspect, the above mechanism includes a toner bottle fastening member which occupies a first position where it is engaged with a part of the above toner bottle or a second position deviated from the above part of the toner bottle, an operating member for moving the above toner bottle fastening member from first position to the second position, and a locking member for inhibiting the toner bottle fastening member from being moved to the second position by the operating member.

According to a twenty-eighth aspect of the present invention, in the image forming apparatus as discussed with respect to the twenty-second to twenty-seventh aspects, there is provided an indicating mechanism for indicating that a toner bottle which has been used is empty.

As described above, an advantage offered by the first aspect of the invention is that a stirring member is rotated in a toner outlet position of a powder pump to stir toner which passes the outlet position with the rotation of the stirring member so as to flow when toner is delivered, and therefore this stirring action prevents a toner flow from being stopped, as is the case with conventional apparatuses when toner aggregated by a frictional heat between a stator and a rotor of the powder pump passes the narrow toner outlet position, whereby it is possible to prevent toner clogging in the toner outlet position of the powder pump.

An advantage offered by the second aspect of the invention is that a wire is used as a stirring member which is wound in spiral in a direction that toner is delivered when it is rotated, and therefore this stirring member is useful to prevent toner clogging in an outlet position of a powder pump and to improve toner delivery characteristics.

An advantage offered by the third aspect of the invention is that a toner bank for storing toner is placed in the side of the main body so as to be apart from a developing apparatus and there is provided a toner delivering mechanism for delivering toner from the toner bank to the developing apparatus, and therefore its layout is not restricted and a degree of freedom is considerably increased by virtue of its layout, whereby a structure can be made in consideration of operability or functional characteristics, and since two or more toner bottles are arranged in the toner bank, a toner volume can be increased by increasing the number of bottles according to a size of a machine to be used by using toner bottles used for a small-sized machine and therefore a large-volume of a toner bank is achieved and toner bottles can be used in common independently of a machine size. Accordingly, there can be provided an image forming apparatus including a toner supplying apparatus with a reliable large-volume toner bank having an increased degree of freedom and improved operability and it is effective to promote recycling of toner bottles so as to achieve a global environment protection (resource protection).

An advantage offered by the fourth aspect of the invention is that toner bottles are arranged in a given direction, a plurality of toner bottles are vertically arranged, and caps of individual toner bottles are opened or closed independently, and therefore a simple configuration is achieved for a toner delivery section in the toner bank and toner blocking can be prevented in the toner delivery section.

An advantage offered by the fifth aspect of the invention is that there is provided only a single toner delivery path to the side of the developing apparatus at the bottom of the toner bank, and therefore a simple and low-cost apparatus can be provided.

An advantage offered by the sixth aspect of the invention is that a powder pump is used as a toner delivery mechanism from a toner bank to a developing apparatus, and therefore a degree of freedom on a layout of a delivery path is increased and a simple and low-cost apparatus can be provided.

An advantage offered by the seventh aspect of the invention is that there is provided a stirring member which rotates with a rotor in an outlet position of the above powder pump, and therefore it is possible to prevent toner clogging in the outlet position of the powder pump so as to improve toner delivery characteristics.

An advantage offered by the eighth and ninth aspects of the invention is that an image forming apparatus includes a toner bank for containing a plurality of toner containers which are cylindrical containers in which toner is contained each having an opening portion at an end of the cylinder and a flexible toner delivering means for delivering toner from the toner bank to a toner supplying section of a developing apparatus, and therefore an arrangement position of the toner bank is not restricted, toner supplement characteristics to the toner bank is extremely simple, and a large-volume toner bank is achieved. Accordingly, it is possible to provide a large-volume toner containing/supplying apparatus having a higher degree of freedom on a layout to the main body of the apparatus.

Furthermore, according to the invention, it is possible to provide an image forming apparatus including a large-volume toner containing/supplying apparatus (a toner bank and toner delivering means) which enables a reduction of a down time of the machine and which has a higher reliability of toner supplying performance and a superior operability of toner supplying operation, and maintains a suitable range of sizes of the developing apparatus and the main body of the apparatus.

An advantage offered by the tenth aspect of the invention is that opening portions of respective toner containers are arranged so as not to interfere with each other and therefore the toner containers are not contaminated with toner when supplying toner from any toner container to the toner bank, whereby it is possible to prevent an operator's hands from being smeared with toner when exchanging the toner bottles or to prevent toner from being scattered thereabout.

An advantage offered by the eleventh aspect of the invention is that the opening portions of the toner containers are sealed with removable caps and an opening/closing mechanisms for the caps are arranged, and therefore the toner containers can be easily exchanged and toner contamination can be avoided when exchanging toner containers.

An advantage offered by the twelfth and thirteen aspects of the invention is that toner can be replenished easily and quickly without interrupting an operation of the image forming apparatus.

An advantage offered by the fourteenth aspect of the invention is that it is possible to recognize easily a specific position of an empty toner bottle to be replaced.

An advantage offered by the fifteenth aspect of the invention is that it is possible to recognize the number of the toner bottles to be replaced and their positions easily in advance, so that the toner bottles can be quickly exchanged.

An advantage offered by the sixteenth and seventeenth aspects of the invention is that each toner bottle is pivoted on its axis, and therefore unlike the conventional configuration, the toner bottle itself need not be displaced. Accordingly, the toner bottles can be arranged in a simple structure in which they are vertically stacked and therefore a structure for discharging toner does not need a large space unlike the conventional one in which a plurality of toner bottles are circumferentially rotated based on a central point other than the axis of the toner bottles, and also in the configuration, a simple configuration is obtained since it does not need a configuration in which a plurality of toner bottles are circumferentially rotated at a time.

An advantage offered by the eighteenth aspect of the invention is that toner in a toner bottle is gradually discharged based on a timing sequence determined by a signal from a toner residue detecting sensor, and therefore a large amount of toner is not discharged from the toner bottle unlike the conventional apparatus. Thus, it is possible to decrease a volume of a portion to which toner discharged from the toner bottle is supplied so as to prevent an increase of the size of the apparatus.

An advantage offered by the nineteenth aspect of the invention is that one of the toner bottles can be put in a toner supplying stance independently, and therefore unlike the conventional apparatus, a selected toner bottle need not be moved to a supplying position. Thus, this apparatus does not require a time for moving the toner bottle before starting a toner supply, whereby it is possible to improve an operability of the apparatus since the toner supply can be started quickly and simplifies a configuration for selecting the toner bottle.

An advantage offered by the twentieth aspect of the invention is that an indicator is displayed signifying whether or not a selected toner bottle contains toner, so as to inform an operator. Therefore, it is possible to prevent missing an exchanging time for toner bottles and further to prevent a possibility of a stopped operation of a developing apparatus. Further, the operator can easily determine which toner bottle should be selected and when it should be changed. Furthermore, since an exchanging time can be precisely displayed, contamination with toner can be avoided though it often occurs in conventional apparatuses when exchanging toner bottles when toner still remains in it. Thus, an operability can be improved in selecting or exchanging toner bottles.

An advantage offered by the twenty-first and twenty-second aspects of the invention is that even if a decrease of a toner amount in a first toner bottle causes a decrease of a toner supplying amount from the first toner bottle, a toner supply is started from a second toner bottle at a timing sequence based on a signal from a toner sensor, and therefore toner can be supplied always and stably.

An advantage offered by the twenty-third aspect of the invention is that a toner bottle having a spiral projection on its inner wall is configured so as to be pivoted on the axis by a toner discharging means and therefore the toner bottle itself need not be displaced unlike with the conventional configuration. Accordingly, a structure for discharging toner does not need a large space, unlike a conventional one in which a plurality of toner bottles are circumferentially rotated based on a central point other than the axis of the toner bottles, so as to have a simple configuration.

An advantage offered by the twenty-fourth aspect of the invention is that a toner supply from the above-described first toner bottle is stopped by halting the above discharging means after an elapsed certain period of time beginning from starting a toner supply from the second toner bottle, and therefore toner in the toner bottle is completely used up so as to prevent wasting toner and to cut down on waste power consumption, which improves economical efficiency.

An advantage offered by the twenty-fifth aspect of the invention is that an opening portion of a first toner bottle is closed after an elapsed certain period of time, and therefore it is possible to prevent scattering of toner attached to an inside of the toner bottle or its opening portion.

An advantage offered by the twenty-sixth aspect of the invention is that there is provided a mechanism for restricting a removal of a toner bottle unless an opening portion of the toner bottle is closed by an opening means, and therefore it is possible to prevent scattering of toner remaining inside the toner bottle or toner attached to the opening portion when exchanging toner bottles or during maintenance or inspection operations and it is possible to prevent such a condition that the toner bottle cannot be opened after exchanging the bottles which may be caused if an operator forgets to withdraw a cap which has been removed and remained in the apparatus when exchanging the toner bottles.

An advantage offered by the twenty-seventh aspect of the invention is that removal of a toner bottle is controlled by a mechanism having a toner bottle fastening member which occupies a first position where it is engaged with a part of the toner bottle or a second position deviated from the above part of the toner bottle, an operating member for moving the above toner bottle fastening member from the first position to the second position, and a locking member for inhibiting the toner bottle fastening member from being moved to the second position by the operating member, and therefore the toner bottle can be removed or inhibited to be removed without fail in a simple configuration with a toner bottle fastening member.

An advantage offered by the twenty-eighth aspect of the invention is that it is indicated is made regarding whether a selected toner bottle contains toner, and therefore an operator can discriminate the toner bottles. Accordingly, it is possible to determine easily which toner bottle should be selected or when the toner bottle should be changed, so as to prevent missing a time for exchanging toner bottles.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
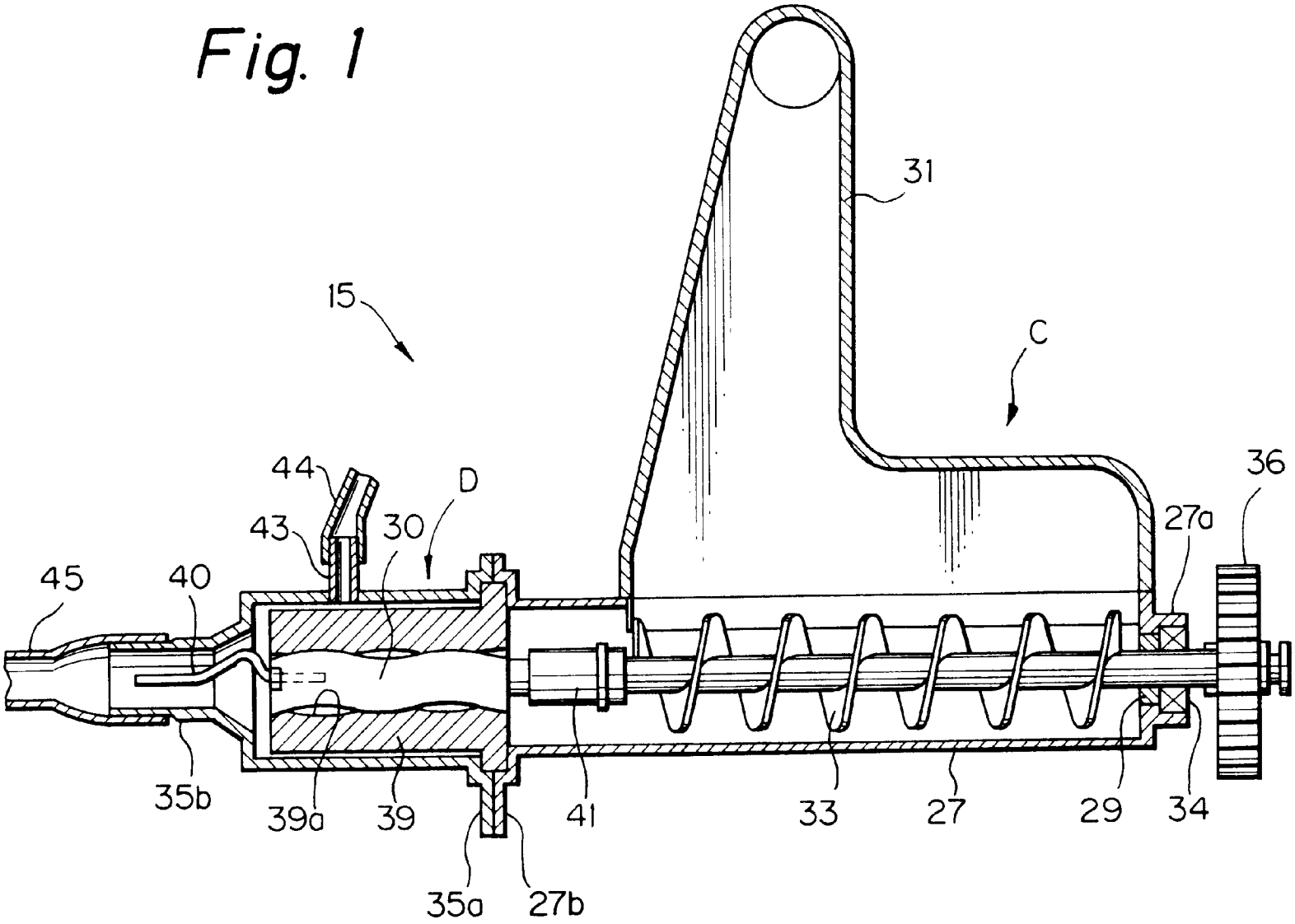
FIG. 1 is a longitudinal sectional view of a toner delivering apparatus in an image forming apparatus of an embodiment according to the invention.

So as to facilitate review of the above-identified drawings the following legend of selected element labels is provided:

15 Toner delivering apparatus

30 Rotor

35*b* Outlet

40, 55 Stirring members

D Power pump

106 Developing apparatus

106N Toner residue detecting mechanism

131 Photosensitive drum

220 Toner bottle

300 Toner bank

330 Powder pump unit as toner delivering mechanism

341A, 341B, 341C Toner-end sensor as toner-end detecting mechanism

350 Toner supplying pipe as toner delivering mechanism

351 Indication as an empty bottle indicating mechanism

352 Message display as an empty bottle displaying mechanism

T Toner

408 Toner supplying apparatus

409 Toner bottle

409A Opening portion

409B Projection

415 Slider which is a component of an opening mechanism

416 Chuck which is a component of an opening mechanism

418 Driving motor which is a component of a toner discharging mechanism

420 Toner bottle fastening member

423 Operating member

429 Locking member

C Control section

DETAILED DESCRIPTION OF THE PREFERRED EMBODIMENT

Figure 3:
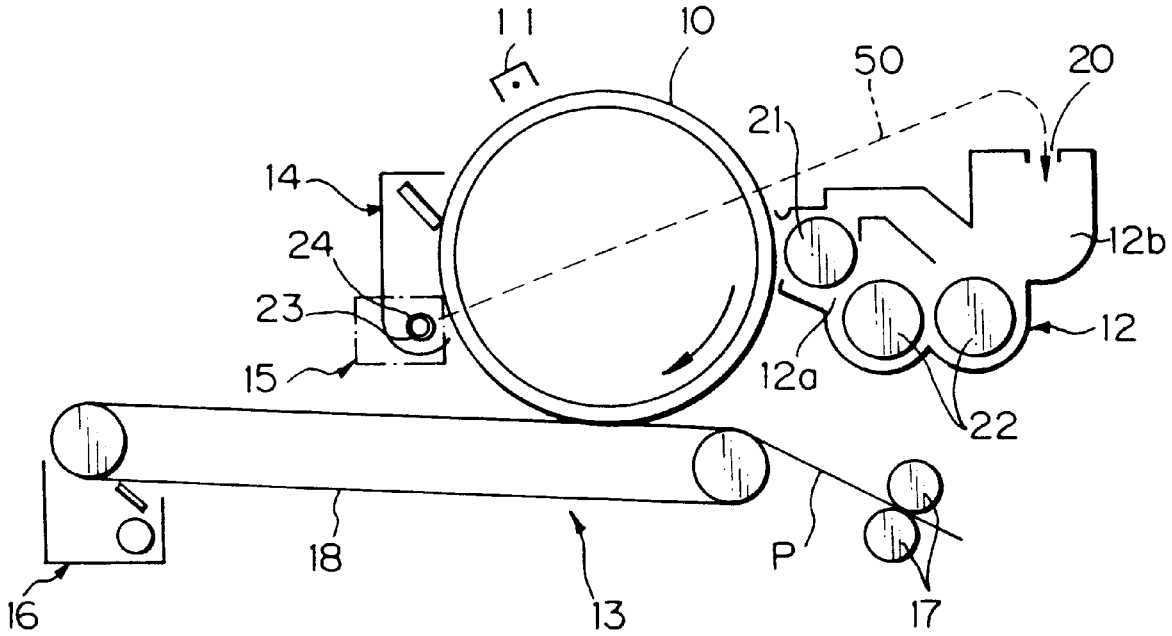
FIG. 3 is a schematic configuration diagram of the image forming apparatus.

Referring now to the drawings, wherein like reference numerals designate identical or corresponding parts throughout the several views, and more particularly to FIG. 3 thereof, there is illustrated a schematic diagram of a recording section of a laser printer, which is but one example of an image forming apparatus to which the present invention is applied.

The printer has a drum-shaped photosensitive body 10 placed almost in a center of the printer body. In sequential peripheral portions of the photosensitive body 10, the printer includes a charging apparatus 11, a developing apparatus 12, a transfer belt apparatus 13, and a photosensitive body cleaning apparatus 14, each described in order corresponding to a rotational direction of the drum-shaped photosensitive body 10 indicated by an arrow. In addition, in the inner side of the photosensitive cleaning apparatus 14, there is provided a toner delivering apparatus 15 indicated by a chained (i.e., broken, but not dashed, line). Further, in a lower-left portion of the transfer belt apparatus 13, there is provided a transfer belt cleaning apparatus 16.

In a recording operation, a sheet P is transferred from a lower-right portion of FIG. 3, and then delivered to a lower side of the photosensitive body 10 under a timing sequence controlled by way of resist rollers 17. As for the photosensitive body 10, a surface is charged by the charging apparatus 11 when passing by the charging apparatus 11, a static latent image is formed on the surface by being irradiated with a laser beam from an optical writing mechanism (which is not shown), and then the static latent image is sequentially made visible with toner being attached thereto when the image passes the developing apparatus 12. Next, after the visible image is transferred to the sheet P by the transfer belt apparatus 13, the sheet P is delivered to a fixing apparatus (which is not shown) by the transfer belt apparatus 13, where the visible image is fixed by the fixing apparatus, and then the sheet P is output from the apparatus.

On the other hand, after the visible image is transferred, remaining toner on the photosensitive body 10 is removed, so as to be salvaged, by the photosensitive body cleaning apparatus 14, and toner attached to the transfer belt 18 is removed so as to be salvaged by the transfer belt cleaning apparatus 16.

To be reused for development the subsequent visible images, the toner salvaged by the photosensitive body cleaning apparatus 14 is transmitted (i.e., transferred or transported) to the toner delivering apparatus 15 and then delivered to the developing apparatus 12 through a delivery path 50 indicated by a dashed line with an arrow in FIG. 3 by the toner delivering apparatus 15.

In the developing apparatus 12, as shown in FIG. 3, a developing roller 21 and a stirring/delivering member 22 are rotatably arranged in a developing section 12*a* in a development case and a toner supplying aperture 20 is arranged on a top of a toner supplying section 12*b*.

Figure 2:
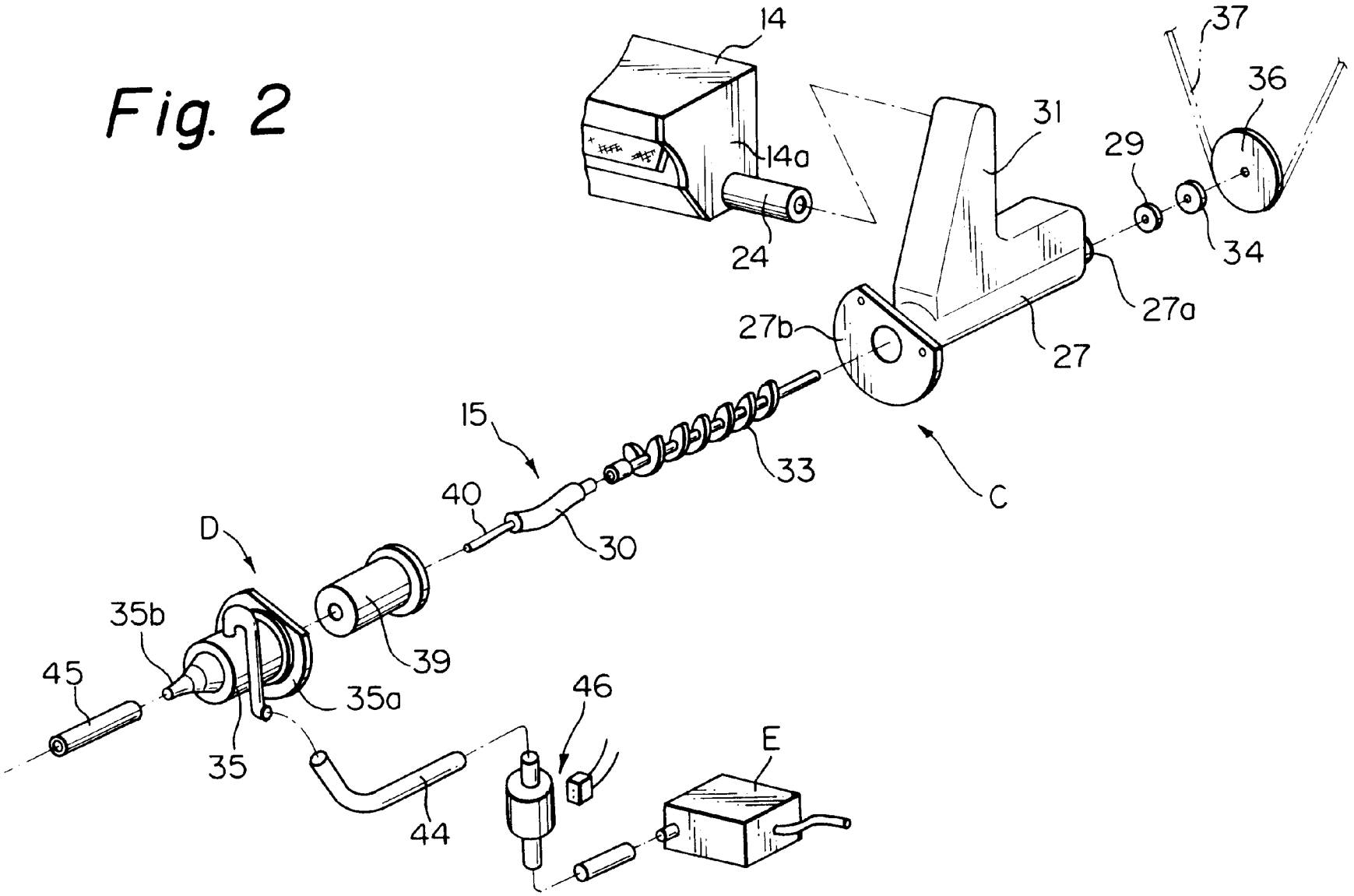
FIG. 2 is an exploded perspective view of the toner delivering apparatus.

In the photosensitive body cleaning apparatus 14, a toner discharging path is formed from a far bottom inner side to a near bottom inner side as shown in FIG. 3, and a toner delivering screw 23 is rotatably arranged in this toner discharging path. In addition, a discharging tube 24 communicating with the apparatus 14 is arranged in the inner side of the toner discharging path, and the discharging tube 24 protrudes from the side in the inner side of a cleaning case 14*a* as shown in FIG. 2. Then, the photosensitive body cleaning apparatus 14 is connected to the toner delivering apparatus 15 through the discharging tube 24.

The toner delivering apparatus 15, as shown in FIGS. 1 and 2, includes a toner transmitting mechanism and a powder pump indicated by reference numerals C and D, respectively. With a side plate (which is not shown) arranged in the inner side of the above printer body between them, the toner delivering apparatus 15 is arranged in an outside opposite to the photosensitive body cleaning apparatus 14 and being supported by the side plate.

The toner transmitting mechanism C has an oblong transfer guide case 27, at an end of which there is provided a tube having a short diameter 27*a* and at the other end of which a flange 27*b* is arranged in its outer periphery. A sealing member 29 is fitted in the short-diameter tube 27*a*, while an L-shaped connection case 31 is attached to the outer peripheral portion and the discharging tube 24 and is inserted into the upper end portion of the connection case 31 so as to communicate with the inside of the cleaning case 14*a*.

A horizontal delivery screw 33 is arranged in the transfer guide case 27 with an end thereof being rotatably held by the short-diameter tube 27*a* through a bearing member 34. Further, a belt 37 for transmitting a rotation from a driving motor (not shown) is suspended on a pulley 36 which is arranged at the end of the horizontal delivery screw 33, while a rotor 30 of the powder pump D is connected at the other end of the screw.

The powder pump D has a cylindrical pump case 35, at an end of which a flange 35*a* is arranged in its outer periphery and at the other end of which an outlet 35*b* is arranged. A cylindrical stator 39 is fixedly inserted into a pump case 35 and then a rotor 30 made of stainless steel is rotatably arranged in the stator 39. The stator 39, which is made of an elastic material such as rubber, is formed so as to have a diameter which is spaced about 1-mm away from an inside of the pump case 35 as shown in FIG. 1 when it is fixed to the pump case 35, and a spiral slot 39*a* is formed in an inner circumference of the stator 39.

The rotor 30 is a torsion-shaped shaft member made of stainless steel, with one end thereof being connected to the horizontal delivery screw 33 through a joint 41 and having attached thereto at the other end a stirring member 40.

The stirring member 40, for example, is a thin rod made of stainless steel having a 2-mm diameter, although the rod can be made of rigid plastic. The member 40 is partially curved almost in a middle portion thereof as shown in FIG. 1., and it is arranged in an outlet portion 35*b* with its base end being pressed into a hole on the other end surface of the rotor 30.

Further, in the powder pump D, an air supplying tube 43 is arranged in an outer peripheral portion of the pump case 35, and the air supplying tube 43 is connected to an air transfer pipe 44 of an air pump indicated by a reference numeral E in FIG. 2. In addition, there is provided an air detector 46 that detects whether air is passing through the air transfer pipe 44 and is placed in the middle of the air transfer pipe 44.

The powder pump D is connected to an end of a toner transfer pipe 45 in the outlet 35*b*. The toner transfer pipe 45 is made of a flexible pipe material such as, for example, nonrigid PVC, nylon, and the like. Accordingly, the pump case 35 is screwed on the transfer guide case 27 with its flange 35*a* fitted to a flange 27*b*.

Then, the toner transfer pipe 45 is pointed toward the toner supplying aperture 20 (FIG. 3) on the developing apparatus as indicated by a dashed line with an arrow in FIG. 3 and then the toner transfer pipe 45 is connected to the toner supplying aperture 20 at the other end of the toner transfer pipe 45. Thus, the above-described delivery path 50 is formed with a connection of the toner transfer pipe 45 between the photosensitive body cleaning apparatus 14 and the developing apparatus 12.

In the above-described printer shown in the figures, the salvaged toner removed from the photosensitive body 10 by the photosensitive body cleaning apparatus 14 is delivered through the toner discharging path with a rotation of the toner discharging screw 23, discharged from the discharging tube 24, and then dropped into the transfer guide case 27 through the connection case of the toner delivering apparatus 15.

In the toner delivering apparatus 15, the above driving motor is driven to transmit the rotation to the horizontal delivery screw 33 through the belt 37 and a pulley 36. Then, with the horizontal delivery screw 33, the rotor 30 and the stirring member 40 are rotated integrally. First, with a rotation of the horizontal delivery screw 33, the salvaged toner is transmitted into the stator 39 of the powder pump D. Further, with a rotation of the rotor 30, the toner is transmitted as if it were pressed out from the stator 39 to the toner transfer pipe 45 through the outlet 35*b*, and an air flow is introduced into the pump case 35 from an air supplying tube 43 through an air transfer pipe 44 by an air pump E so as to be transmitted to the toner transfer pipe 45.

At this point, the salvaged toner passing the narrow outlet 35*b* and is transmitted to the toner transfer pipe 45 while being stirred so as to flow with a rotation of the stirring member 40. Then, the toner is delivered along the air flow in the toner transfer pipe 45 so as to be returned to the toner supplying section 12*b* of the developing apparatus 12.

Figure 4:
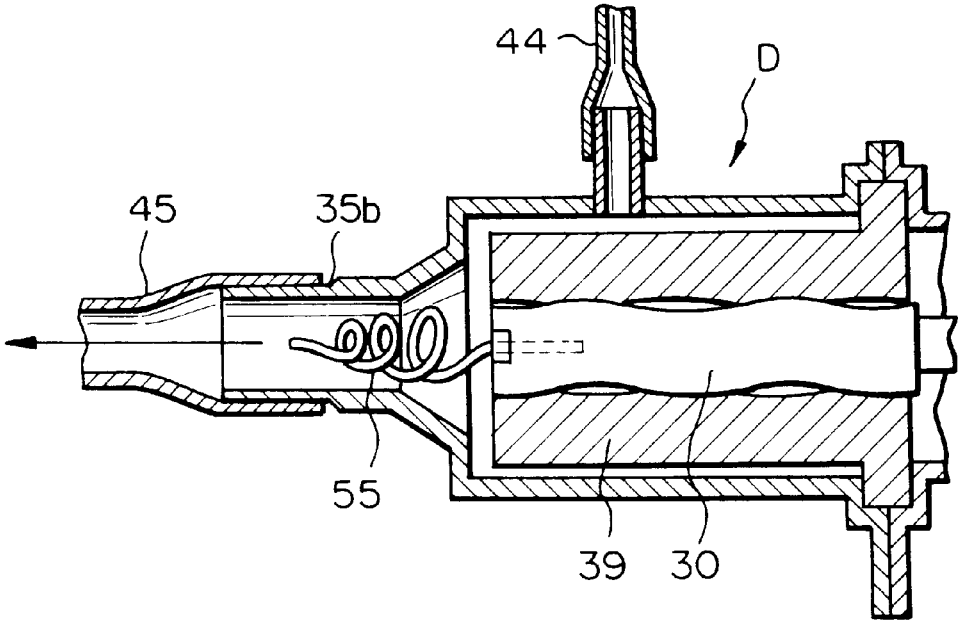
FIG. 4 is a main portion longitudinal sectional view illustrating a modification of the embodiment of the toner delivering apparatus.

In an alternative example as shown in FIG. 4, a stirring member 55 is in a form of a spiral that is wound in a direction in which salvaged toner is delivered toward the portion indicated by an arrow, in FIG. 4, when it is rotated. In addition, the shape of the stirring member is that of a coil whose diameter becomes gradually smaller so as to fit a shape of a port of the outlet 35*b*.Thus, the toner is delivered to the toner transfer pipe 45 while being stirred at the outlet 35*b* by a rotation of the stirring member 55 when the stirring member 55 is rotated.

The toner delivering apparatus 15 in the above embodiment delivers the toner salvaged by the photosensitive body cleaning apparatus 14 to the developing apparatus 12. It is also possible, however, to have a configuration in which the above described transfer belt cleaning apparatus 16 is connected to the developing apparatus 12 by a delivery path so as to deliver the toner salvaged by the transfer belt cleaning apparatus 16 to the developing apparatus 12 through the delivery path.

Alternatively, the used toner may be delivered to a disposal toner tank to dispose of the toner directly. As another alternative, if the toner is not used yet, the configuration is also applied to deliver toner from the toner tank containing the toner to the developing apparatus.

Figure 5:
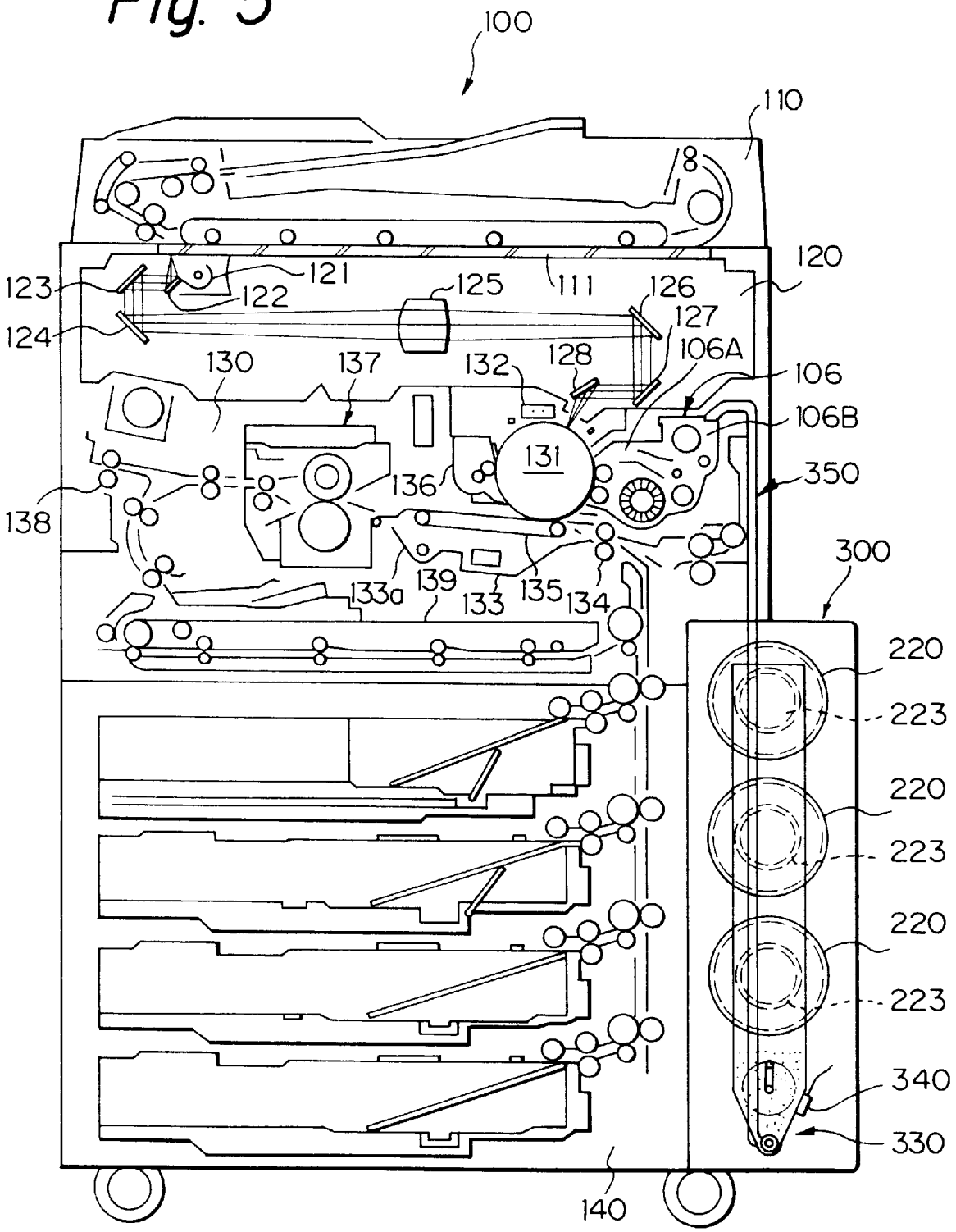
FIG. 5 is a schematic configuration diagram of an image forming apparatus illustrating an embodiment of the invention.

FIG. 5 is a schematic configuration diagram of an image forming apparatus showing another embodiment of the present invention. In FIG. 5, there is shown an example of an image forming apparatus which is a copying machine. A copying machine body 100 includes an automatic document feeder (ADF) 110, an exposing section 120 for forming an image in a conventional known electrophotographic system, an image forming section 130, and a paper feeding section 140. The exposing section 120 is configured in an exposure optical system having a light source 121 for putting light on a document (not shown) placed on a contact glass 111 by the ADF 110 or with a manual insertion, mirrors 122, 123, 124, 126, 127, 128 and a lens 125 for exposing a reflected light image from the document on a photosensitive drum 131 which is a latent image carrier of the image forming section 130.

The image forming section 130 includes a photosensitive drum 131, and a charging apparatus 132, a developing apparatus 106, a resist roller 134, a transfer belt apparatus 133, a photosensitive body cleaning apparatus 131, a fixing apparatus 137, a paper output roller 138, and a transfer paper reversing/delivering section 139, arranged around the photosensitive drum 131, as shown in FIG. 5. In the paper feed section 140, a plurality of paper feed cassettes are set and contain transfer paper in various sizes. Although the above exposing section 120 is an example of an analog-type exposure optical system, it can serve as a laser printer if it is configured in a system in which an image is optically recorded on the photosensitive drum based on an image signal by using a laser scan optical system in which a laser light source and a deflector are used as an exposing section, and it can serve as a digital copying machine or a facsimile if a document reader is arranged between the ADF 110 and the exposing section 120.

In FIG. 5, when an image forming operation is started, the photosensitive drum 131 is charged by the charging apparatus 132 and then exposed with a document image from the exposing section 120 so that a static latent image is formed on a surface of the drum 131. The static latent image is developed by developer (two-component developer or one-component developer) in the developing apparatus 106, and a toner image is formed on the photosensitive drum 131. A toner image formed on the photosensitive drum 131 is transferred to a transfer paper fed to a transfer section (a nip portion between the photosensitive drum 131 and the transfer belt 135) through the resist roller 134 from the paper feed section 140, the transfer paper to which the toner image is transferred is delivered to the fixing apparatus 137 by way of the transfer belt 135 of the transfer belt apparatus 133, and the toner image is fixed to the transfer paper by the fixing apparatus 137. The transfer paper after fixing is output to a paper output tray which is not shown via the paper output roller 138.

After transferring the toner image therefrom, the photosensitive drum 131 is cleaned by the photosensitive body cleaning apparatus 136 so as to salvage or remove remaining toner and contaminant such as paper lint. The transfer belt 135, after a transfer paper delivery operation, is also cleaned by a cleaning mechanism 133*a* in the transfer belt apparatus 133 so as to salvage or remove remaining toner and paper lint.

In FIG. 5, as a developing apparatus 106, there is shown an example in which a magnetic brush developing method is applied by using a two-component developer that includes toner and a carrier as discussed below. The developing apparatus 106 of the copying machine body 100 is connected to a toner bank 300 by a toner supplying pipe 350 having a flexible member, and toner stored in the toner bank 300 is supplied to the developing apparatus 106 through the toner supplying pipe 350.

Figure 6:
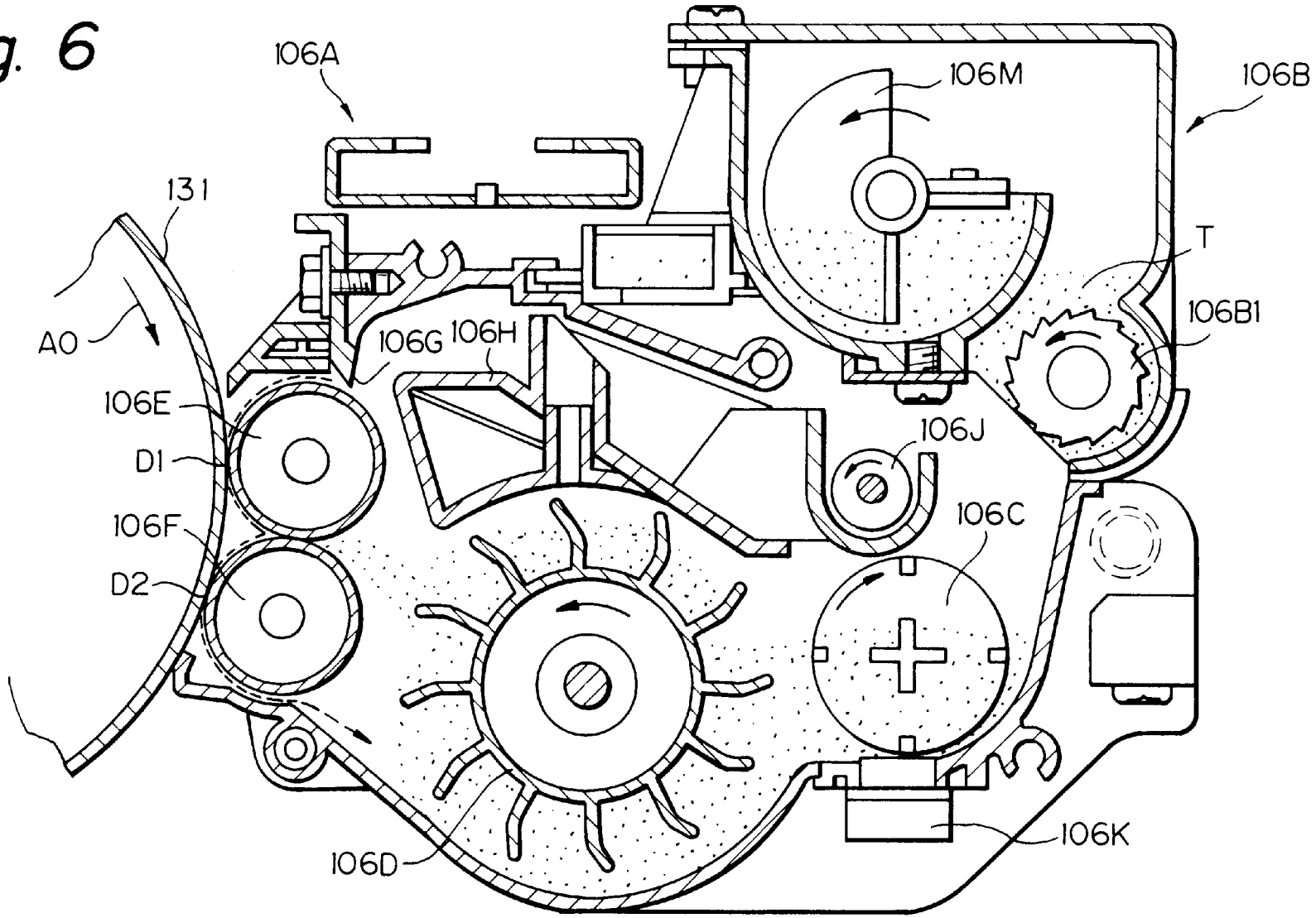
FIG. 6 is a sectional view illustrating a configuration of a developing apparatus of the image forming apparatus shown in FIG. 5.
Figure 7:
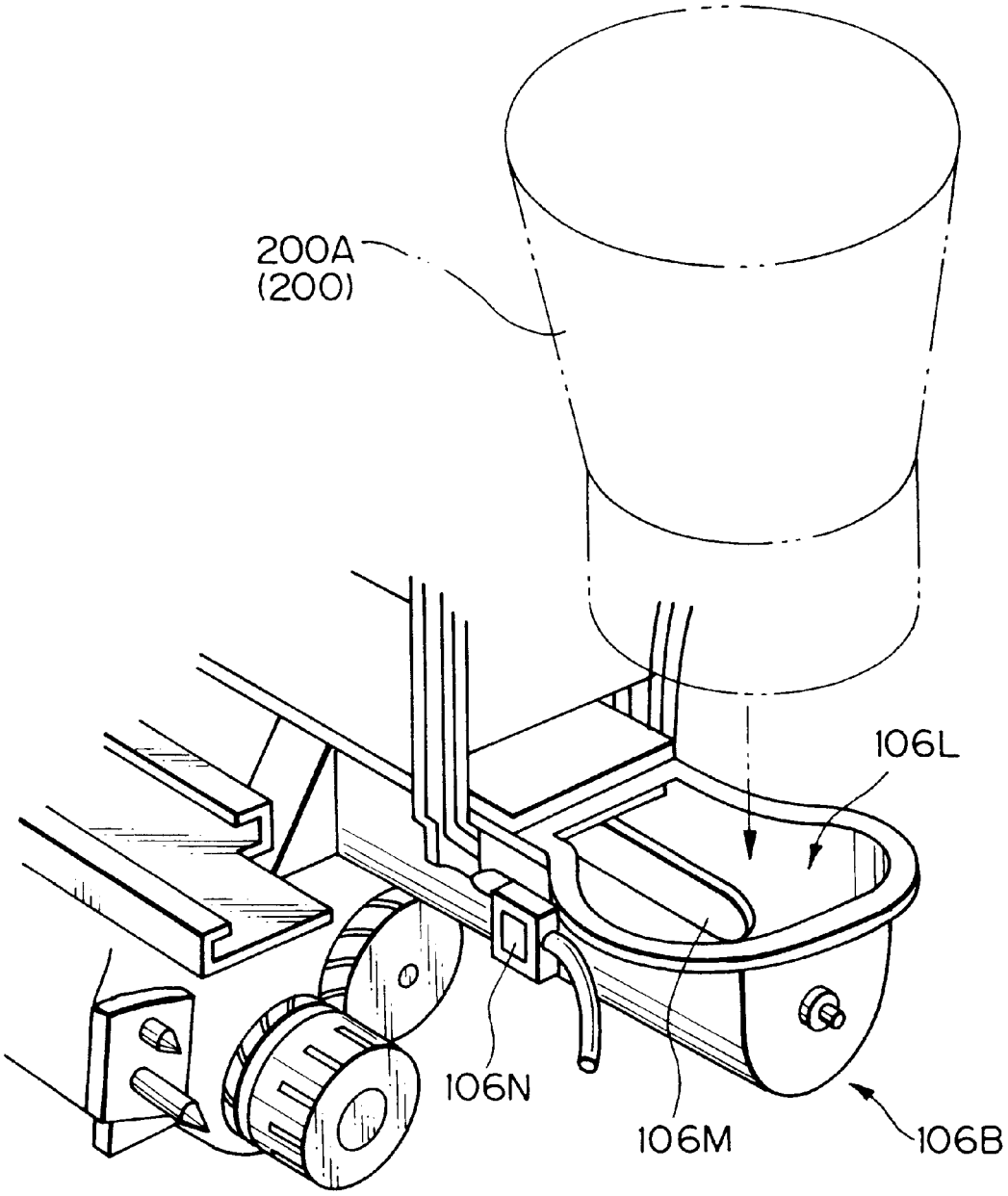
FIG. 7 is a main portion perspective view illustrating a configuration of a toner supplying section of the developing apparatus shown in FIG. 6.
Figure 8:
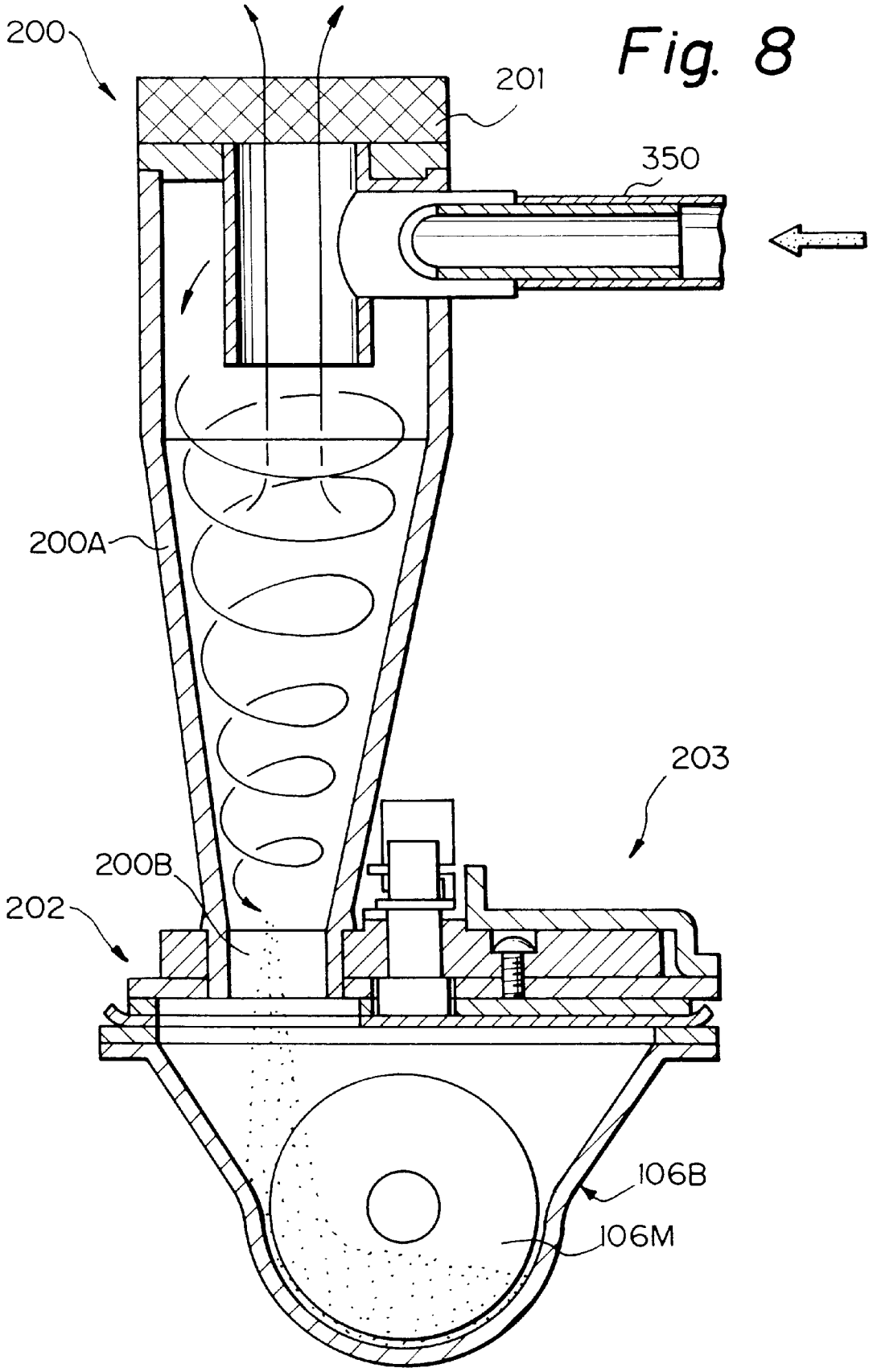
FIG. 8 is a main portion sectional view illustrating a configuration of the toner supplying section and a toner salvaging mechanism of the developing apparatus shown in FIG. 6.
Figure 9:
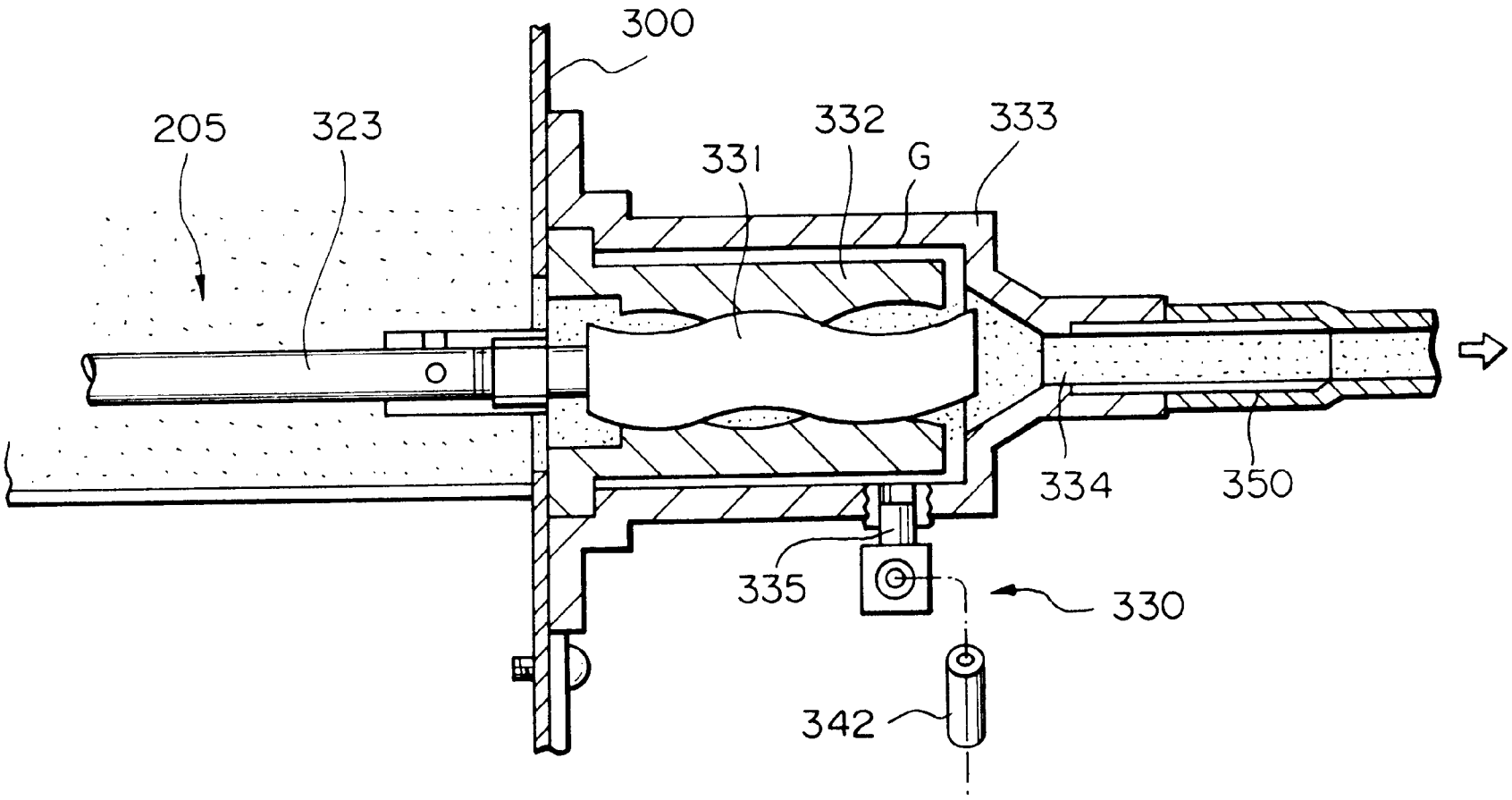
FIG. 9 is a main portion sectional view illustrating a configuration of a powder pump (Moineau-pump) forming a toner delivering mechanism for delivering toner from a toner bank to the developing apparatus.
Figure 10A:
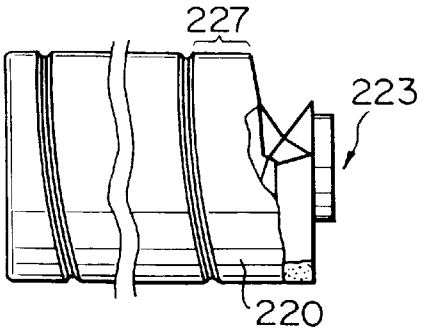
FIGS. 10*a–d* (including related FIGS. 10*a′* to 10*d′*) illustrate how toner is guided by way of a projected portion and an opening projected portion of a toner bottle.
Figure 10A:
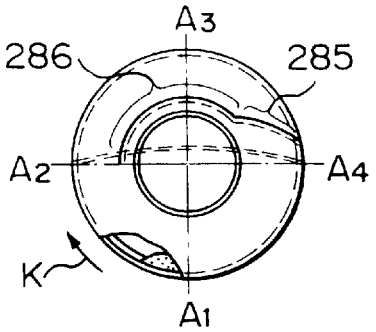
Figure 10B:
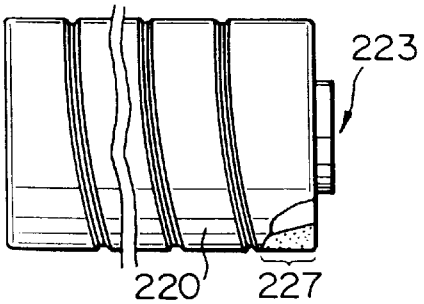
Figure 10B:
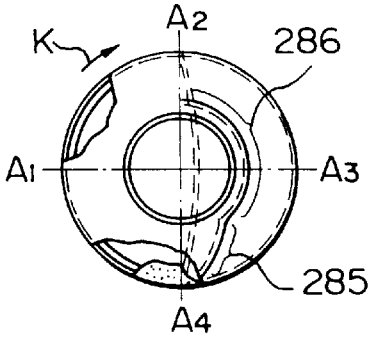
Figure 10C:
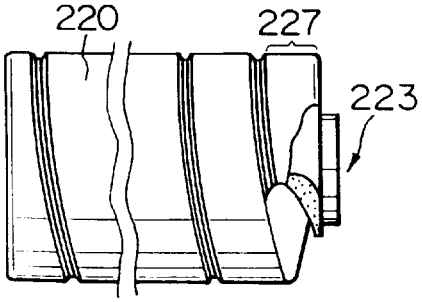
Figure 10C:
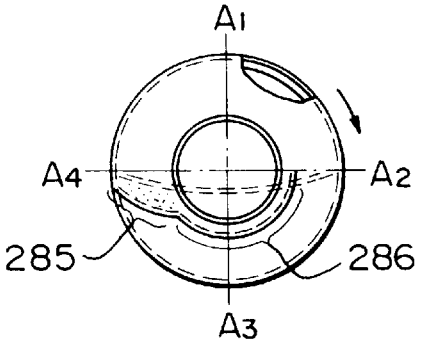
Figure 10D:
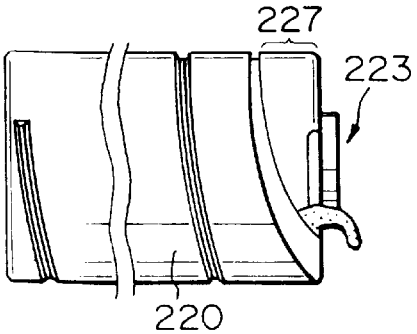
Figure 10D:
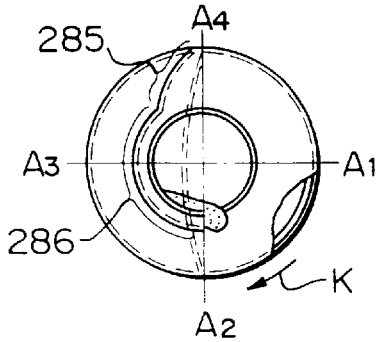

FIGS. 6 to 8 are diagrams for an explanation of a configuration of the developing apparatus 106. FIG. 9 is a main portion sectional view showing a configuration of a powder pump unit 330 for transferring toner from the toner bank 300 to the developing apparatus 106; a toner delivering mechanism includes the powder pump unit 330 and the above-discussed toner supplying pipe 350.

The toner delivering mechanism will be described below. As shown in FIG. 5, the powder pump unit 330 is arranged in a single delivery path arranged in a lower portion of the toner bank 300. As shown in FIG. 9, for this powder pump unit 330, a screw pump commonly called a Moineau-pump which is conventionally known is used, includes a rotor 331, a stator 332, and a holder 333. The rotor 331 is engaged with a driving source (such as a driving motor, not shown) via a driving shaft 323 (or a horizontal delivery screw with a screw attached to the driving shaft on its outer periphery in some cases) and the rotor 331 is rotatively driven by a rotation of the driving source. In other words, this powder pump unit 330, which includes a rotor 331 connected to the above described driving source via the driving shaft 323, a fixed stator 332 made of an elastic body such as a rubber material and surrounding the rotor 331, and a holder 333 holding the stator 332, takes in toner under the toner bank 300 from the side of the driving shaft 323 so as to deliver it toward a toner passageway (a discharging section) 334 with a rotation of the rotor 331.

In addition, there is an about 1-mm gap G between a side of the stator 332 and an inner side of the holder, the gap communicating with the toner passageway (a discharging section) 334. An air supply port 335 is provided so that air blows from the gap G to the toner passageway 334. In other words, the air supply port 335 communicates with the toner passageway 334 through an air discharging port arranged in an air pump which is not shown and an air supply tube 342. When the air pump starts to run, air blows on the toner in the toner passageway 334 via the air supply tube 342 and the air supply port 335 with a flow rate of approximately 0.5 to 1 liter/min, whereby fluid-like flow is achieved for toner which is discharged from the toner passageway 334 of the powder pump unit 330 and the toner is discharged to the toner supplying pipe 350 as aided by the air. Therefore, a toner delivery operation with the powder pump is more reliable than conventional devices.

In addition, if the stirring member 40 shown in FIG. 1 is arranged on the rotor 331 in the same manner, this combination is effective to prevent clogging in the outlet of the powder pump unit 330.

The toner which has passed the powder pump unit 330 is transmitted to a toner supplying section 106B of the developing apparatus 106 via the toner supplying pipe 350. For the toner supplying pipe 350, it is advantageous to use a material which is flexible and has excellent resistance to toner (for example, nylon, Teflon, etc.) adhering thereto. In the image forming apparatus of this embodiment, the connection between the developing apparatus 106 and the toner bank 300 is flexible, whereby a positional restriction on each arrangement is obviated and therefore it is possible to layout components of the apparatus effectively. Further, it becomes possible to achieve a large-volume toner bank 300.

Controlling when toner is supplied from the toner bank 300 to the developing apparatus 106 in this embodiment is performed by a toner residue detecting mechanism 106N (See FIG. 7) arranged in the developing apparatus 106. If a detected toner amount is at a predetermined value or lower, the above driving source and the air pump are driven so as to supply toner to the toner supplying section 106B of the developing apparatus 106. When a toner amount in the toner supplying section 106B reaches a predetermined value or greater, it is detected by the toner residue detecting mechanism 106N so as to stop the supply of toner. With these controls, the toner supplying section 106B always contains a certain amount of toner and toner is supplied to the developing container 106A reliably, so that a stable developing process is assured. Additionally, if the toner residue detecting mechanism 106N detects that the toner residue is at a predetermined value or lower when exceeding a predetermined detection count or period of time, it determines that there is no toner in the toner bank 300 and then issues an alarm which an operator can recognize on an operating section or a display which is not shown in the copying machine body 100. With these controls, it is possible to supply toner to the toner bank 300 (by exchanging the toner bottle 220 with a new bottle) at an appropriate time.

Next, the developing apparatus 106 will be described below. FIG. 6 is a sectional view illustrating an example of a configuration of the developing apparatus 106. In FIG. 6, the developing apparatus 106 includes a developing container 106A and a toner supplying section 106B; the developing container 106A is arranged near the photosensitive drum 131 which moves in a direction indicated by an arrow AO and the toner supplying section 106B is mounted on the developing container 106A. In the developing container 106A, a stirring roller 106C and a paddle wheel 106D are arranged for development, so as to scoop up a two-component developer consisting of magnetic or non-magnetic toner and magnetic carrier particles subjected to frictional electrification with opposite polarities as a result of being stirred together by the stirring roller 106C and the paddle wheel 106D. In addition, the toner supplying section 106B stirs toner T with a rotation of a toner supplying roller 106B 1 and transmits the toner toward the stirring roller 106C if a density of the toner supplied to the photosensitive drum 131 is lower.

In a position where the developer is scooped up by the paddle wheel 106D, there are arranged a plurality of (two in an example in FIG. 6) developing rollers 106E and 106F near the photosensitive drum 131. These two developing rollers 106E and 106F are respectively arranged in an upstream side and a downstream side along the moving direction of the photosensitive drum 131; the roller in the upstream side is considered to be a first developing roller 106E and the roller in the downstream side is to be a second developing roller 106F. These first and second developing rollers 106E and 106F include a developing sleeve which is rotatable in a counterclockwise direction by a driving section, which is not shown, and a magnetic roller fixed in the developing sleeve as a main portion. This developing sleeve is made of non-magnetic body such as aluminum or stainless steel. The magnetic roller includes a plastic magnet molded by mixing a ferrite magnet or a rubber magnet, and further nylon powder and ferrite powder, having a configuration in which a plurality of magnetic poles are arranged along a circumferential direction.

In the developing container 106A, the developer is scooped up by a centrifugal force generated at a rotation of the paddle wheel 106D and then expelled toward the first developing roller 106E. A part of the expelled developer is supplied directly to the first developing roller 106E and carried on a surface of the first developing roller 106F. Another part of the remaining developer to be expelled rebounds from the second developing roller 106F and then it is carried on the surface of the first developing roller 106E, by way of a magnetic force in the side of the first developing roller 106E. To supply the developer to the first developing roller 106E also from the side of the second developing roller 106F, it is necessary to increase relatively a rotation speed of the paddle wheel 106D in order to increase in advance the amount of developer rebounding from the second developing roller 106F so as to increase the centrifugal force.

The developer carried on the surface of the first developing roller 106E moves on the roller surface with a rotation of the developing sleeve, and after the layer thickness is restricted by a doctor blade 106G, the developer reaches a first developing area D1 in which the first developing roller 106E is opposite to the photosensitive drum 131, so that a latent image on the photosensitive drum 131 is made visible with toner. After that, when the developer which has passed the first developing area D1 moves to a position where the magnetic force in the side of the first developing roller 106E has a lower effect, it is transmitted toward a second developing area D2 between the second developing roller 106F and the photosensitive drum 131 as indicated by a dashed line in FIG. 6 with a rotation in the side of the second developing roller 106F and a magnetic force from the magnetic roller. Then, the developer drops to the bottom of the developing container 106A in a position where the second developing roller 106F has no effect on it and this developer is then stirred again by the paddle wheel 106D.

On the other hand, developer scraped off the first developing roller 106E due to restriction of the layer thickness with the above doctor blade 106G is guided by a separator 106H toward a delivery screw 106J located at the other end of an extension of the separator 106H and then dropped to the stirring roller 106C by the delivery screw 106J. Therefore, at the other end of the extension of the separator 106H, there is a slit for dropping the developer being formed in a position opposite to the stirring roller 106C.

The magnetic rollers arranged in the first and second developing rollers 106E and 106F have an arrangement of magnetic poles which can be used to form a repulsive magnetic field generated by identical poles between the nearest portions of the first developing roller 106E and the second developing roller 106F, so that the transfer direction of the developer is forcibly set to a direction in which the developer starts for the developing roller 106F. With this arrangement, the developer is transferred to the second developing roller 106F by way of the magnetic pole in the side of the second developing roller 106F.

Near the developing container 106A and the stirring roller 106C, there is arranged a toner density sensor 106K having a toner density detecting mechanism for detecting a mixing ratio of toner and carrier. This toner density sensor 106K is described by giving an example of a method in which a toner density is detected based on a content of the toner under developing by using changes of inductance on a coil arranged in the developer.

In the toner supplying section 106B of the developing apparatus 106, as shown in FIG. 7, a toner supplement opening 106L is formed in the side of an axial end of the stirring member 106M arranged in the toner supplying section 106B, and in this toner supplement opening 106L, a toner salvaging mechanism 200, described later, is to be removably arranged. Additionally, in FIG. 7, a reference numeral 106N indicates a sensor for detecting supplement toner residue in the toner supplying section 106B.

The toner salvaging mechanism 200, which has a unit structure which is configured separately from the developing apparatus 106, is used to salvage toner which has been delivered by being mixed with air through the toner supplying pipe 350 from the toner bank 300 which is a toner supplying source by separating the toner from the air so as to supply toner in preparation for decreased supplement toner in the toner supplying section 106B of the developing apparatus 106. A configuration of the toner salvaging mechanism 200 is shown in FIG. 8.

In FIG. 8, the toner salvaging mechanism 200 has a funnel-shaped toner separating section 200A whose longer direction is in a vertical direction. The toner separating section 200A includes a hopper which separates air from toner transmitted together from the toner bank 300 which is the above toner supplying source and drops the toner only by gravity so as to put the toner into the toner supplying section 106B of the developing apparatus 106. Therefore, in the upper part of the toner separating section 200A, an end of a toner supplying pipe 350, which is one of the toner delivering mechanisms, is connected, while an opening 2003 which can be connected to the toner supplying section 106B of the developing apparatus 106 is formed in the lower part. With this configuration, a mixture of air and toner that is transmitted from the toner supplying pipe 350 falls in spiraling fashion due to the shape of the toner separating section 200A and the discharging position of the toner supplying pipe 350 when striking an inner wall of the toner separating section 200A, and the air having a lower specific gravity rises while only the toner having a higher specific gravity drops, whereby the air is separated from the toner. On the top surface of the toner separating potion 200A, there is provided a filter 201 for discharging an air, and on the bottom surface, there are provided an opening/closing member 202 for opening or closing the opening 200B and its opening/closing mechanism 203.

The toner separating section 200A can be separated from the toner supplying pipe 350, and the developing apparatus 106 can be drawn toward this side of the image forming apparatus together with the toner salvaging mechanism 200.

As shown in FIG. 5, the toner bank 300 contains a plurality of toner bottles 220 which are cylindrical containers containing toner, each having an opening portion 223 at an end of the cylinder, being vertically arranged with respect to one another and set with the opening portions 223 in the inner side. In other words, at an end of the toner bottles 220, an opening portion 223 is formed so as to have a smaller diameter than a diameter of the cylindrical body. With a part of the inner surface of a shoulder portion of an end surface on which the opening portion 223 of the toner bottle 220 is formed being pushed out from the inner surface of the shoulder up to an edge of the opening portion 223, a projected portion 285 for raising toner is formed (FIGS. 10*a–d* and 10*a′* to 10*d′*). Next, how the toner is guided will be described by referring to FIGS. 10*a–d* and 10*a′* to 10*d′*.

FIGS. 10*a–d* and 10*a*$^1$–*d*$^1$ show how the toner is guided by the projected portion 185 of the toner bottle 220 and an opening projected portion 286; a relationship between sub-diagrams (a), (b), (c) and (d) and sub-diagrams (a'), (b'), (c') and (d') (see, FIGS. 10*a–d* and 10*a′* to 10*d′* respectively) corresponds to elevational views and right-side views of the toner bottle 220. The sub-diagrams (b), (c), and (d) show views rotated from the sub-diagram (a) by 90 degrees, respectively. An arrow K in each sub-diagram indicates a direction in which the toner bottle 220 rotates. In the sub-diagrams (a) and (a'), each part of the maximum diameter in the shoulder is located vertically downward and toner is guided to the lower part of the circumferential wall in the maximum-diameter part of a head portion of the toner bottle by a guiding groove 227. In the state shown in the sub-diagrams (b) and (b') after a rotation by 90 degrees from the above state in a direction indicated by the arrow K, a borderline area between the maximum-diameter part of the shoulder portion and the above projected portion 285 is located vertically downward and part of toner guided by the above guiding groove 227 is put on the projected portion. During a further rotation by 90 degrees from this state to the state shown in the sub-diagrams (c) and (c') in a direction indicated by the arrow K, the projected portion 285 raises the toner up to an edge of the opening portion 223 as if it were a spoon. Before or after the state shown in the sub-diagrams (d) and (d') after a further rotation by 90 degrees in a direction indicated by the arrow K, the above toner on the projected portion 285 is partially transferred to the opening projected portion 286 and then discharged from the opening portion 223 due to an incline of the opening projected portion 286.

In this point, the projected portion 285 itself is recessed like a scooping part of a spoon as apparently shown in the sub-diagram (c) in this shown example. By using a container having this shape near the opening portion 223, the container prevents powder dust from being scattered in the hopper at the bottom of the toner bank 300 due to a drop of a lump of toner powder which has been discharged and the toner is gradually discharged when toner in the toner bottle 220 is discharged from the opening portion 223. In addition, it is possible to nearly exhaust the toner contained in the toner bottle 220. Furthermore, extra toner is removed when the rotation of the toner bottle occurs and only a spoonful of toner is scooped up to the opening portion 223, and therefore toner is discharged stably from the opening portion 223.

Figure 11:
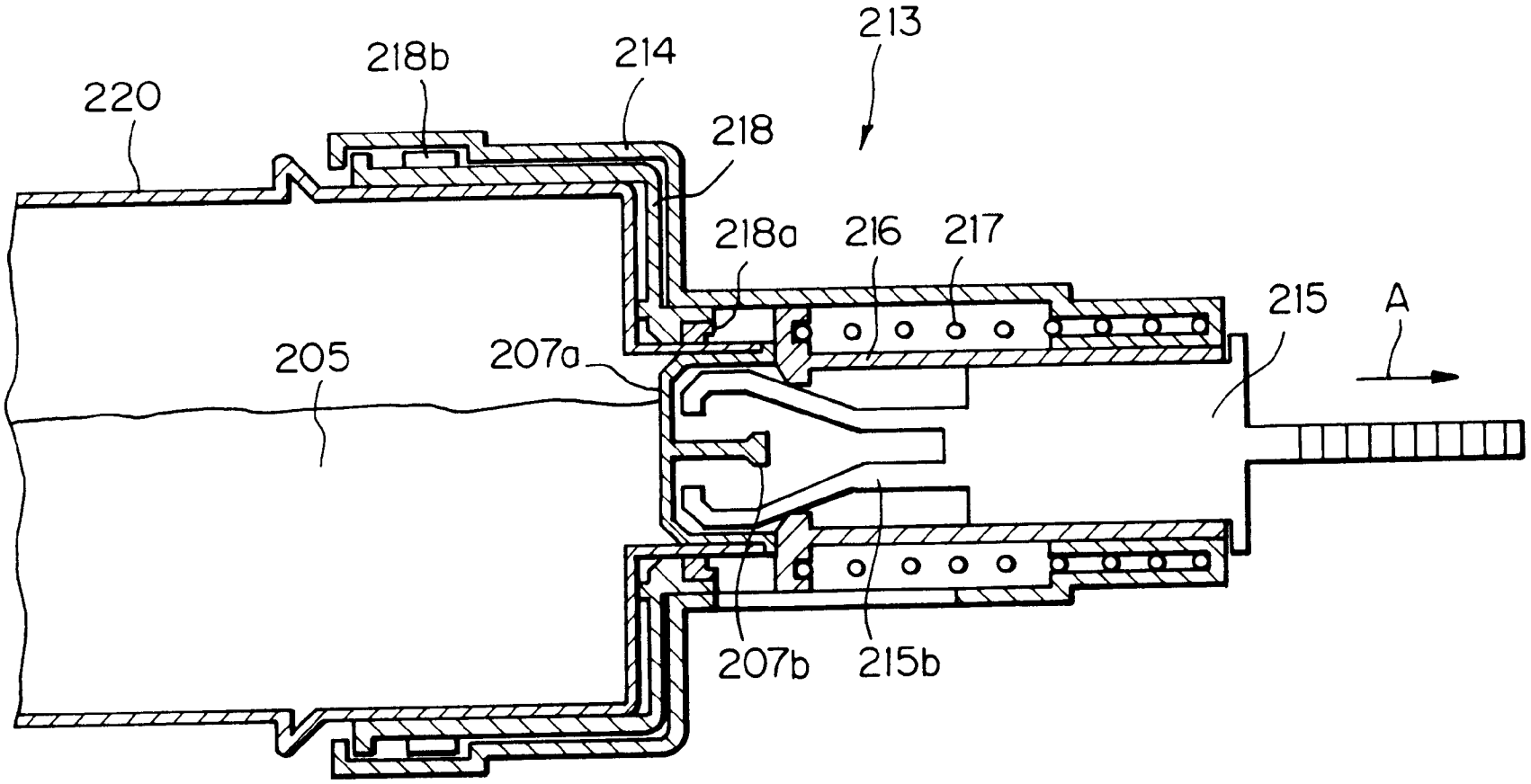
FIG. 11 is a diagram of a mechanism for removing or fitting a cap attached to an opening portion at an end of a toner bottle and a main portion sectional view illustrating a state of the opening portion closed by the cap.
Figure 12:
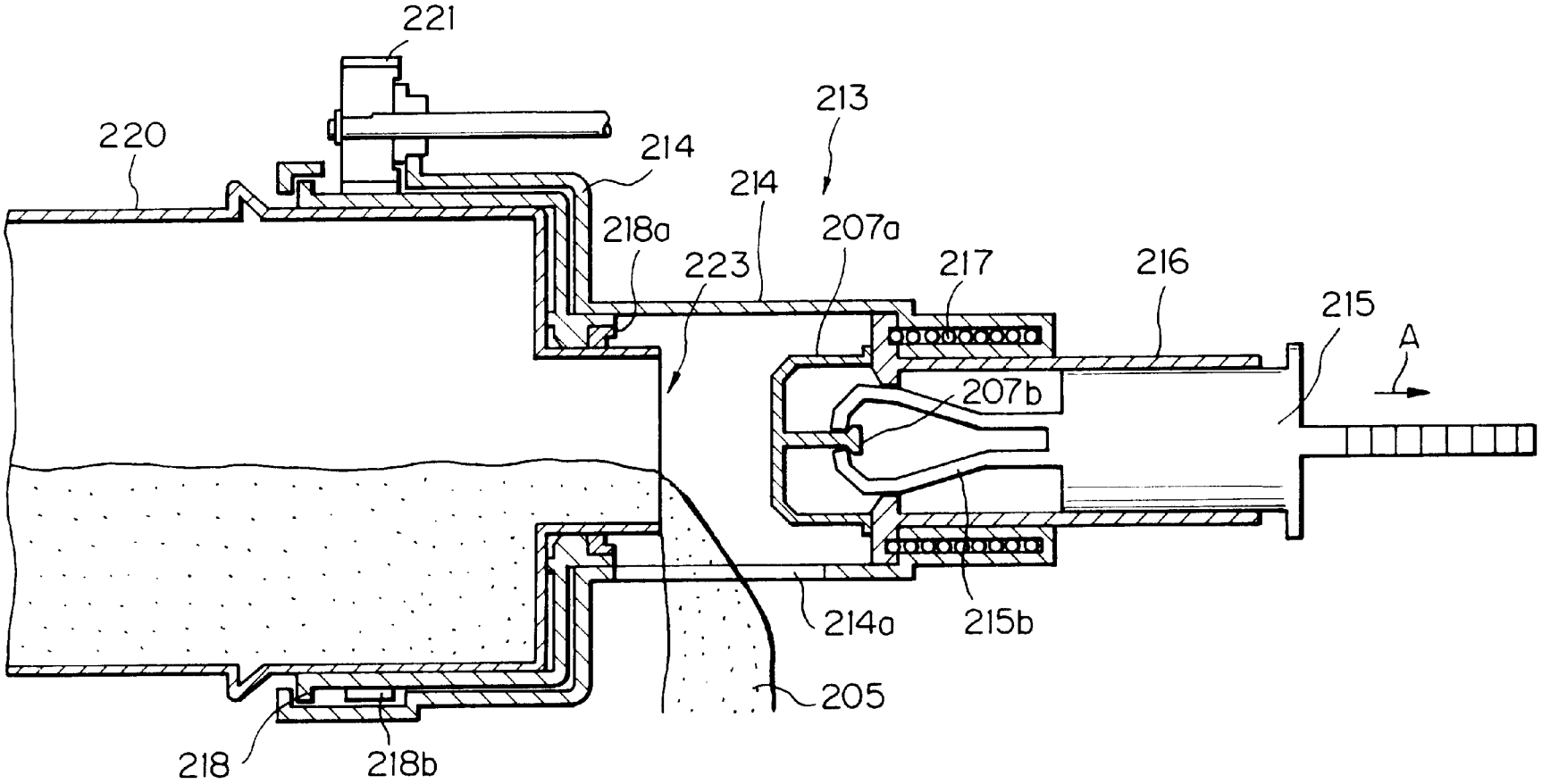
FIG. 12 is a diagram of a mechanism for removing or fitting a cap attached to an opening portion at an end of a toner bottle and a main portion sectional view illustrating a state of the opening portion from which the cap is removed.
Figure 13:
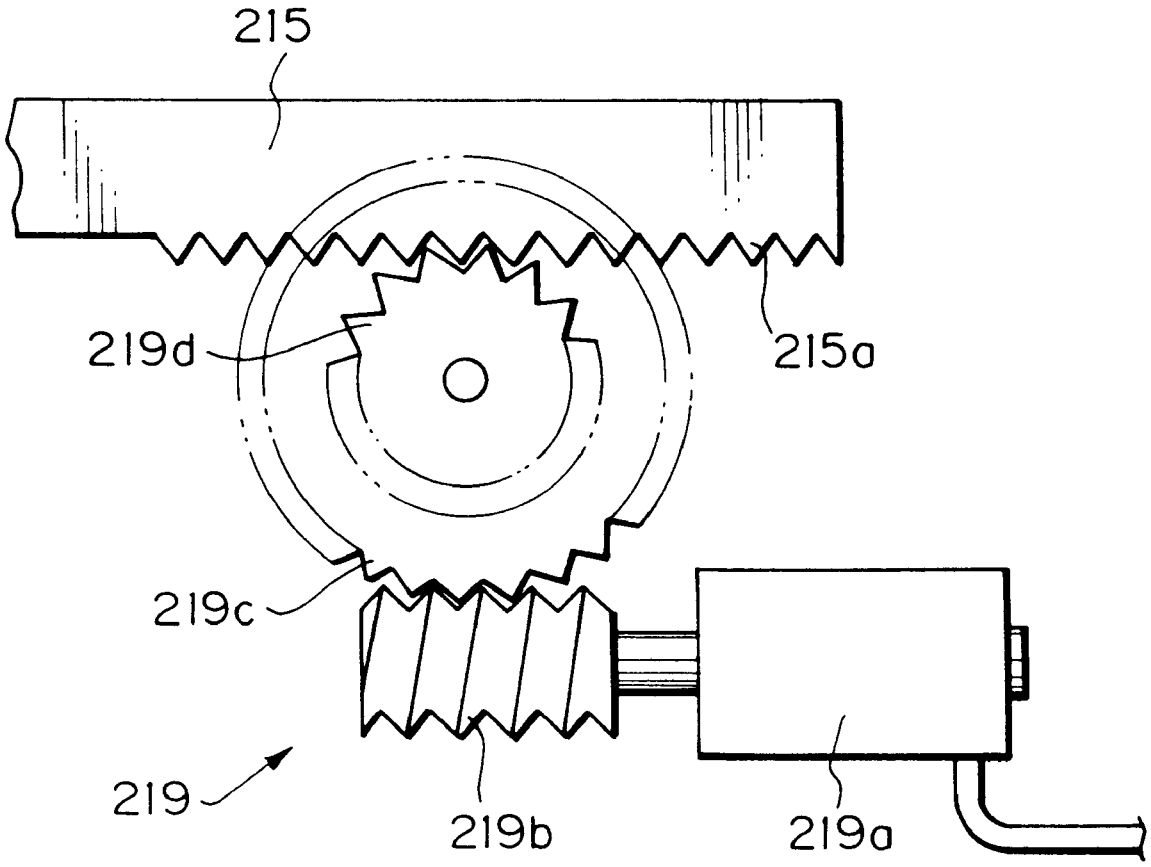
FIG. 13 is a diagram of an opening or closing mechanism for a cap put on the opening portion at an end of a toner bottle and a diagram illustrating a configuration of a cap moving apparatus.

Next, FIGS. 11, 12, and 13 are diagrams for descriptions of mechanisms for opening or closing caps 207*a* put on the opening portion 223 at an end of the above toner bottle 220. FIG. 11 shows the toner bottle 220 set in a holder 213 of the toner bank 300 and the opening portion 223 is closed with the cap 207*a*. FIG. 12 shows the cap 207*a* taken off so as to open the opening portion 223. In a holder 214 composing the holder portion 213, there is provided a rotatably-supported inner holder 218, which is rotated by a gear drive from outside (a driving gear 221 shown in FIG. 12) and reference numeral 218*b* in FIG. 12 indicates such a gear arranged. Each of the toner bottles 220 has recess and projecting portions (not shown) so that it can rotate synchronously with this inner holder 218. In the inner holder 218, as shown in FIG. 12, a seal 218*a* is arranged so as to prevent toner from being scattered from a gap between the toner bottle 220 and a supporting section of the inner holder 218. In the holder 214, a slider 216 and a chuck 215 are supported so as to slide freely, respectively.

The slider 216 is pressed by a spring 217 in a direction so as to urge the cap 207*a*toward the toner bottle 220. When the chuck 215 is shifted in a direction indicated by an arrow A from this state, as shown in FIG. 12, a lug 207*b* of the cap 207*a* is held by a click 215*b* of the chuck 215 and then the cap 207*a* is drawn out of the toner bottle 220, whereby the opening portion 223 is opened. When the driving gear 221 shown in FIG. 12 is rotated by a motor which is not shown in FIG. 12, the inner holder 218 rotates and the toner bottle 220 rotates synchronously with this rotation, whereby toner 205 in the toner bottle 220 is discharged from the opening portion 223 by the mechanism shown in FIG. 10. If the toner 205 in the toner bottle 220 is used up, the above toner residue detecting mechanism 106N gives warning that no toner residue is detected, and the opening portion 223 of the toner bottle 220 can be closed by the cap 207*a* by shifting the chuck 215 in a direction reverse to the direction indicated by the arrow A in FIG. 12 as shown in FIG. 11.

An apparatus for moving the cap is shown in FIG. 13. In FIG. 13, a moving apparatus 219, which includes a driving motor 219*a*, a worm gear 219*b*, a helical gear 219*c*, a pinion 219*d*, and a rack 215*a*, can move the chuck 215 in a horizontal direction in this drawing with a rotation of the driving motor 219*a* in a clockwise direction or a counter-clockwise direction, whereby the cap 207*a* can be put on or off the opening portion 223 of the toner bottle.

When the cap 207*a* is put on the opening portion 223 of the toner bottle 220, a stopper is needed to prevent the toner bottle 220 from coming off. An example of this stopper is shown in FIG. 14.

Figure 14:
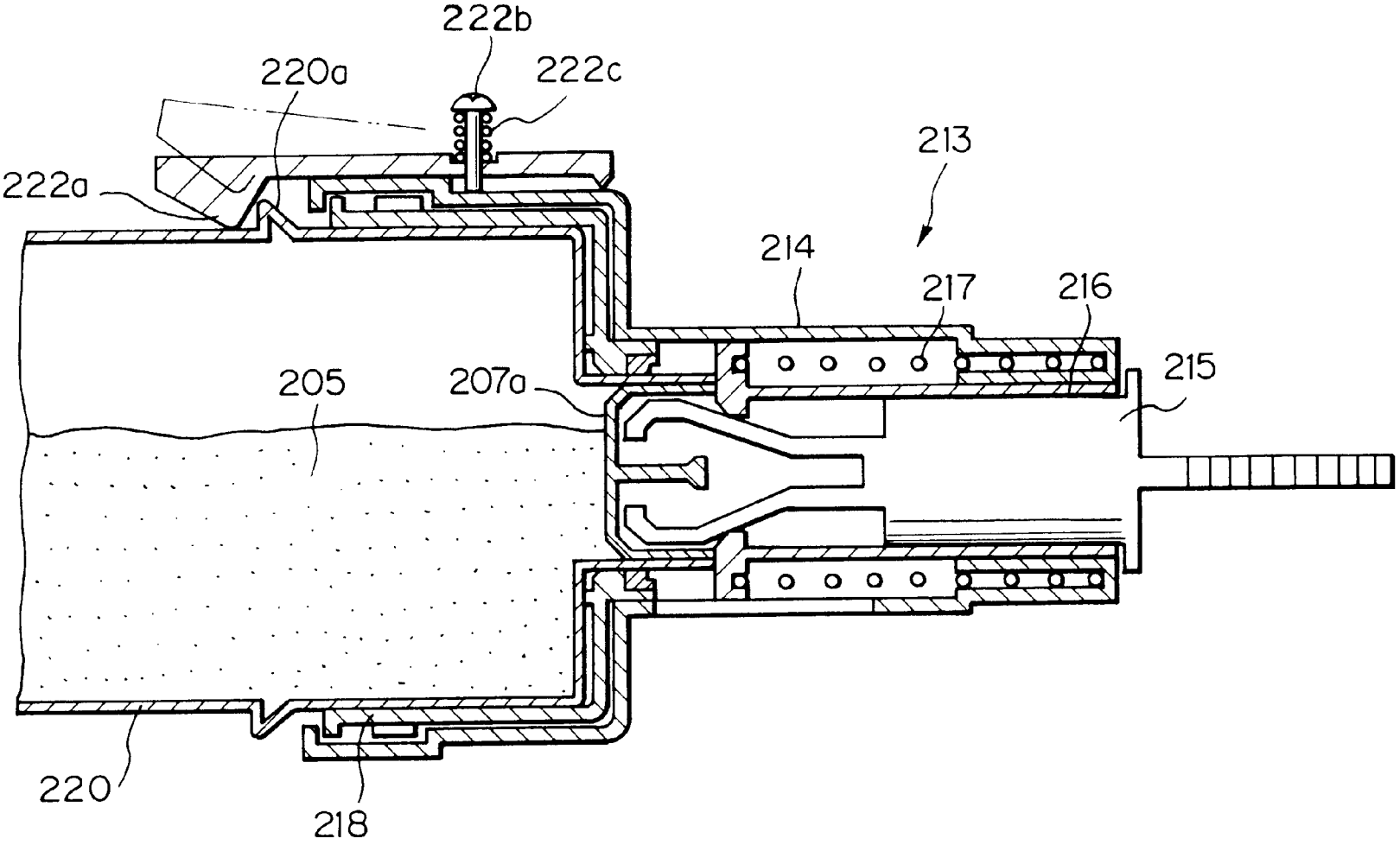
FIG. 14 is a diagram of a stopper for fixing the toner bottle when the cap is put on the opening portion at an end of the toner bottle.

In FIG. 14, the stopper 222*a* is supported by a stepped screw 222*b* and a spring 222*c*fixed to the holder 214, with its click portion being engaged with a projection 220*a* arranged on an outer peripheral surface of the toner bottle 220, and it is pressed by the spring 222*c* so as not to be raised up to the position indicated by a two-dotted and dashed line in FIG. 14 by a force of closing the cap 207*a*. Accordingly, the cap 207*a* can be put on the opening portion 223 of the toner bottle 220 securely since the toner bottle 220 is fixed by the stopper 222*a*. In addition, in exchanging the toner bottle 220, the toner bottle 220 can be easily removed from the stopper 222*a* so that it can be easily exchanged by pulling out the toner bottle 220 more strongly or by withdrawing the stopper 222*a* manually or with an added lever or the like to the position indicated by the two-dotted and dashed line in FIG. 14.

In each of the plurality of toner bottles 220 in FIG. 5, there is arranged an opening/closing mechanism for the cap 207*a* shown in FIGS. 11 to 14, so that each toner bottle 220 can be opened or closed independently. Therefore, toner is not supplied from the plurality of toner bottles 220 all at one time, but the toner in the toner bottles can be successively exhausted one by one. Additionally, as shown in FIG. 5, a powder pump unit 330, which is a toner delivery path and a toner delivering mechanism, is arranged at the bottom of the toner bank and supplement toner from each toner bottle 220 is accumulated at the bottom of the toner bank 300, and therefore there is provided a toner height detecting sensor 340 for detecting the height of the toner at the bottom of the toner bank 300, so that this toner height detecting sensor 340 controls opening or closing of the cap 207*a* on the toner bottle 220 to prevent toner from being supplied above a certain level. With this control, it becomes possible to prevent an unnecessary amount of toner from being supplied from the toner bottle 220 causing toner blocking due to an excessive pressure exerted on the toner, whereby toner can be delivered more reliably from the toner bank 300 to the developing apparatus 106. The toner height detecting sensor 340 is a ultrasonic sensor, which detects the height in a path where toner remains from the toner bottle 220 to the developing apparatus 106.

FIGS. 15 to 24 show features of another embodiment of the present invention.

A discussion of an image forming section, an opening/closing structure of toner bottles, and a guiding method of toner are the same as for the above-described embodiment, and thus has been omitted here. The same reference numerals designate corresponding parts in the above and these embodiments.

Figure 15:
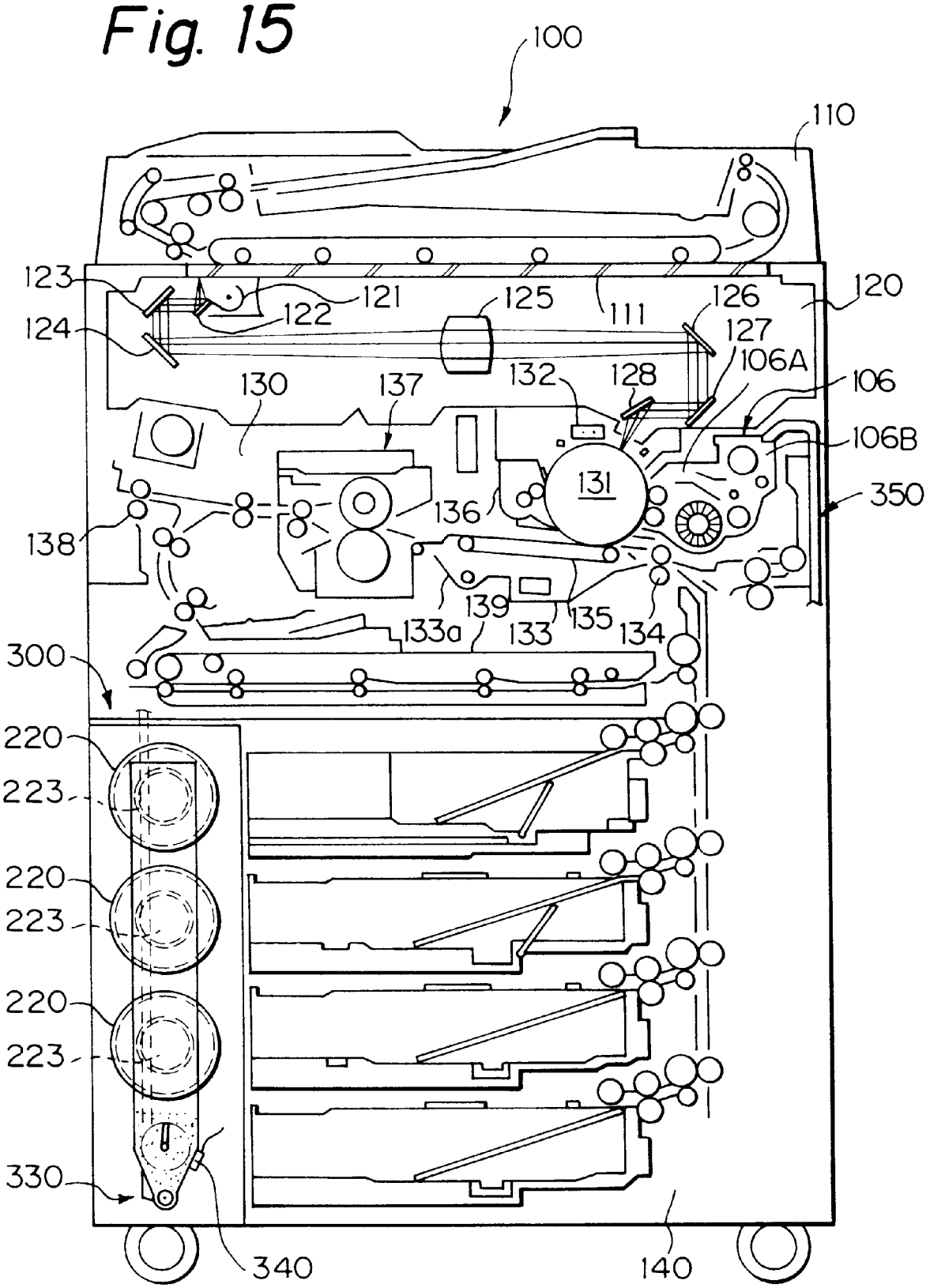
FIG. 15 is a schematic side view illustrating a modification of the embodiment in FIG. 5.

FIG. 15 shows an example in which a toner bank 300 is arranged in the left side on this figure of a copying machine main body 100, in other words, in a position further apart from a developing apparatus 106 relative to the above-described embodiment.

Figure 16:
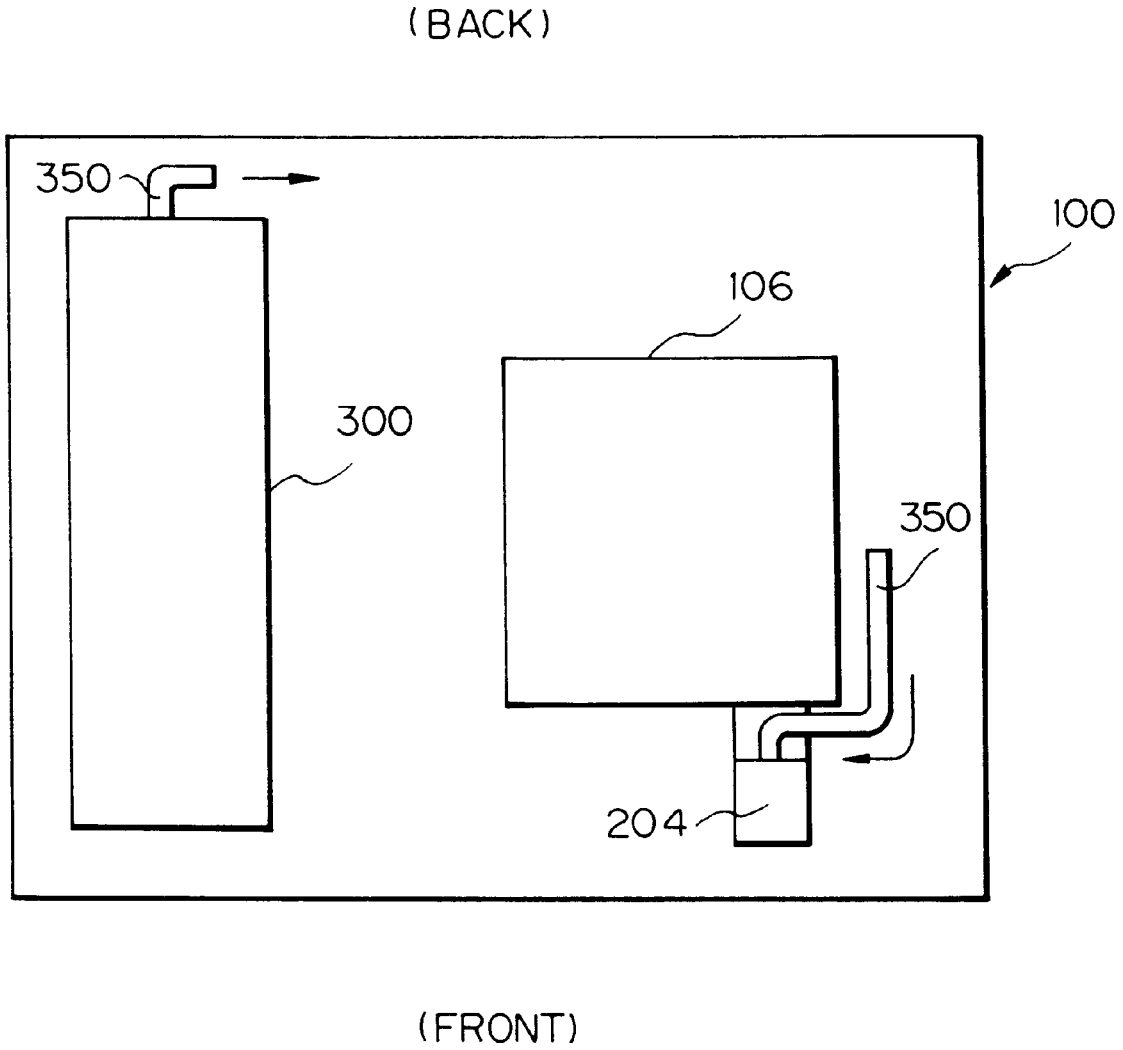
FIG. 16 is a schematic top view illustrating a modification of the embodiment in FIG. 5.

A positional relationship between the toner bank 300 and the developing apparatus 106 in this configuration is schematically outlined as a plan view in FIG. 16. In this case, a toner supplying pipe 350 extends toward the right side in the inner side bottom of the copying machine main body 100 and rises up from the portion to extend forward, and then it is connected with a toner salvaging mechanism 204 described later.

Figure 17:
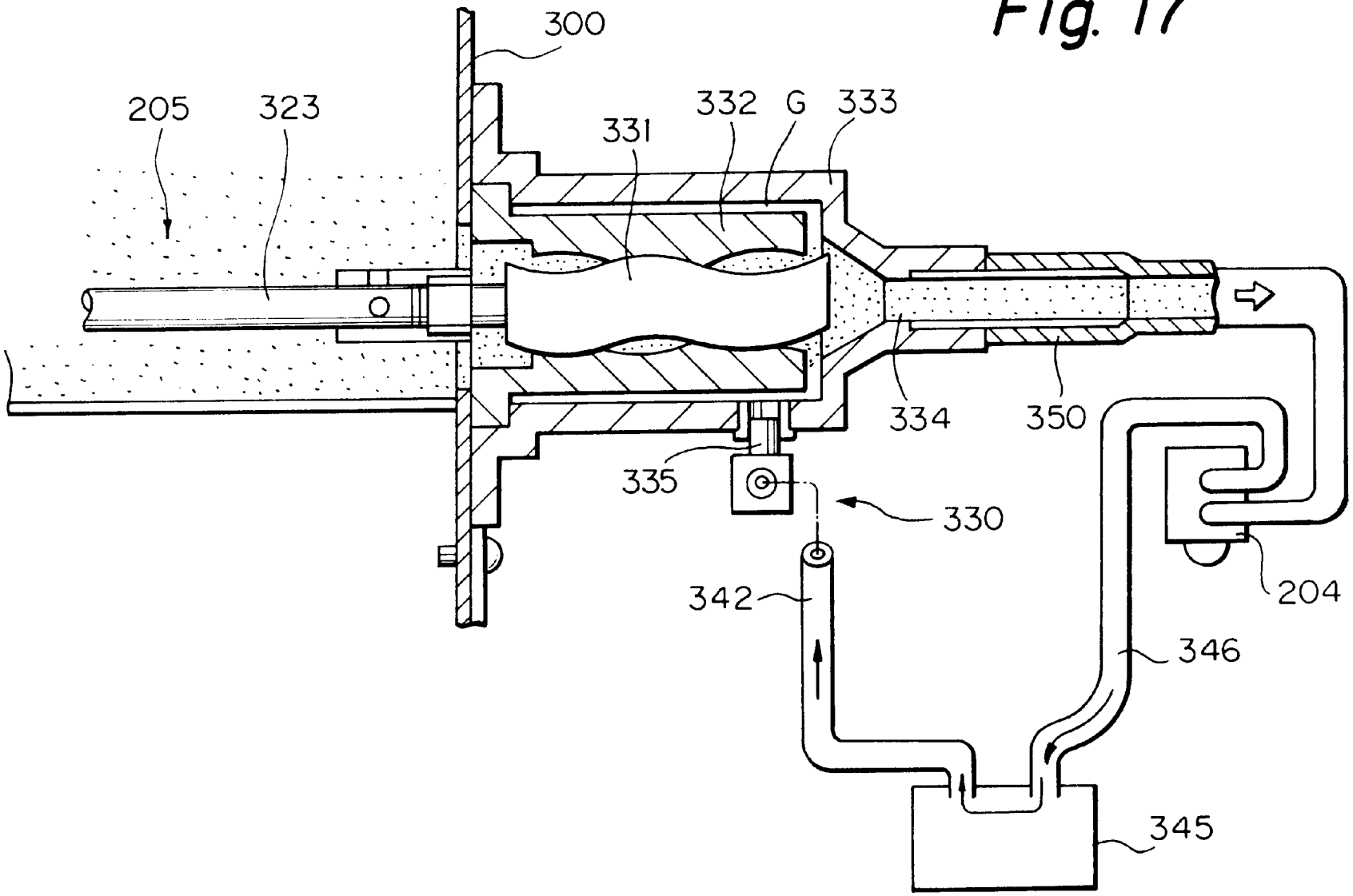
FIG. 17 is a main portion sectional view illustrating a configuration of a powder pump (mono-pump) forming the toner delivering mechanism of the embodiment in FIG. 5.

In this embodiment, a powder pump unit 330 has a configuration, as shown in FIG. 17, in which an air supplying tube 342 communicates with an air discharging outlet of an air pump 345 and in which the toner salvaging mechanism 204 is continuously connected with an air pump 345 by a flexible air pipe 346, so that air separated by the toner salvaging mechanism 204 is taken by the air pump 345.

Figure 18:
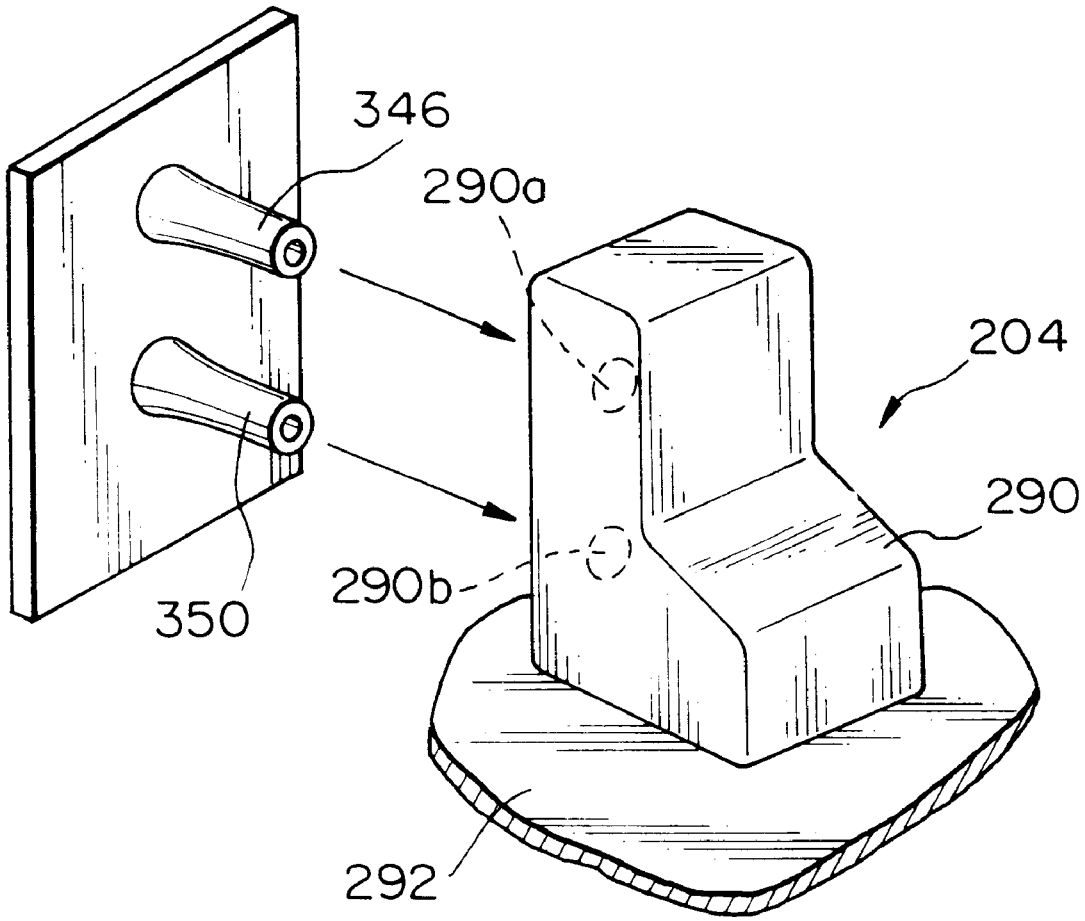
FIG. 18 is a main portion perspective view of the toner salvaging mechanism of the embodiment in FIG. 5.

As shown in FIG. 18, end portions of the air pipe 346 and the toner supplying pipe 350 are fixed to the side of the copying machine main body 100, and mating holes 290*a* and 290*b* are formed on a connecting portion 290 of the toner salvaging 204 corresponding to them. The connecting portion 290 is formed integrally with a lid 292 for closing an upper surface of a hopper of the toner salvaging mechanism 204. The connecting portion 290 is removable from the end portions of the air pipe 346 and the toner supplying pipe 350 through the mating holes 290*a* and 290*b*, whereby the developing apparatus 106 can be drawn toward this side of the copying machine 100 together with the toner salvaging mechanism 204. Other configurations of the toner salvaging mechanism 204 are the same as for the toner salvaging mechanism 200.

Figure 19:
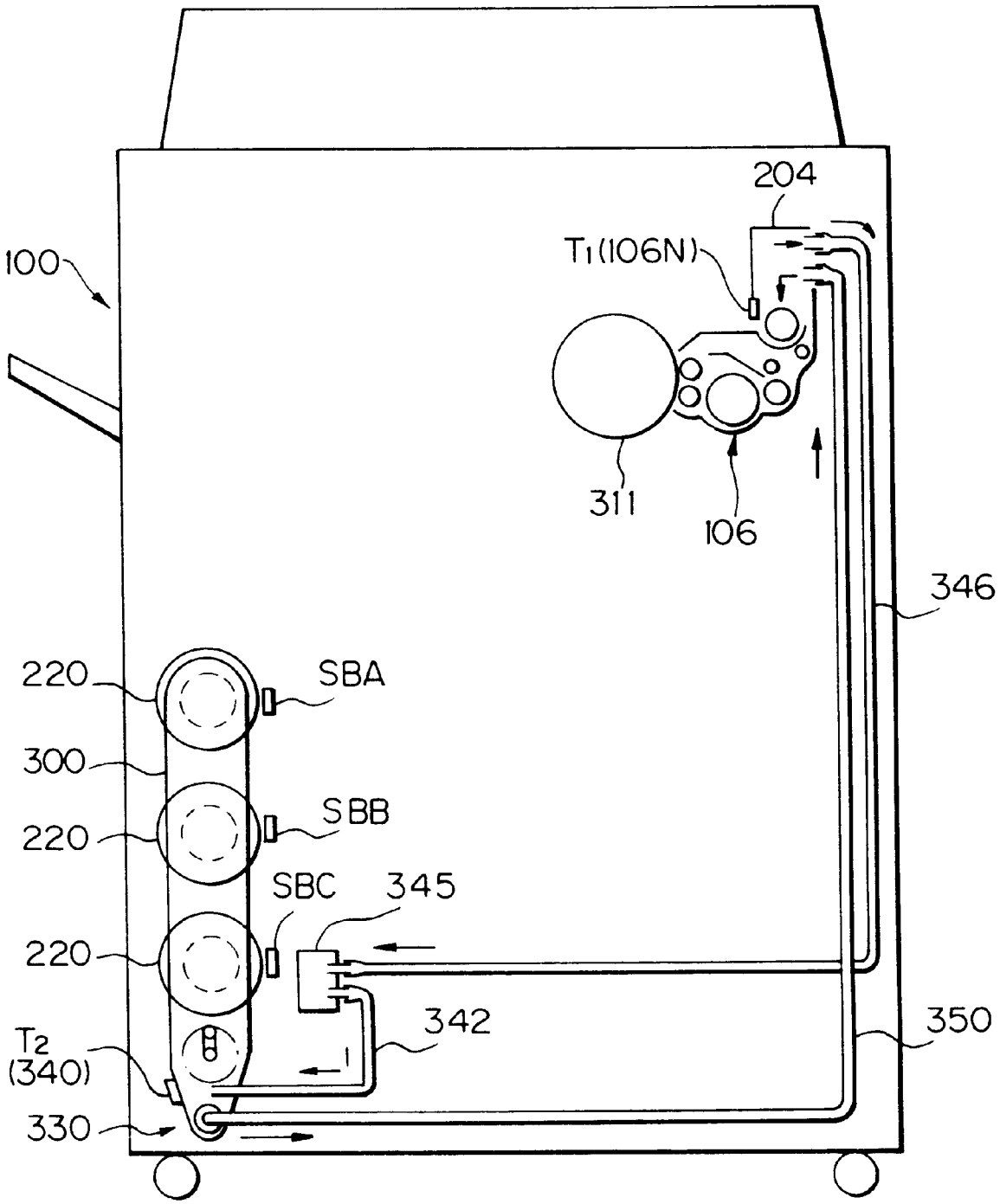
FIG. 19 is a schematic side view illustrating the toner delivery path of the embodiment in FIG. 5.
Figure 21:
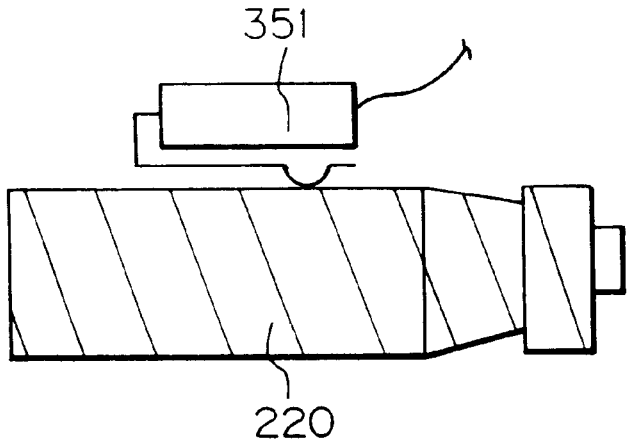
FIG. 21 is a schematic side view illustrating a microswitch as a toner bottle detecting sensor.
Figure 22:
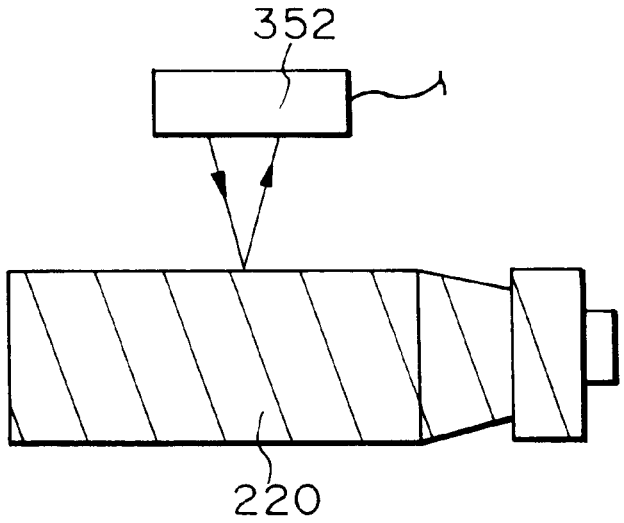
FIG. 22 is a schematic side view illustrating a reflex photosensor as a toner bottle detecting sensor.
Figure 23:
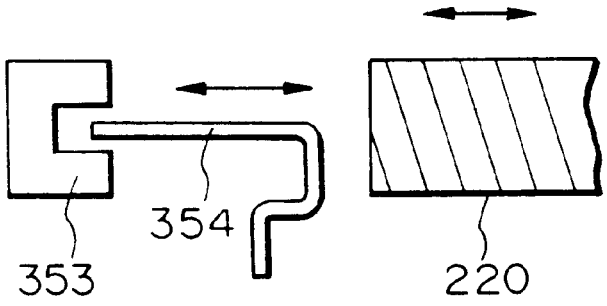
FIG. 23 is a schematic side view illustrating a transmission sensor as a toner bottle detecting sensor.

FIG. 19 shows only the above toner supply configuration. In respective toner bottles 220 of the toner bank 300, bottle detecting mechanisms SBA, SBB, and SBC are arranged for detecting whether or not a corresponding toner bottle is set in place. A microswitch 351 as shown in FIG. 21 and a reflex photosensor 352 as shown in FIG. 22 can be used for these bottle detecting mechanisms. In addition, as shown in FIG. 23, the detecting mechanism can be configured by a transmission sensor 353 and a feeler 354 which moves in conjunction with the toner bottle 220. If the transmission sensor 353 is used, there is no contact in a detecting potion, which is a disadvantage of the microswitch 351, and it is not a relevant consideration for an attenuation of a reflected light, which is a disadvantage of the reflex photosensor 352, and therefore the transmission sensor 253 (as compared with the microswitch) is the most advantageous.

For each toner bottle 220, a detection is made in relation to whether or not a toner bottle is set in place, whether a cap is opened or closed, and whether or not any toner remains in the bottle, and then the respective conditions are stored in a nonvolatile memory which is provided in a controlling mechanism which is not shown. In toner detecting sensors $T_1$ (the toner bank side) and $T_2$ (the developing apparatus side), "H" indicates a presence of toner and "L" indicates an absence of toner, and these conditions are also stored in the nonvolatile memory. If a condition is the one which can be determined based on a value output from the sensor itself such as, for example, whether a toner bottle is set or not, however, it need not be specifically stored in the nonvolatile memory.

Figures 20, 20A:
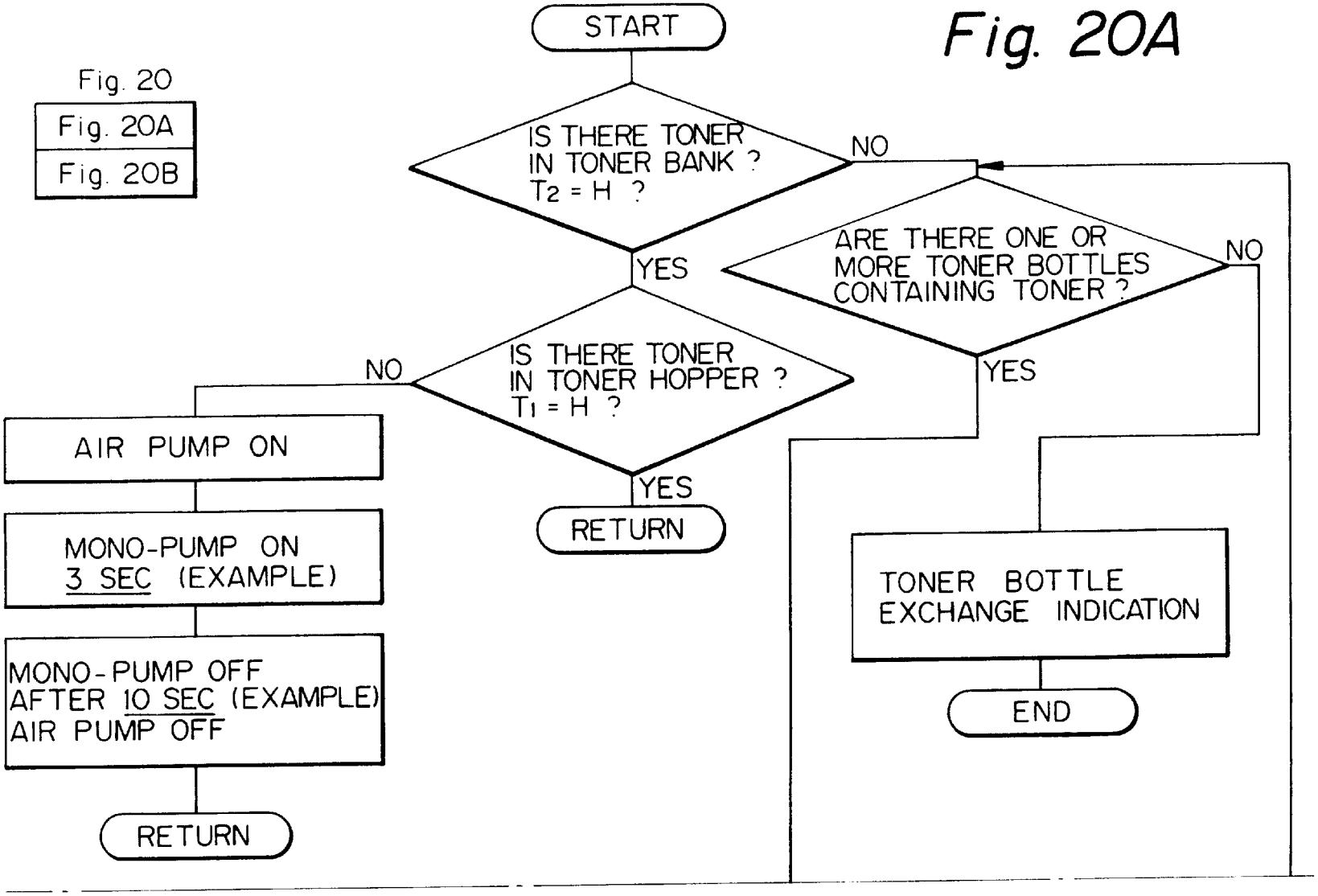
FIG. 20 is a control flowchart in relation to a toner supply from a toner bank to the developing apparatus of the embodiment in FIG. 5.
Figure 20B:
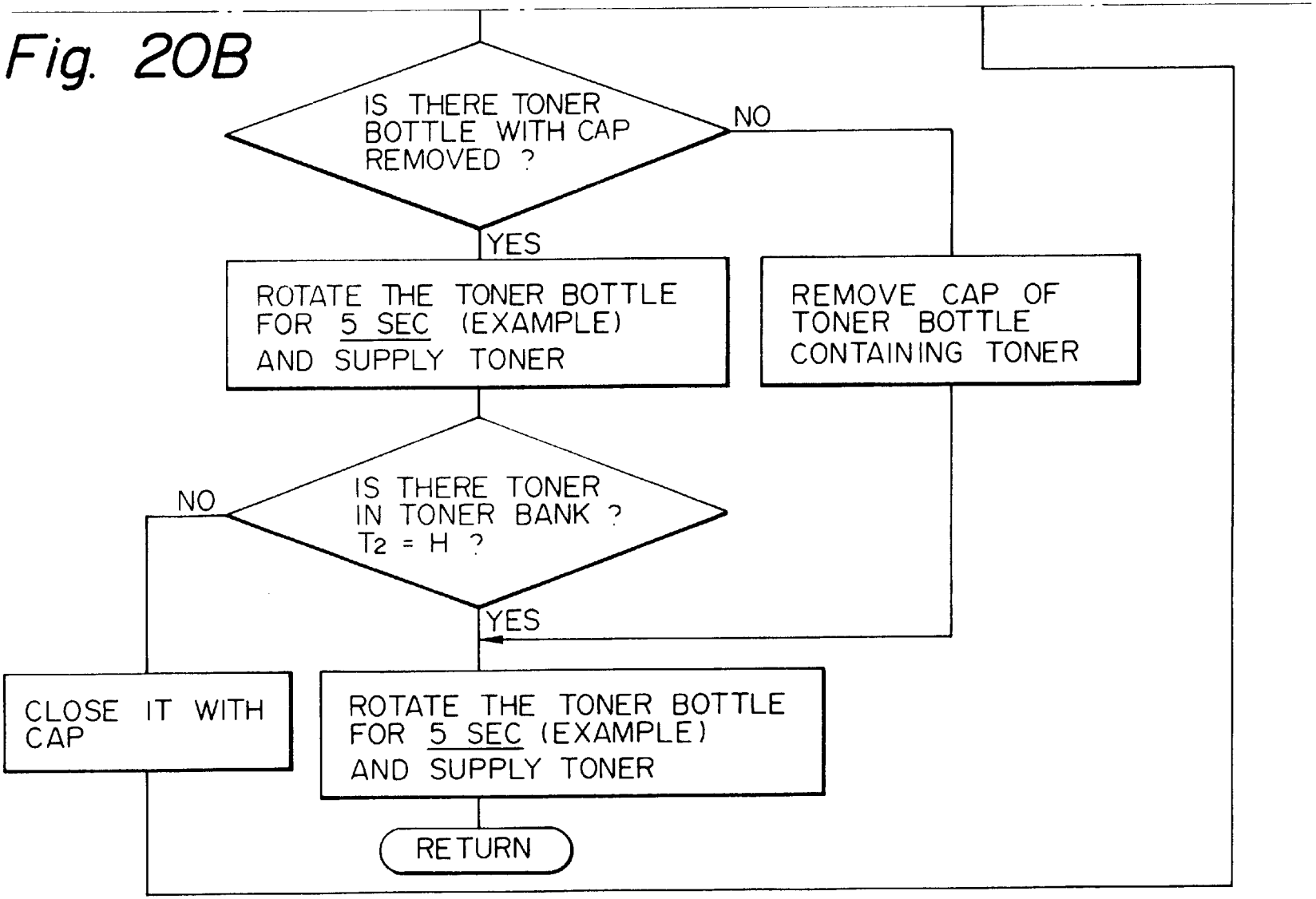

FIG. 20 shows a flowchart of an example of a control for supplying toner from the toner bank 300 to the developing apparatus 106 based on the above configuration. In this flowchart, a judgment of "Is there toner bottle with cap removed?" is made based on memory information which is stored in the memory containing the past information of the open-driving operations. In addition, a judgment of "Are there one or more toner bottles containing toner?" is made based on in-formation of the bottle-set sensors SBA to SBC. In particular, the process begins in step S1 where an inquiry is made regarding whether there is toner in the toner bank and whether $T_2$=h (i.e., at least at a height h). If the response to the inquiry in step S1 is affirmative, the process proceeds to step S3 where a second inquiry is made regarding whether there is toner in the toner hopper and whether $T_1$=h. If the response to the inquiry in step S3 is affirmative, the process returns to step S1, however, if the response to the inquiry in step S3 is negative, the process proceeds to steps S5, S7 and S9, where the air pump is turned on, the mono pump is turned on for three seconds, for example, and then the mono pump is turned off after ten seconds, for example, and the air pump is turned. Subsequently, the process returns to step S1.

If the response to the inquiry in step S1 is negative, the process proceeds to step S11 where an inquiry is made regarding whether there is one or more toner bottles containing toner. If the response to the inquiry in step S11 is affirmative, the process proceeds to step S13 where another inquiry is made regarding whether there is a toner bottle with a cap removed. If the response to the inquiry in step S13 is negative, the process proceeds to step S23 where the cap of the toner bottle containing toner is removed and the process proceeds to step S21. However, if the response to the inquiry in step S13 is affirmative, the process proceeds to step S15 where the toner bottle is rotated for five seconds (for example) so as to supply toner therefrom. Subsequently the process proceeds to step S17 where another inquiry is made regarding whether there is toner in the toner bank ($T_2$=h). If a response to the inquiry is step S17 is affirmative, the process proceeds to step S21 where the toner bottle is rotated for five seconds, for example, so as to supply toner and the process returns to step S1. However, if the response to the inquiry in step S17 is negative, the process proceeds to S19 where the toner bottle is closed with the cap and the process proceeds to step S11.

Figure 24:
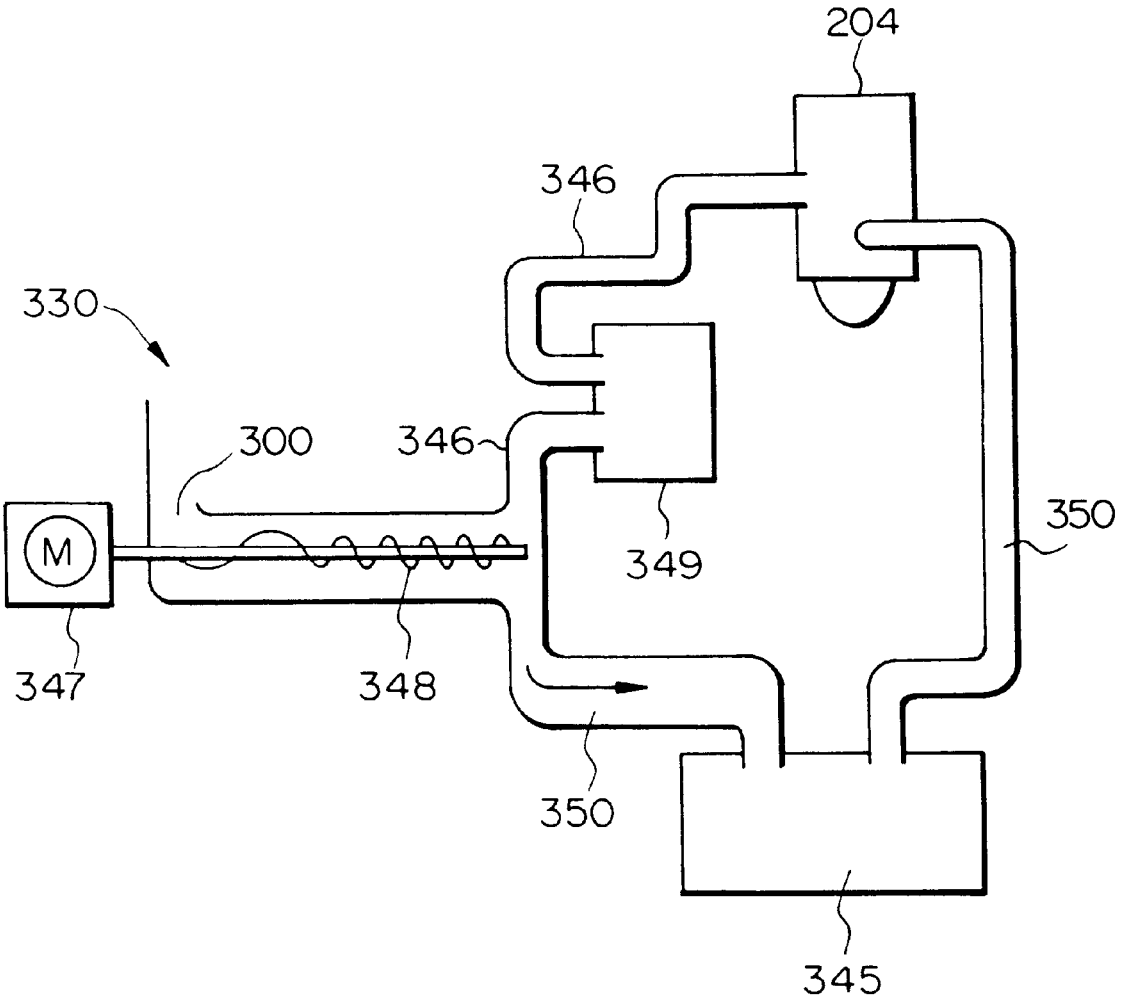
FIG. 24 is a schematic diagram illustrating a configuration in which an air pump is used instead of the Moineau-pump.

Although a Moineau-pump is used in the above powder pump unit 330, a long-time use of the Moineau-pump may cause a counterflow of air due to abrasion of members, and therefore a durability of a driving system cannot be sufficiently insured. FIG. 24 shows a configuration of a powder pump unit 330 which is able to cope with this problem. The powder pump unit 330 in this example does not use a Moineau-pump. In other words, toner in the toner bank 300 is delivered by a horizontal delivery screw 348 connected to a driving source 347, taken in a first air pump 345 through a toner supplying pipe 350 directly connected to a toner bank 300, and then transmitted to a toner salvaging mechanism 204 through the toner supplying pipe 350 from the first air pump.

The toner salvaging mechanism 204 is connected to a second air pump 349 by an air pipe 346 in order to discharge air separated from toner by the toner salvaging mechanism 204 with a suction action of the second air pump 349 to the side of the second air pump 349. Furthermore, the second air pump 349 is connected to the toner tank 300 by an air pipe 346, and toner in the toner bank 300 is taken into the first air pump 345 with a combined action of a discharging force of the second air pump 349 and a suction force of the first air pump 345. From a viewpoint of lowering cost, the powder pump unit can be configured without using the second air pump 349.

As described above, with the configuration for which only an air pump is used, it becomes possible to improve a durability of the component parts and to downsize a portion around the discharging outlet of the toner tank 300. The air pump is useful to improve a degree of freedom of the apparatus layout since it can deliver toner wherever required in a toner circulating system.(See FIGS. 28 to 30 for example.)

Figure 25:
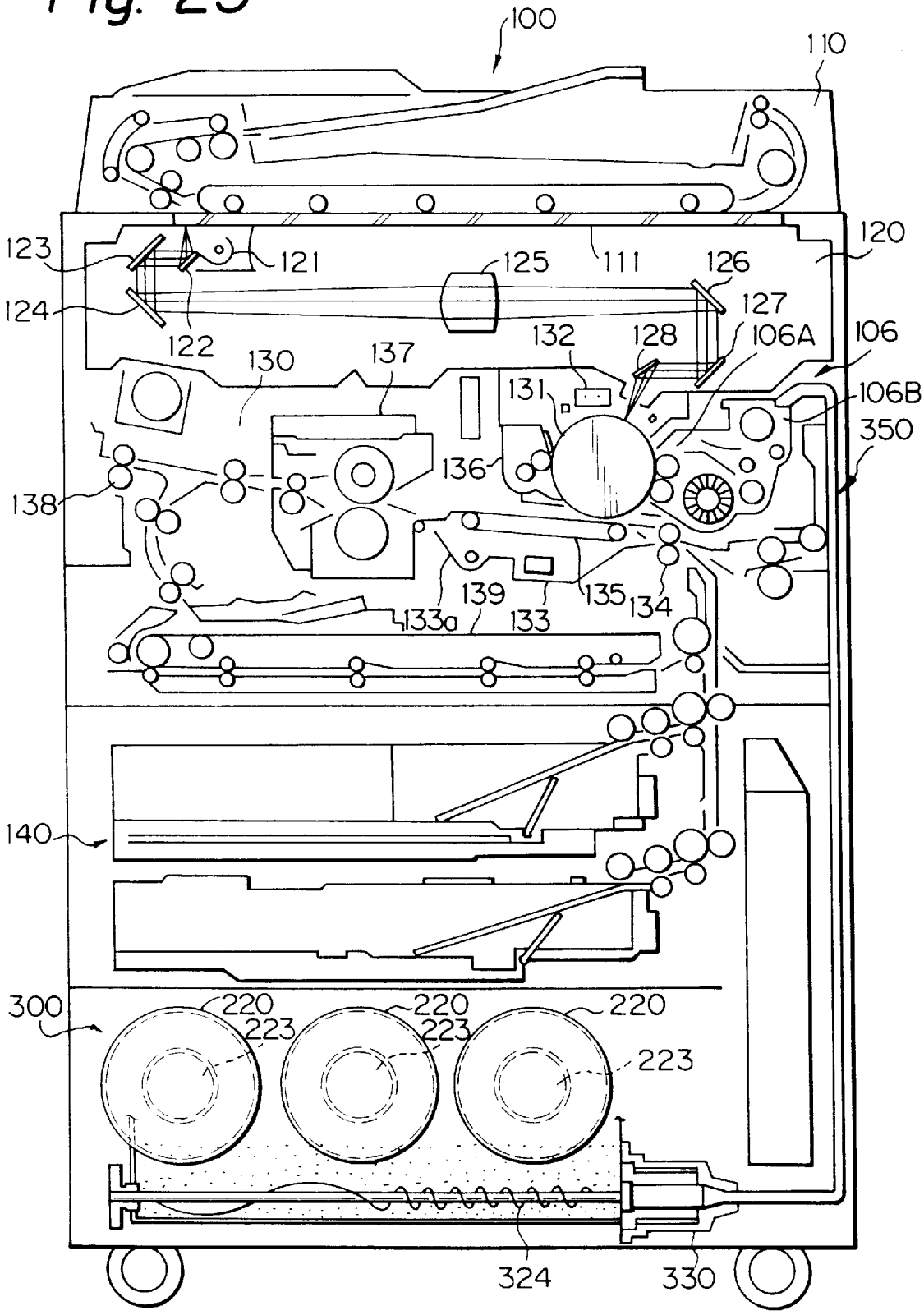
FIG. 25 is a schematic configuration diagram of an image forming apparatus of an embodiment in which a toner bank is horizontally arranged at the bottom.
Figure 26:
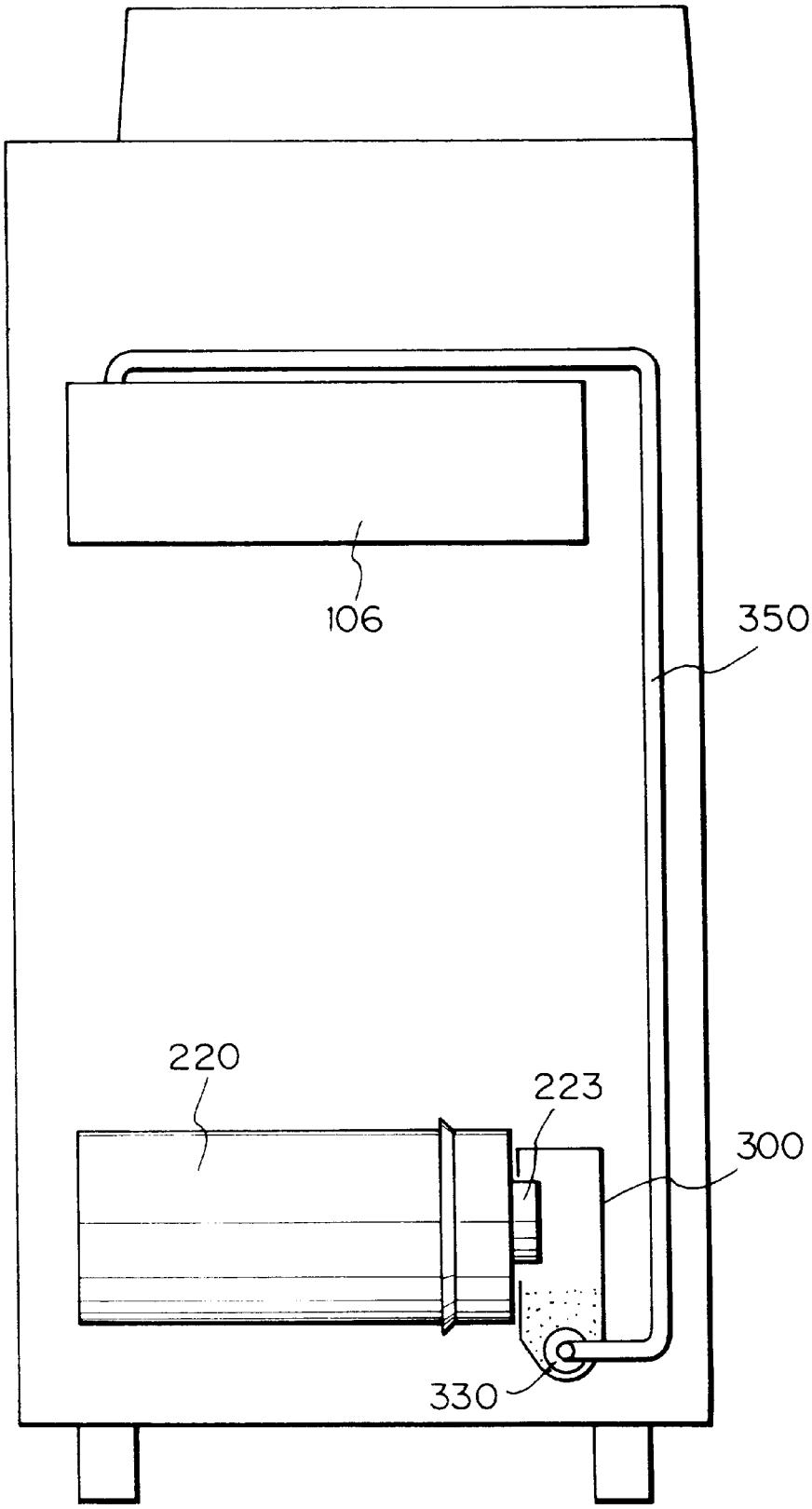
FIG. 26 is a schematic side view of the embodiment shown in FIG. 25.
Figure 27:
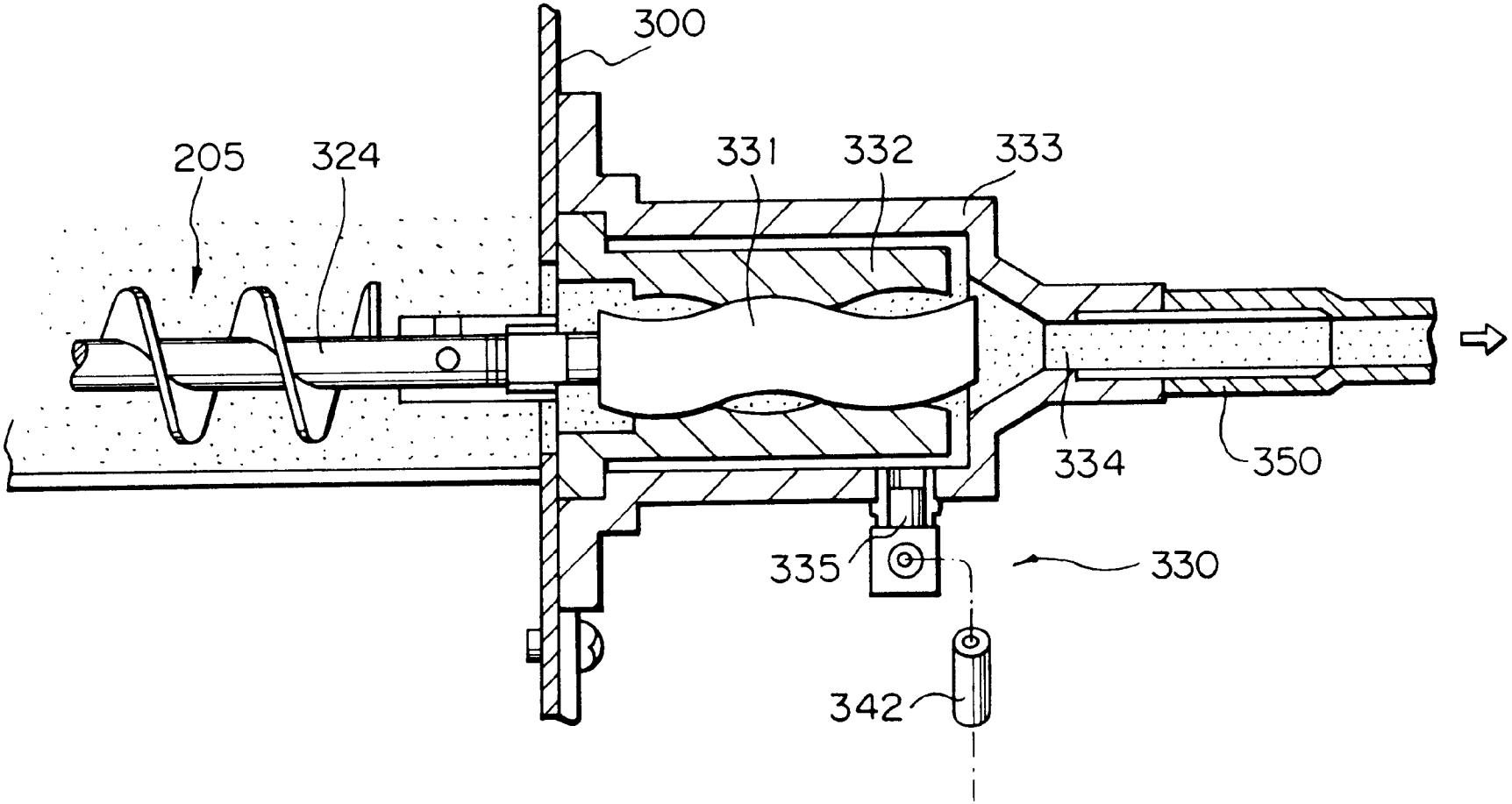
FIG. 27 is a main portion sectional view illustrating a configuration of a powder pump (Moineau-pump) forming the toner delivering mechanism of the embodiment shown in FIG. 25.

FIGS. 25 to 27 show features of another embodiment of the present invention.

FIG. 26 is a schematic side view of a copying machine shown in FIG. 25. An image forming section or other sections, an opening/closing structure of toner bottles, and a guiding method of toner are the same as for the above described embodiments, and therefore are not discussed below. The same reference numerals designate corresponding parts in the above and these embodiments.

A toner bank 300 in this embodiment is arranged at the bottom of a copying machine main body 100, with respective bottles 220 (toner containers) horizontally arranged in parallel (FIG. 25). A developing apparatus 106 is connected to the toner bank 300 by a toner supplying pipe 350 made of a flexible member, and toner stored in the toner bank 300 is supplied to the developing apparatus 106 through the toner supplying pipe 350.

FIG. 27 is a main portion sectional view indicating a configuration of a powder pump unit 330 for transferring toner from the toner bank 300 to the developing apparatus 106, and a flexible toner delivering mechanism includes this powder pump unit 330 and the above toner supplying pipe 350. This toner delivering mechanism is controlled on the basis of a detecting signal provided by a toner residue detecting mechanism 106N in the same manner as for the above described embodiments. In this description, a flexible toner delivering mechanism has a meaning of a mechanism which is effective to deliver toner without any restriction even if a delivery path is contrary to a gravity-drop of the toner.

In this embodiment, respective toner bottles 220 are horizontally arranged in parallel and therefore there is no opening portion 223 of any other toner bottle 220 from an opening portion 223 of each toner bottle 220 to a supplement and drop position of the toner bank 300, whereby it is possible to prevent an operator's hands from being smeared with toner when exchanging the toner bottles 220 or to prevent toner from being scattered thereabout. Corresponding to this parallel-arrangement configuration of the toner bottles 220, there is provided a horizontal delivery screw 324 for delivering toner by a stirring action and dropping toner from the toner bottle 200 toward the powder pump unit 330 at the bottom of the toner bank 300, and a rotor 331 of the powder pump unit 330 is coaxially engaged with the horizontal delivery screw 324. In addition, the other end of the horizontal delivery screw 324 is engaged with driving source which is not shown.

Figure 28:
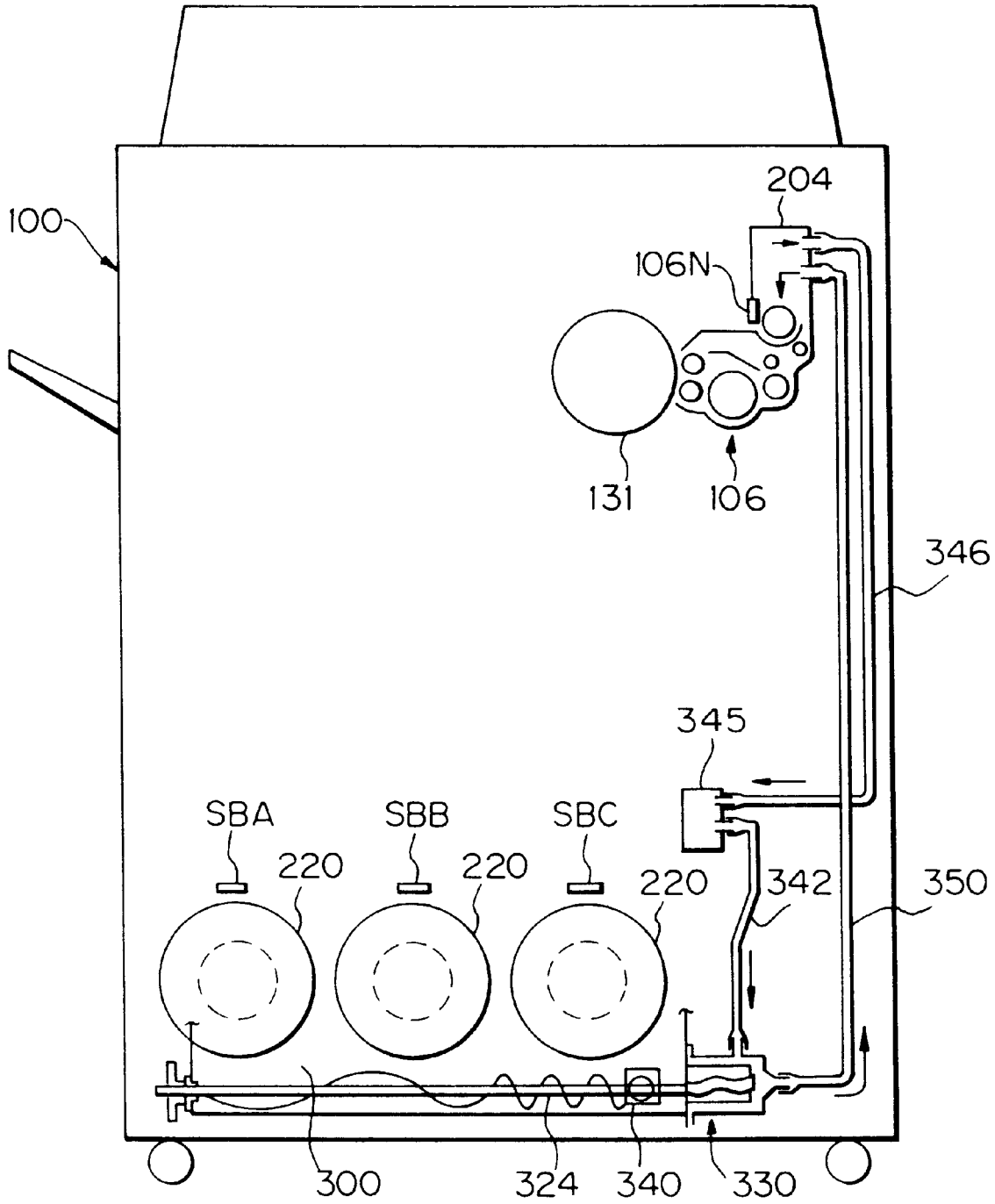
FIG. 28 is a schematic side view illustrating a toner delivery path.
Figure 29:
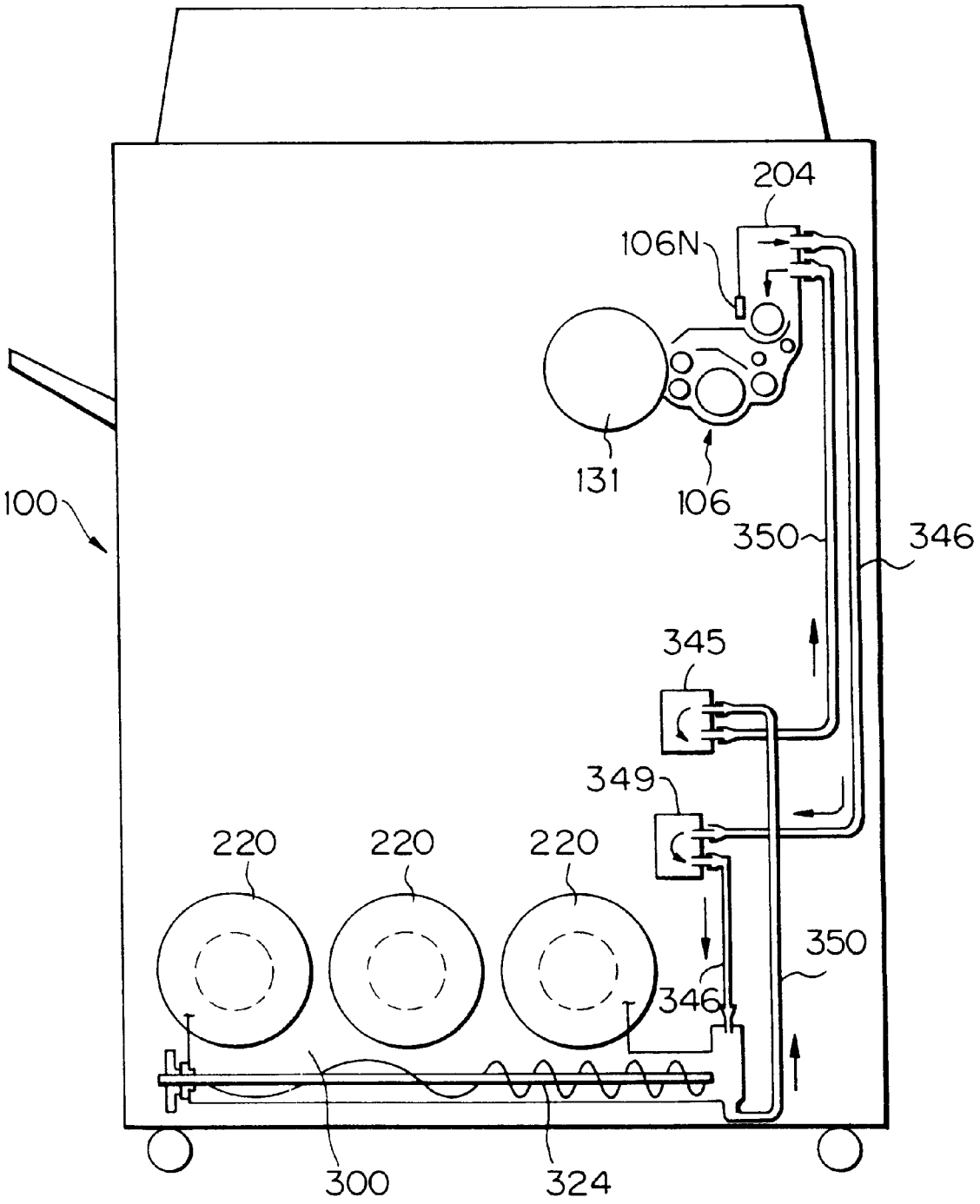
FIG. 29 is a schematic side view illustrating a toner delivery path.
Figure 30:
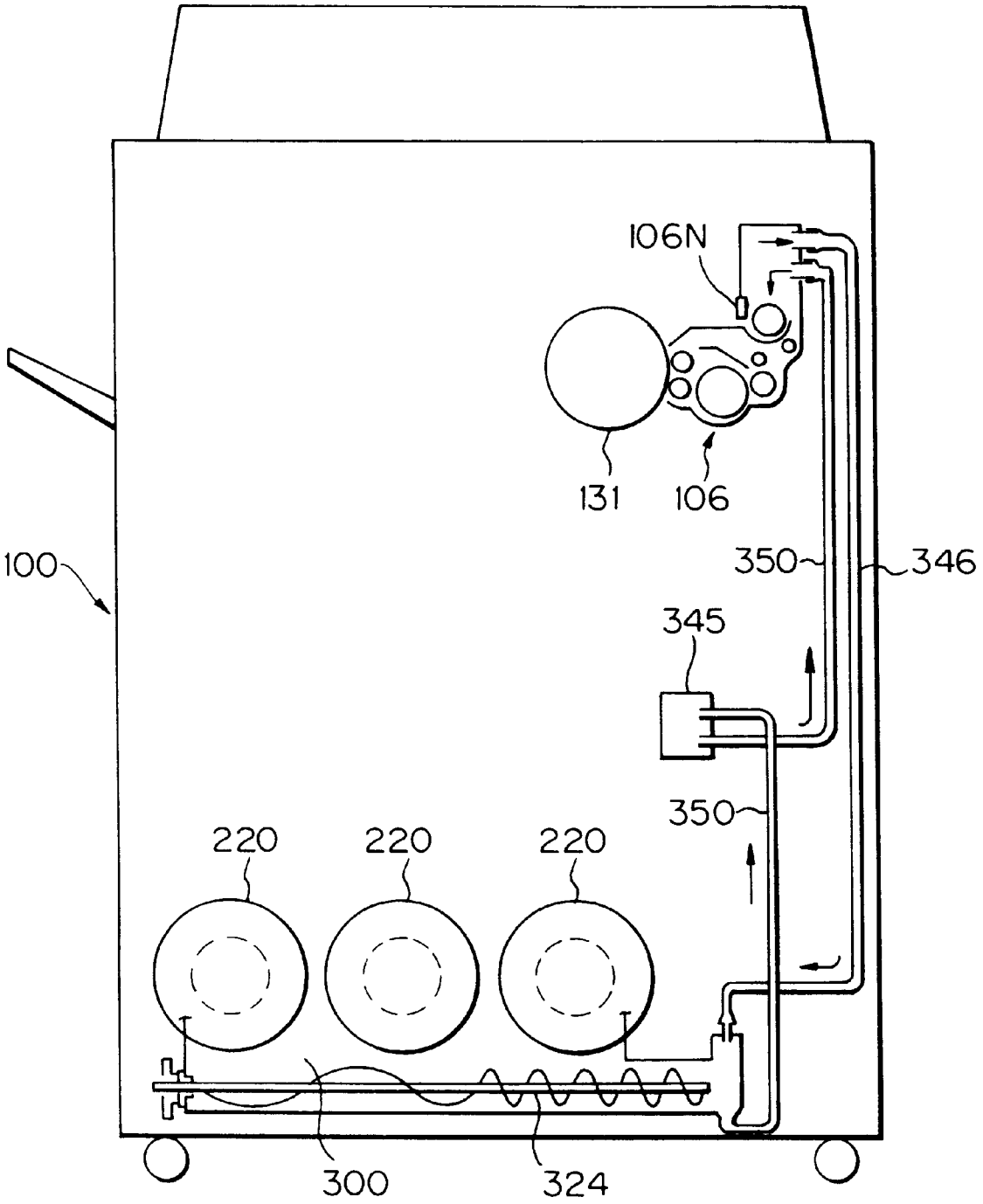
FIG. 30 is a schematic side view illustrating a toner delivery path.

FIGS. 28 to 30 are views showing an improvement of a degree of freedom of the layout in designing an apparatus by using the above flexible toner delivering mechanism (including a case of using an air pump instead of a Moineau-pump). FIG. 28 shows an example in which a Moineau-pump is used, FIG. 29 shows an example of using two air pumps instead of the Moineau-pump, and FIG. 30 shows an example of using a single air pump alternatively instead of the Moineau-pump.

FIGS. 31 to 34 show features of another embodiment of the present invention.

An image forming section or other sections, an opening/closing structure of toner bottles, and a guiding method of toner for this embodiment are the same as for the above described embodiments, and therefore are not discussed below. The same reference numerals designate corresponding parts in the above and this embodiments.

In this embodiment, respective toner bottles 220 are set in a vertical toner bank 300 and are discriminated from each other as toner bottles 220A, 220B, and 220C, respectively, sequentially from the uppermost bottle.

Each of a plurality of toner bottles 220A to 220C has an opening/closing mechanism of a cap 207*a* in the same manner as for the above described embodiments, and therefore respective toner bottles 220A to 220C can be opened or closed independently.

In addition, respective toner bottles 220A to 220C are arranged in sites spaced apart from a developing section, and therefore they are not affected by driving of the image forming apparatus during the driving operation, so as to be removable-independently of each other.

As described above, toner dropped downward from a plurality of toner bottles 220A to 220C is collected at the bottom of the toner bank 300 and then transmitted to the developing section by a pump in this configuration, and therefore in relation to respective toner bottles 220A to 220C, it is possible to supply toner from all of the plurality of toner bottles 220A to 220C at one time, or in sequence. In sequential operation, a toner bottle is changed once toner therein is exhausted and other toner bottles are selected to supply toner in a predetermined order of the toner bottles or by changing toner bottles in a more arbitrary fashion from other toner bottles which are not detected to be empty. In this invention, the latter toner bottle changing method is applied.

When using this toner bottle changing type of a toner supplying method, toner is not supplied from all of the plurality of toner bottles 220A to 220C at one time, but an empty toner bottle is exchanged for another one of the toner bottles, and therefore toner can be continuously supplied from another toner bottle without stopping the image forming apparatus also during the exchange, whereby a situation of a toner shortage which causes an operator to perform a mandatory maintenance action at a particular time does not basically occur. Moreover, toner can be supplied also during an image forming operation and therefore there is not a situation of an interruption of the image forming operation for exchanging toner bottles.

Figure 31:
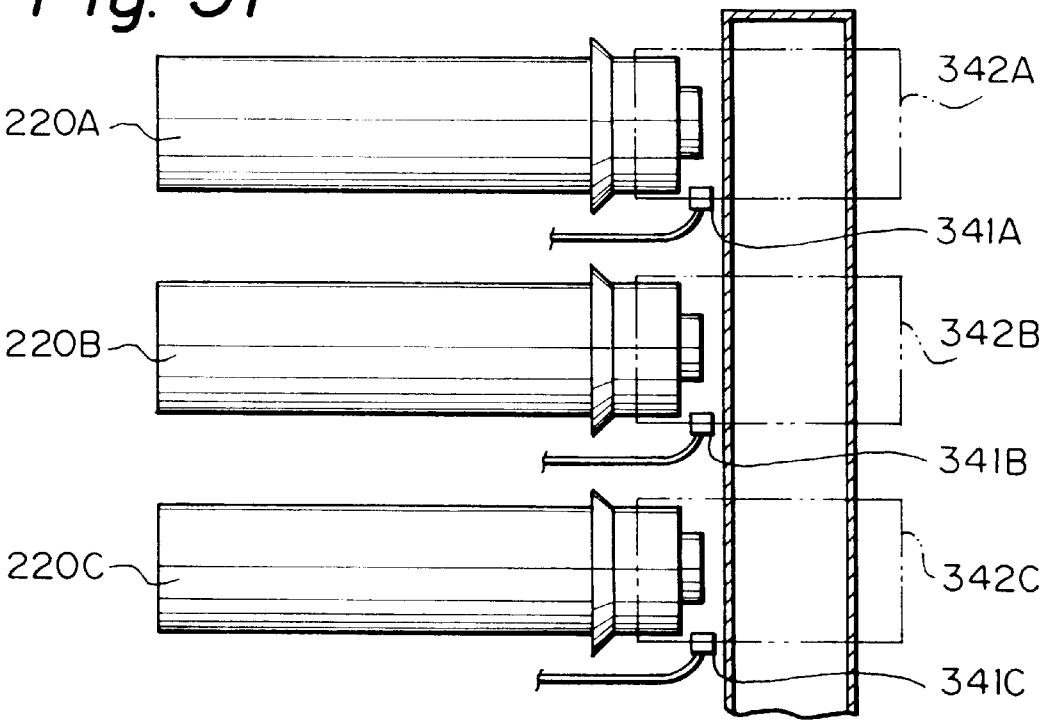
FIG. 31 is a diagram describing a condition of how toner-end detecting mechanisms are arranged correspondingly for a plurality of toner bottles.
Figure 32:
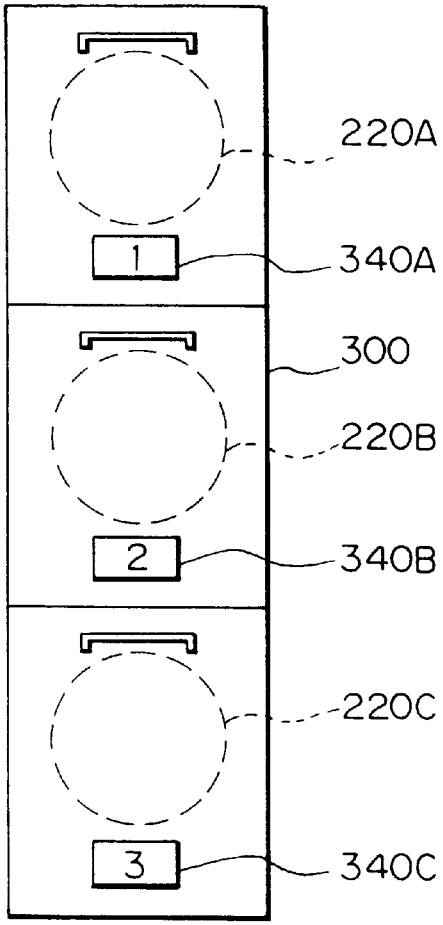
FIG. 32 is a diagram for describing a condition that the toner-end indicating mechanisms are arranged in toner bottle containing sections corresponding to respective toner bottles.

An empty toner bottle should be replaced without a substantial delay. The issue of which toner bottle is currently empty is known based on information from a toner-end detecting mechanism arranged for each toner bottle. As shown in FIG. 31, in the toner bank 300, the toner bottle 220A is contained in a toner bottle containing section 342A. In this toner bottle containing section 342, there is provided a toner-end sensor 341A as a toner-end detecting mechanism for detecting a toner end (a detecting mechanism for detecting toner residue) for the toner bottle 220A. As this toner-end sensor 341A, for example, an optical sensor is used. Whether or not toner remains in the toner bottle is represented by a change of reflectance of light, and therefore an exhaustion of toner in the toner bottle is determined based on a decrease of a quantity of light in a receiving light portion of the optical sensor. Naturally, it is also possible to detect a toner end by other types of sensors.

In the same manner, the toner bottle 220B is contained in a toner bottle containing section 342B, in which there is provided a toner-end sensor 341B as a toner-end detecting mechanism. Likewise, the toner bottle 220C is contained in a toner bottle containing section 342C, in which there is provided a toner-end sensor 341C as a toner-end detecting mechanism.

Since the toner-end sensor is arranged in each toner bottle in this manner, toner is supplied from a toner bottle selected out of the plurality of toner bottles in a predetermined order, and when it becomes empty, an operator can be immediately informed of which toner bottle is empty. For example, assuming that toner is supplied from the toner bottle 220A first, when toner is used up in the toner bottle, it is detected that the toner bottle 220A becomes empty by a warning based on an output of the toner-end sensor 341A arranged correspondingly to the toner bottle 220A and then the toner bottle is exchanged for another one. This exchanging operation can be performed also when the image forming apparatus is forming images. During the exchange operation, toner is supplied from a toner bottle among other toner bottles in a predetermined order or from a toner bottle filled with toner selected from the bottles in a random or arbitrary order.

Based on a toner-end detecting signal from each toner-end sensor 341A to 341D in FIG. 31, an operator is informed of a toner bottle to be exchanged by toner-end indicating mechanisms 340A, 340B, and 340C such as LED or the like being turned on individually and specifically for the respective toner bottles 220A to 200C arranged on the toner bank 300.

In other words, when a toner bottle is detected as being empty the operator is immediately informed of which toner bottle is empty by illuminating a toner-end indicating mechanism. With this information, the operator can exchange the empty toner bottle without any ambiguity as to which bottle is to be replaced.

Figure 33:
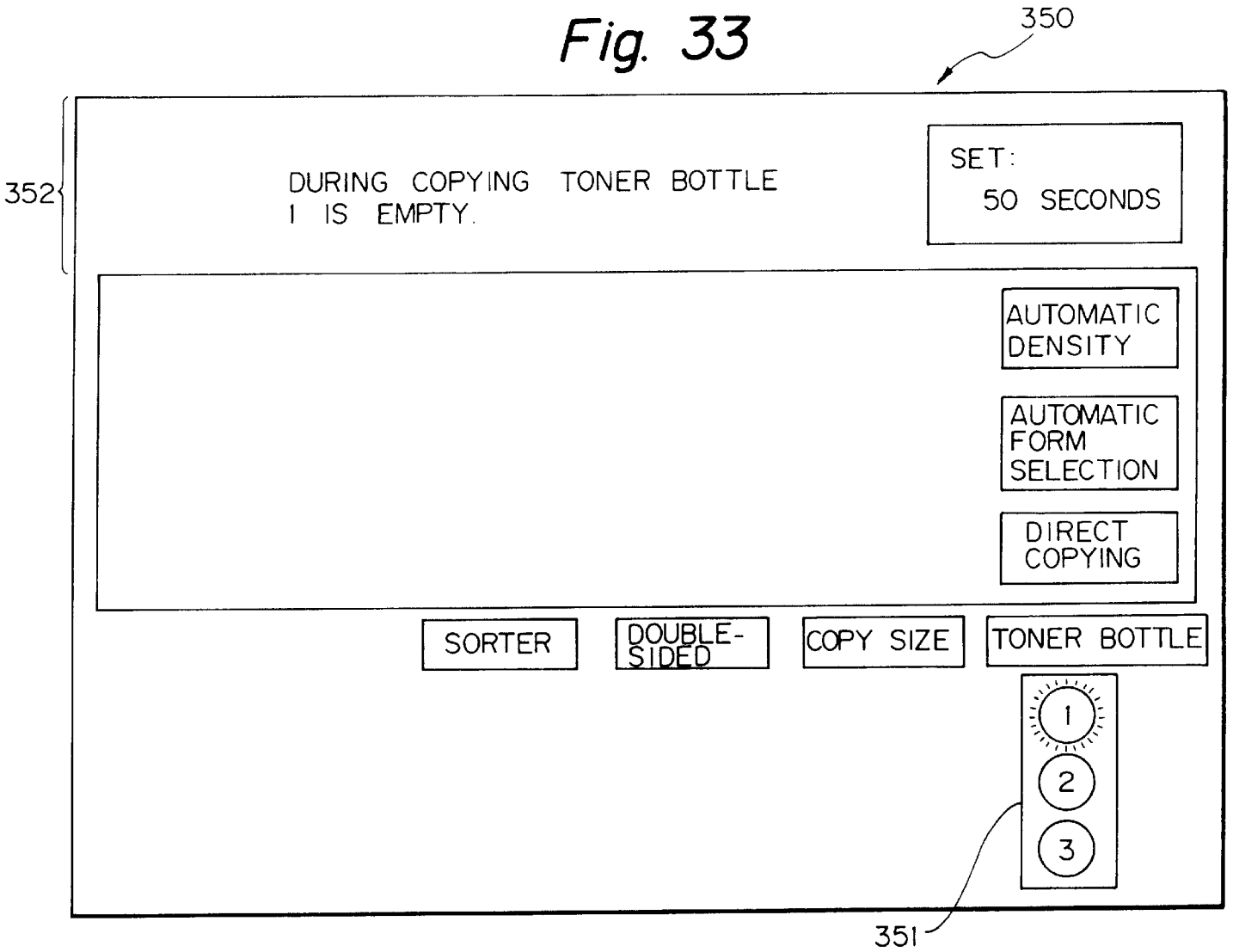
FIG. 33 is a diagram illustrating an empty bottle displaying mechanism arranged on an operator screen.
Figure 34:
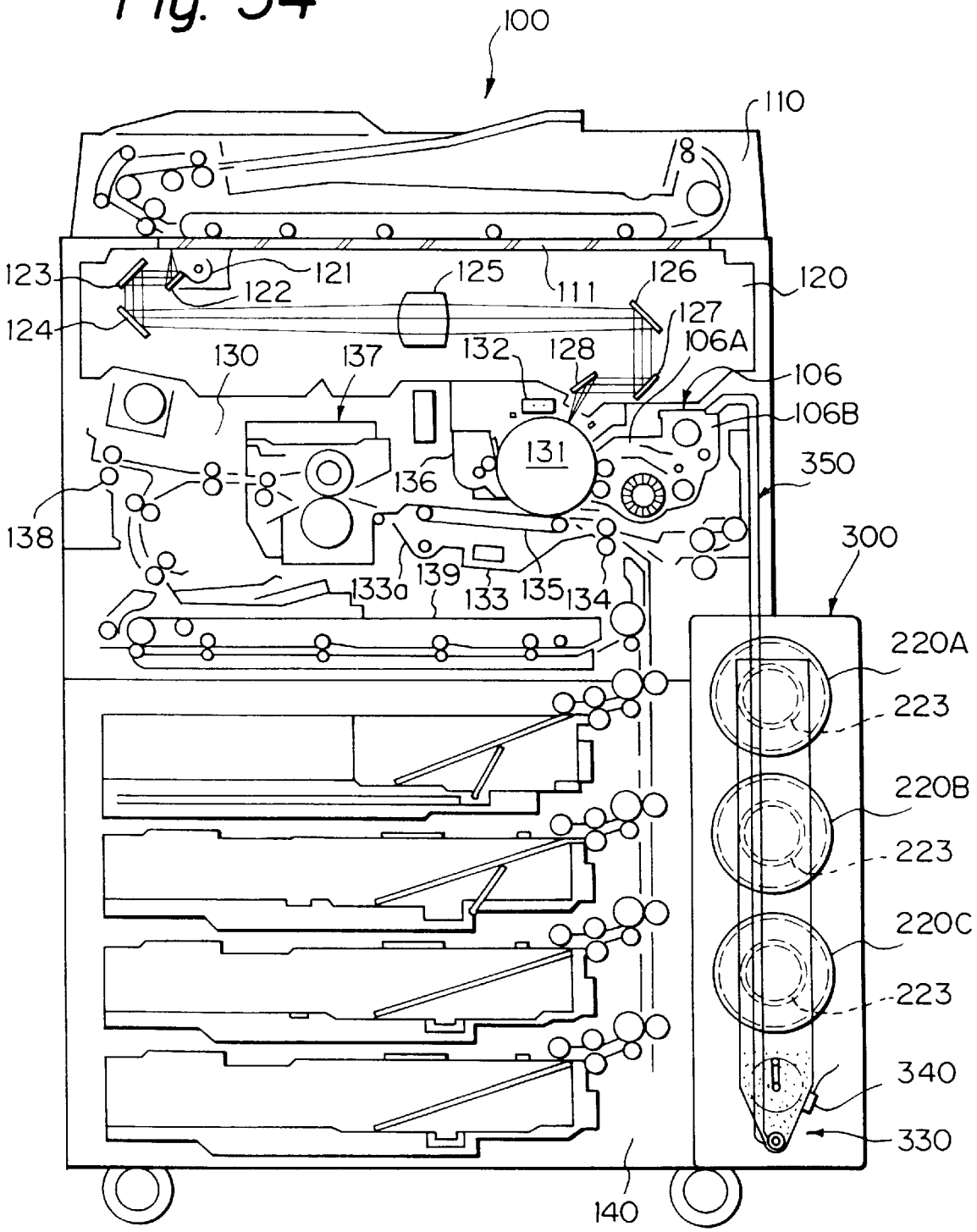
FIG. 34 is a schematic configuration diagram of an image forming apparatus of the embodiment shown in FIG. 31.

FIG. 33 shows an example of a screen 350 of an operating portion which is not shown in the copying machine main body 100. On a part of the screen 350, there is provided a display 351 for displaying an arrangement of the plurality of toner bottles 220A to 220C. In this display 351, there are shown a display (1) corresponding to the toner bottle 220A, a display (2) corresponding to the toner bottle 220B, and a display (3) corresponding to the toner bottle 220C. When all of the toner bottles 220A to 220C contain toner, the portions of (1) to (3) are put in an OFF state so as to be inconspicuous. For example, when the toner bottle 220A becomes empty, the portion of the display (1) is illuminated by way of an inverted character display, whereby the operator is informed of which toner bottle is empty.

In the same manner, when the toner bottle 220B or the toner bottle 220C becomes empty, the portion (2) or the portion (3) is illuminated in the inverted character display, respectively.

Thus, the operator is informed of a location of an empty toner bottle and the number of the toner bottles based on the screen on the external operating section without opening the image forming apparatus, and therefore the operator can exchange toner bottles quickly.

To inform the operator of the empty toner bottle status information more clearly, it is preferable to display text-based messages such as, for example, "Toner bottle 1 is empty", in the location of the message display 352 as shown in the upper portion of the screen 350 in FIG. 33. The display 351 and the message display 352 are examples of empty bottle indicating mechanisms of the present invention.

FIGS. 35 to 41 show features of another embodiment of the present invention. An image forming section or other sections, and a toner guiding method are the same as for the above described embodiments, and therefore they are not discussed below. The same reference numerals designate corresponding parts in the above and these embodiments.

Figure 35:
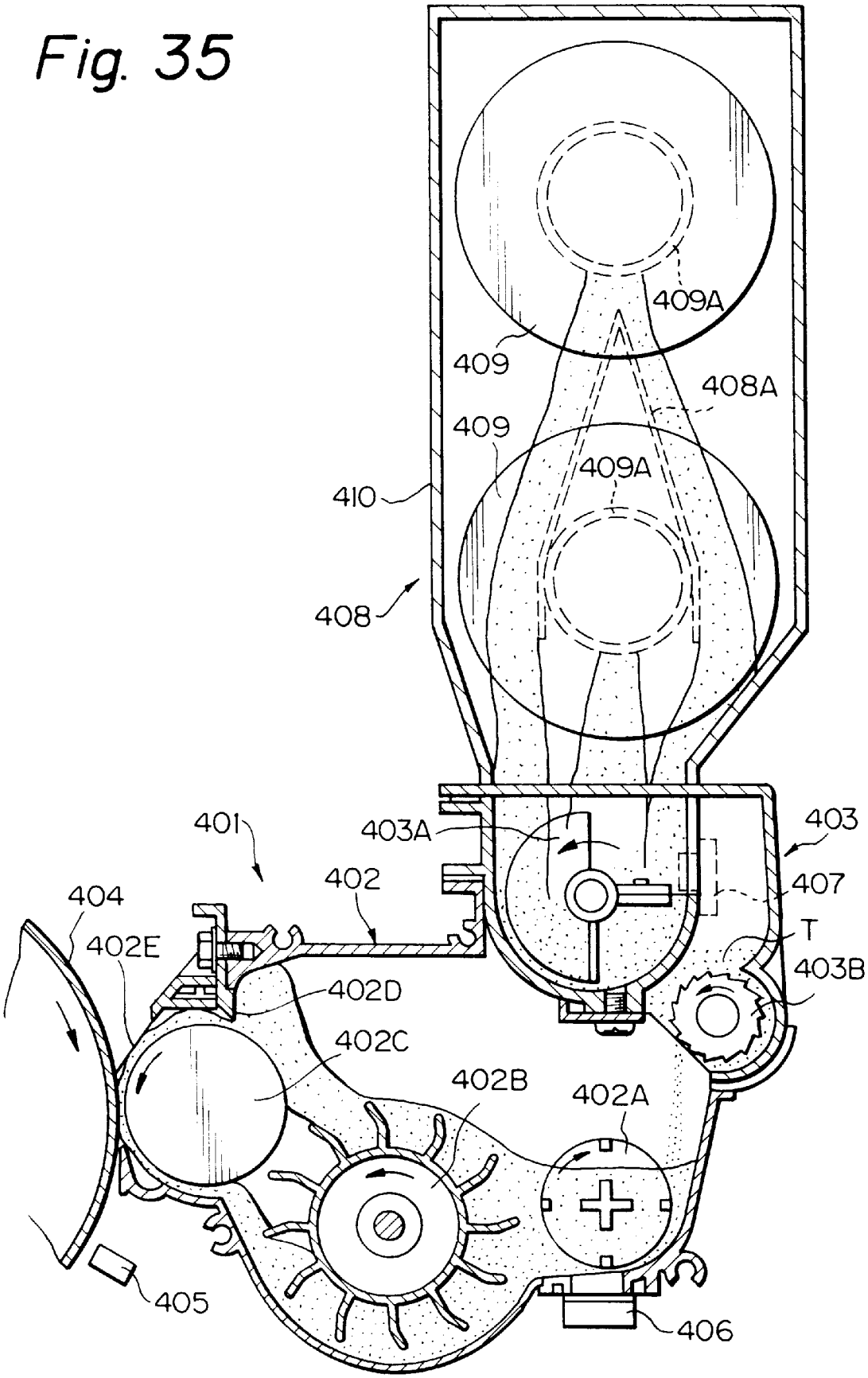
FIG. 35 is a main portion sectional view of a toner supplying apparatus in an image forming apparatus of an embodiment of the invention.

An image forming apparatus of this embodiment includes a developing apparatus 401 and a toner supplying apparatus 408 as shown in FIG. 35.

The developing apparatus 401 includes a developing container 402 and a toner supplying section 403; the developing container 402 is arranged near a photosensitive drum 404 which is rotatable in a clockwise direction as shown in this figure and the toner supplying potion 403 is mounted on the developing container 402.

In the developing container 402 there are arranged a stirring roller 402A, a paddle wheel 402B and a developing sleeve 402C; the stirring roller 402A is located downward (in reference to a flow of toner) of the toner suppling section 403, the developing sleeve 402C is opposite to the photosensitive drum 404, and the paddle wheel 402B is located between the stirring roller 402A and the developing sleeve 402C.

The stirring roller 402A, the paddle wheel 402B, and the developing sleeve 402C can be rotated in the directions indicated by the arrows shown in FIG. 35, respectively, and the paddle wheel 402B scoops up two-component developer consisting of non-magnetic toner and magnetic carrier which have been frictionally charged in opposite polarities by being mixed together in a stirring action by the stirring roller 402A and then delivered to the developing sleeve 402C.

The developing sleeve 402C includes a non-magnetic body made of aluminum or stainless steel, containing a magnetic roller made of a plastic magnet molded by mixing a ferrite magnet or a rubber magnet, and further nylon powder and ferrite powder, and the magnetic roller has a configuration in which a plurality of magnetic poles are arranged along a circumferential direction thereof.

In the developing container 402, there are arranged a doctor blade 402D for restricting a layer thickness of toner delivered to the developing sleeve 402C and a seal member 402E for preventing toner from being scattered away from the developing sleeve 402C.

Figure 36:
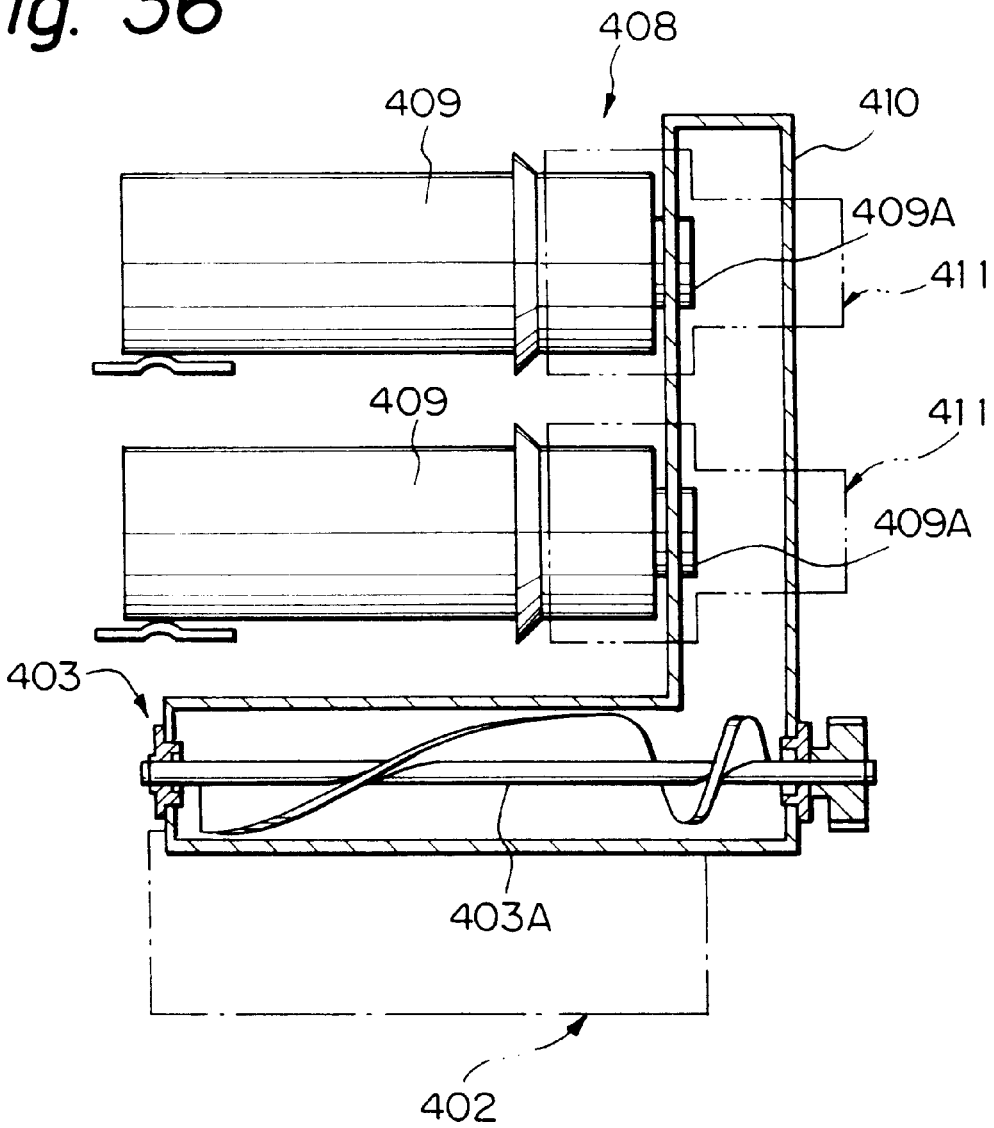
FIG. 36 is a side view of the toner supplying apparatus shown in FIG. 1.

The toner supplying section 403 includes a toner delivering member 403A and a toner supplying roller 403B. As shown in FIG. 36, the toner delivering member 403A is a member having spiral blades whose lead amounts differ in an axial direction, and the toner supplying roller 403B is for supplying toner into the developing container 402 by being rotated only when a required rotation amount is set to supply toner based on a signal from a control section which is not shown.

Near a circumferential surface portion of the photosensitive drum 404 which has passed the developing apparatus 40 1, there is arranged a toner sensor 405 for detecting a toner sticking amount on the photosensitive drum 404, and near the stirring roller 402A in the developing container 402, there is arranged a toner density sensor 406 having a toner density detecting mechanism for detecting a mixing ratio with toner carrier. The toner sensor 405 is a reflex photosensor and the toner density sensor 406 is a permeability sensor. Additionally, near the toner delivering member 403A in the toner supplying section 403, a toner residue detecting sensor (a toner-end sensor) 407 is arranged. This toner residue detecting sensor 407 is an ultrasonic sensor.

Using the toner density sensor 406, a detection method is applied in which a toner density is detected based on a toner content in the developer by using an inductance change of a coil placed in the developer.

The toner sensor 405, the toner density sensor 406, and the toner residue detecting sensor 407 are connected to a control section which is not shown.

The control section, which will not be described in detail here, is arranged to start a toner supplying operation in the toner supplying section 403 when it is detected that a toner density has reached a predetermined density or lower by the toner sensor 405 and the toner density sensor 406 and to continue the operation until the density is recovered to a predetermined density, and then to display a message indicating no toner residue which is to be supplied on a display, not shown, when such an event is detected by the toner residue detecting sensor 407.

In the toner supplying section 403, a toner supplying apparatus 408 is attached.

The toner supplying apparatus 408 is an apparatus provided to supply toner when there is a shortage of toner stored in the toner supplying section 403, and has a plurality of toner bottles 409 vertically arranged, as shown in FIG. 35 above the toner supplying section 403.

The toner bottle 409 includes a cylindrical container having an opening portion 409A at an end thereof in an axial direction, and as shown in FIG. 36, is set horizontally through a guiding member 450 with its opening portion 409A positioned in the side of a toner dropping path member 410 which communicates with the toner supplying section 403. The toner dropping path member 410 has a space in which the opening portion 409A of the toner bottle 409 is continuously connected with the toner supplying section 403, and in the space, as shown in FIG. 35, a rectifying member 408A is arranged. This rectifying member 408A is arranged to prevent toner discharged from the toner bottle 409 set in the upper stage from being scattered on the opening portion 409A of the toner bottle 409 in the lower stage.

The toner bottle 409 has a spiral guiding groove 409B protruding toward the inside on its outer peripheral surface, whereby when the toner bottle is rotated around its axis being fixed with its opening portion 409A set in a toner dropping path member 410 (See FIG. 36), toner contained inside is pressed by the guiding groove 409B so as to be moved toward the opening portion 409A. A toner discharging step (regarding how to guide the toner) in the toner bottle 409 is the same as for the above described embodiments.

Figure 37:
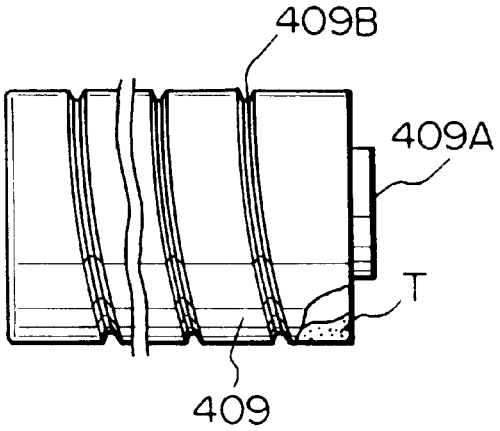
FIG. 37 is a main portion side view of a toner bottle.
Figure 38:
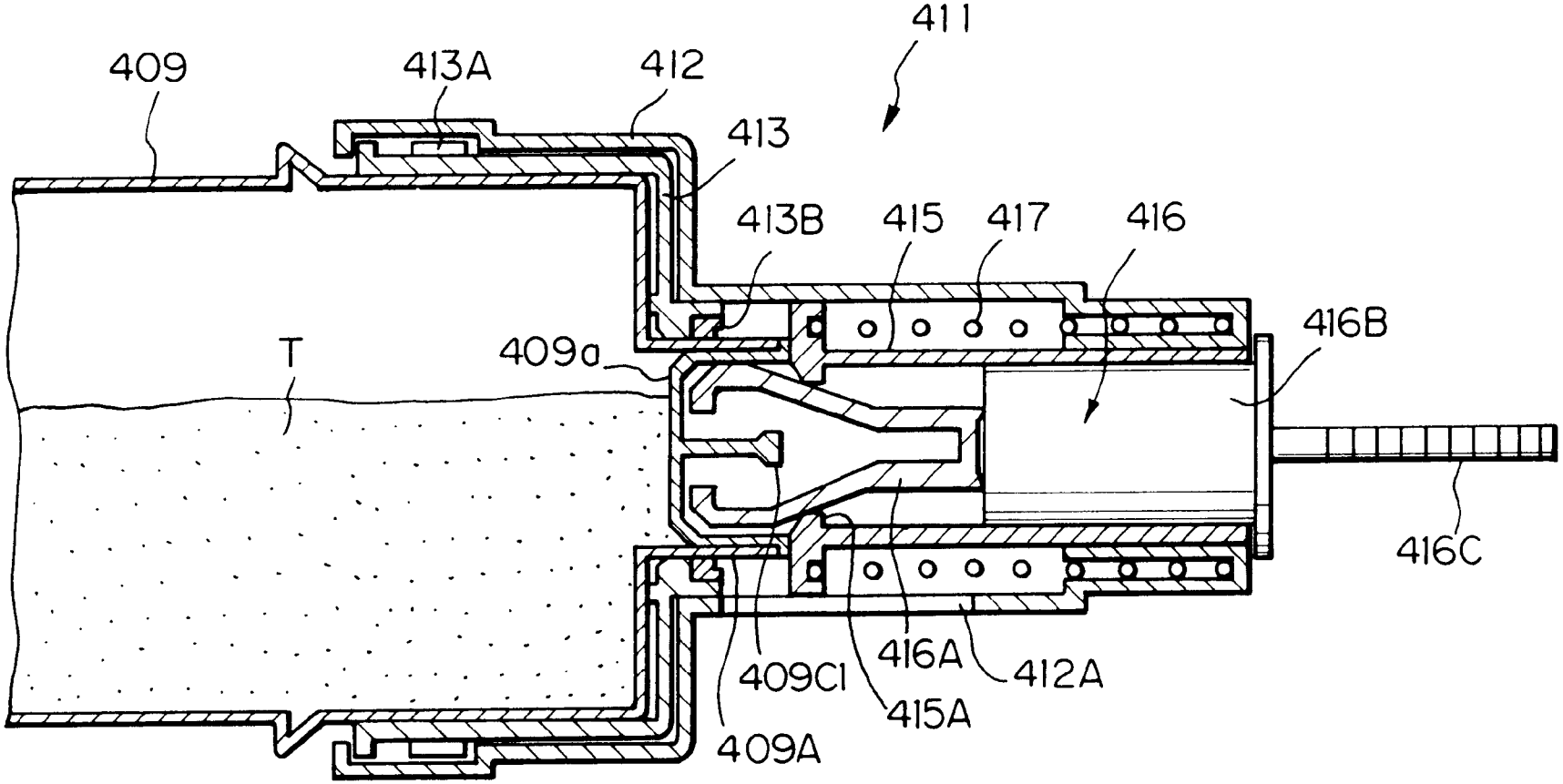
FIG. 38 is a sectional view illustrating a configuration of a toner bottle opening mechanism in the toner supplying apparatus shown in FIG. 35.

A cap 9C on the opening portion 409A of the toner bottle 409 shown in FIG. 37 is put on or off by an opening mechanism having a slider 415 and a chuck 416 shown in FIG. 38 for example.

FIG. 38 shows a configuration of the opening mechanism of the toner bottle 409.

In FIG. 38, the opening portion 409A of the toner bottle 409 is set in the side of the toner dropping path member 410 shown in FIG. 36, and in the toner dropping path member 410, there is provided a holder 411 which can be engagedly inserted with the opening portion 409A of the toner bottle 409 so as to hold the bottle.

The holder 411 has a holder member 412, which includes a member having a stepped cylindrical cross section and has a toner discharging aperture 412A in a part of the lower circumferential surface. The toner discharging aperture 412 that communicates with the toner dropping path member 410 (See FIG. 36).

In the holder member 412, an inner holder 413 having a gear 413A is arranged rotatably on an outer peripheral surface. On the inner surface of the inner holder 413, there is arranged an engaging member (not shown) which can be engaged with an engaging portion (not shown) formed at an end portion having an opening 409A out of the end portions in an axial direction of the toner bottle 409 and is used for rotating the toner bottle 409.

Figure 39:
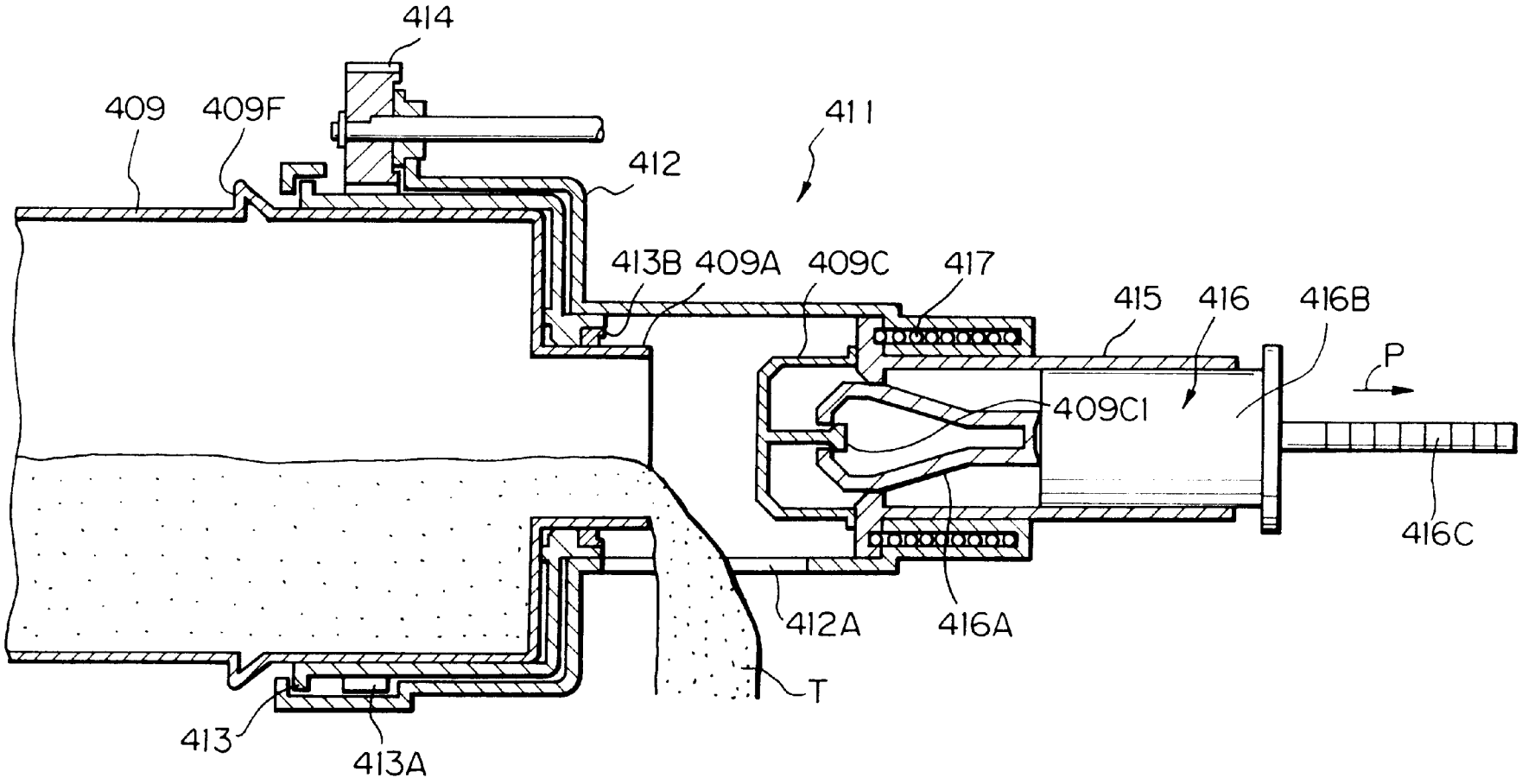
FIG. 39 is a sectional view illustrating a configuration of an opening mechanism and a toner bottle rotating mechanism in the toner supplying apparatus shown in FIG. 38.

With the gear 413A of the inner holder 413, as shown in FIG. 39, a driving gear 414 is engaged which is driven so as to be rotated by a driving motor forming a bottle rotating mechanism which is not shown.

For the inner holder 413, there is provided a sealing member 413B for preventing a leak of toner T, that is put in contact with an outer peripheral surface of the opening portion 409A of the toner bottle 409.

In FIG. 38, in the holder member 412, there is provided a slider 415 and a chuck 416 forming an opening mechanism for putting the cap 409C on or off the opening portion 409A of the toner bottle 409.

The slider 415 is supported to be slidable along an axial direction of the holder member 412 therein, and it is generally urged toward the side of the opening portion 409A of the toner bottle 409 by a spring 417 arranged inside the holder member 412.

The slider 415 has a small-diameter portion 415A for contracting a diameter of the chuck 416 when the cap 409C is pulled out on its inner surface.

The chuck 416 has a click 416A which is opposable to a grab portion 409C1 formed on the cap 409C of the toner bottle 409 at its tip, and a base of the click 416A is formed in a drum shape to be configured as a sliding portion 416B which is put in contact with an inner peripheral surface of the slider 415. The click 416A is made of a flexible member which is divided into a plurality of portions in a circumferential direction, and it is generally mechanically bias to have an extending diameter.

Figure 40:
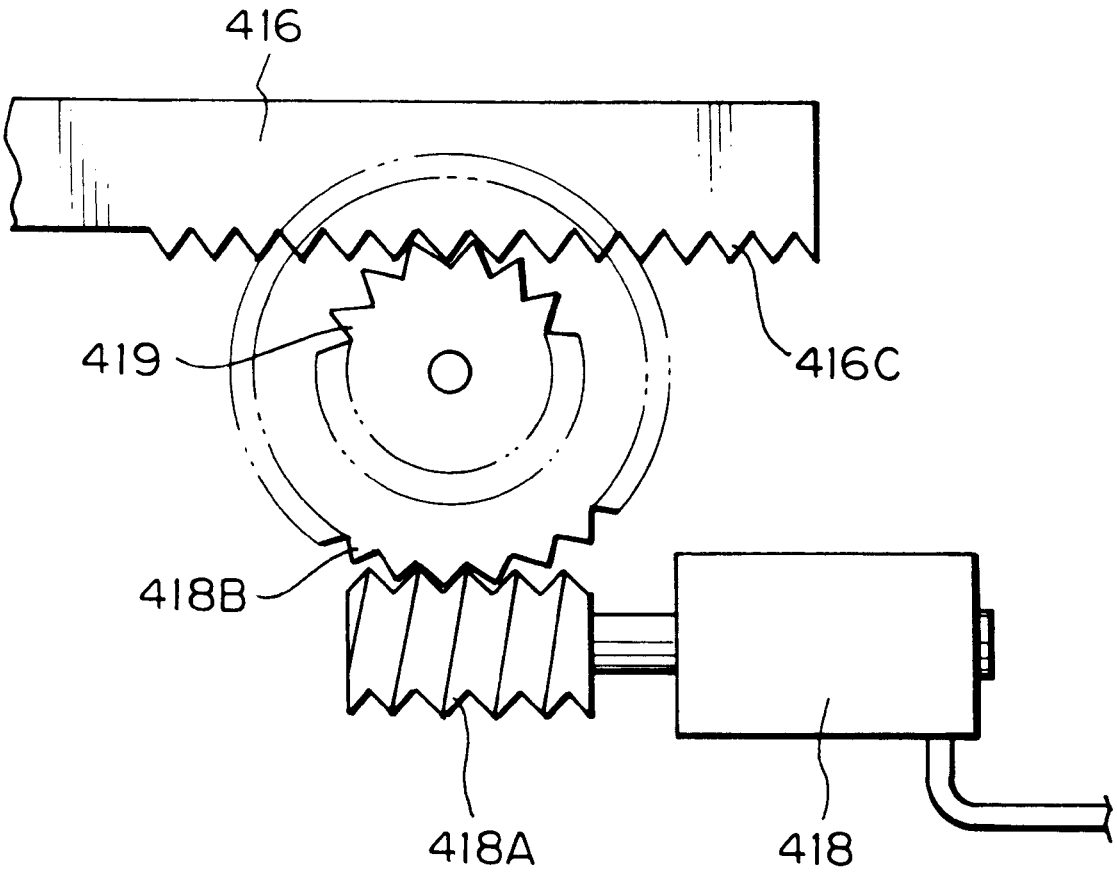
FIG. 40 is a diagram illustrating a configuration of an opening mechanism for the toner bottle shown in FIG. 37.

A rack 416C is formed at an external end of the sliding portion 418B, with which a pinion gear 419 is engaged so as to be linked with a worm gear 418A attached to an output axis of the driving motor 418 through a worm wheel 418B as shown in FIG. 40.

The driving motor 418 is a driving mechanism for the chuck 416 in the slider 415 and the chuck 416 forming the opening mechanism, and it is set to a predetermined rotation amount which enables putting on or off the cap 409C attached to the opening portion 409A of the toner bottle 409.

The driving motor (not shown) which controls a rotation of the toner bottle 409 and the driving motor 418 shown in FIG. 40 form a toner discharging mechanism for discharging toner T from the toner bottle 409 so as to supply the toner T toward the toner supplying section 403 together with the toner bottle 409.

Figure 41:
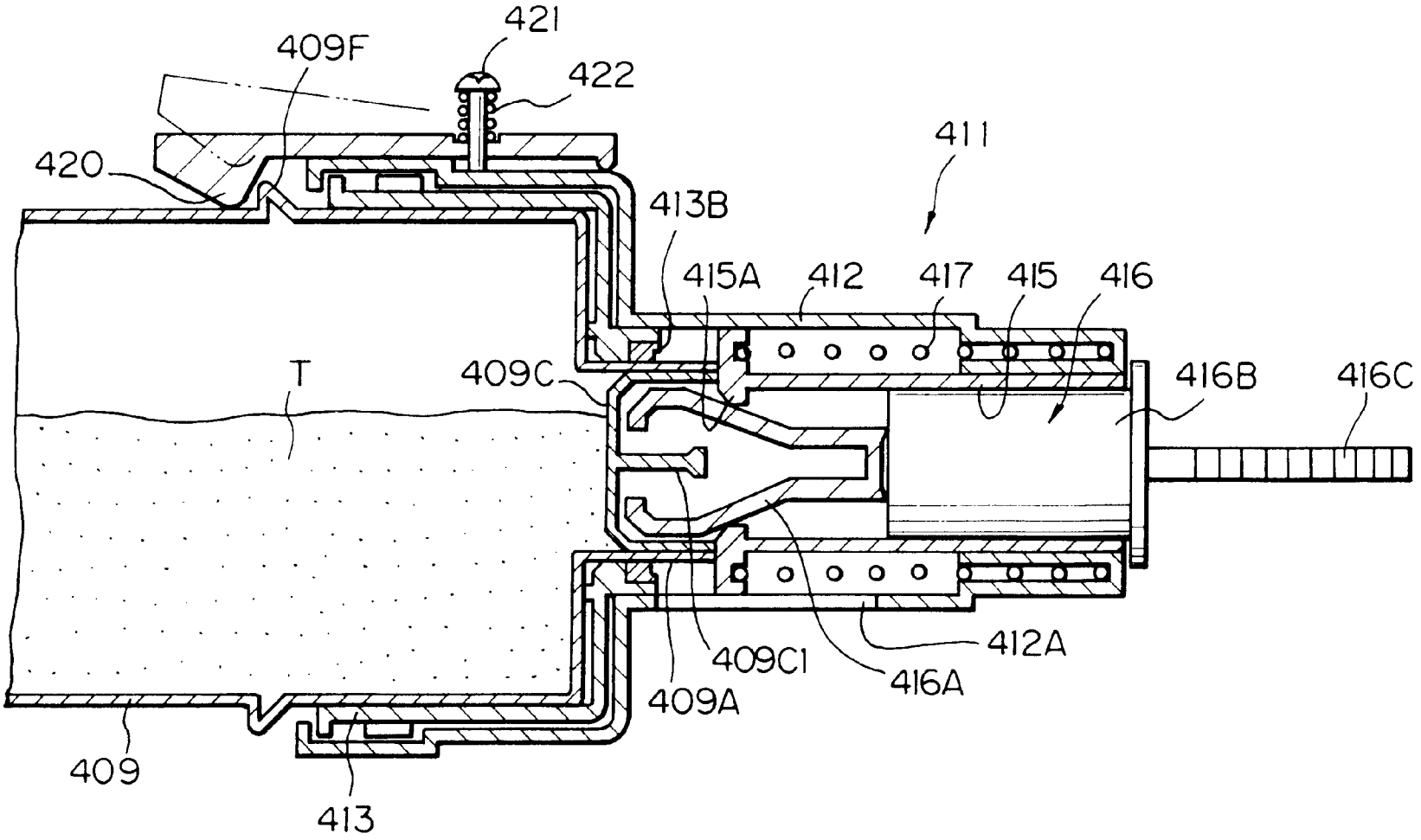
FIG. 41 is a sectional view illustrating a configuration of a fastening mechanism of the toner bottle shown in FIG. 37.
Figure 42:
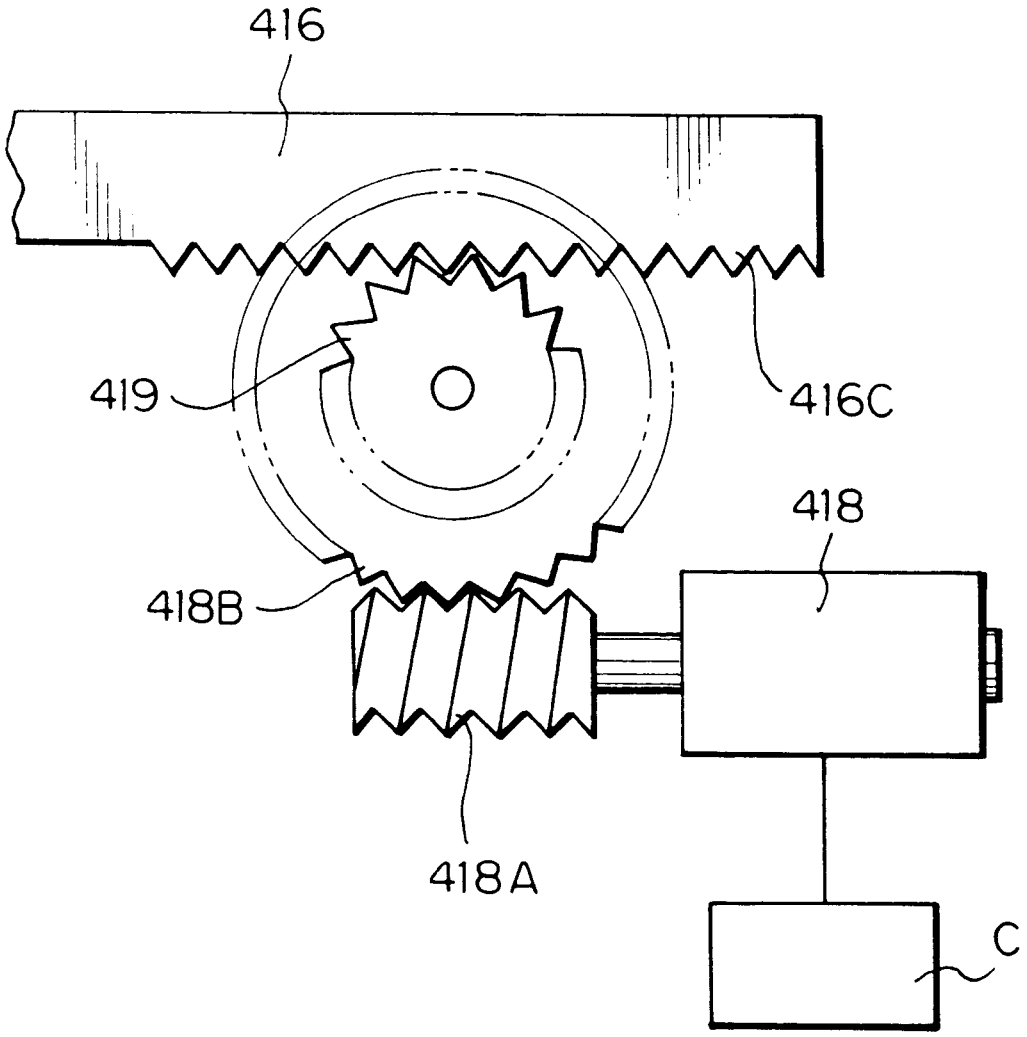
FIG. 42 is a diagram illustrating a configuration of an opening mechanism for a toner bottle of another embodiment.

On an outer peripheral surface of the holder member 412, as shown in FIG. 41, there is provided a stopper 20 for preventing the toner bottle from coming off when putting the cap 9C on the opening portion 9A of the toner bottle which has been set.

In FIG. 41, the stopper 420 is a member which can be pivoted with a stepped screw 421 which is fixed to the holder member 412 being inserted in the middle of a longer direction thereof, and an end portion of it in the longer direction from the position of the stepped screw 421 is put in contact with the outer peripheral surface of the holder member 412 and its other end portion being opposite to a fastening projection 409F which is formed on the outer peripheral surface of the toner bottle 409.

For the stepped screw 421, a spring 422 for pressing the stopper 420 from above is arranged, and as indicated by a solid line in FIG. 41, the other end portion of the stopper 420 in the longer direction is opposite to and engaged with the fastening projection 409F of the toner bottle 409.

This embodiment has the above described configuration, and therefore, as shown in FIG. 38, the slider 415 and the chuck 416 forming the opening mechanism are maintained in a state such that they have been shifted up to a location in which they are opposite to the grab portion 409C1 of the cap 409C by a spring force of the spring 417.

In FIG. 38, when the toner bottle 409 is set in the holder 411, the chuck 416 is positioned opposite thereto in a position where the chuck 416 can catch the grab 409C1 of the cap 409C due to an urging force of the spring 417 and the toner bottle 409 is stopped by the stopper 420 at its fastening projection 409F as shown in FIG. 41 so as to be prevented from coming off.

When the toner bottle 409 is opened (from the condition shown in FIG. 38), the cap 409C is pulled out. In this case, the chuck 416 is moved in a direction in which the cap 409C is pulled out by the chuck 416 (in the direction indicated by an arrow P in this figure) as shown in FIG. 39 by the rack 416C (See also FIG. 40) of the chuck 416 being linked with the driving motor 418 (See FIG. 40).

When the chuck 416 is shifted, the click 416A is contracted in its diameter in a process of moving the small-diameter portion 415A formed in the slider 415 and the click 416A catches the grab 409C1 of the cap 409C so as to prevent its diameter being extended due to the small-diameter portion 415 in a state such that the diameter cannot be contracted any more due to the thickness of the grab 409C1. Accordingly, with the grab 409C1 being caught by the chuck 416, the slider 415 can also be shifted together with the chuck 416 and therefore the cap 409C is pulled out by keeping a grasping force on the grab 409C1.

When the opening portion 409A is opened by pulling out the cap 409C, the toner bottle 409 is rotated via the gear 413A of the inner holder 413 and the driving gear 414 (See FIG. 39), whereby the toner T contained in the toner bottle is discharged by the action which has been already described in the above embodiment and then transmitted from the toner discharging aperture 412A of the holder member 412 to the toner dropping path member 410 to be supplied toward the toner supplying section 403.

The toner supplying apparatus 408 is driven based on a signal from the control section when it is detected that residue of the toner T is decreased to the considerably lower level in the toner supplying section 403 by the toner residue detecting sensor 407 (See FIG. 35) or when it is detected that the toner T is used up completely by the sensor base on supplying start time. Therefore, in the toner supplying apparatus 408, if the toner bottle 409 is set in the holder 411 with the cap 409C pulled out, unless there is no toner T to be supplied from the toner bottle 409, one of the toner bottles 409 is rotated independently so that the toner T can be supplied.

When the toner bottle 409 is rotated, the toner T in the toner bottle 409 is gradually discharged.

If there is no toner T to be supplied in the toner bottle 409, the condition is detected by the toner residue detecting sensor 407. In other words, when the toner residue detecting sensor 407 detects that no toner T is discharged in spite of the rotation of the toner bottle 409 selected by the toner supplying apparatus 408, this information is output to the control section, which displays on a display a message there is no toner T in the selected toner bottle 409. Thus, the operator can determine whether or not there is toner T in the toner bottle 409 and exchange the bottles, if necessary.

When the operator exchanges the toner bottles 409, the cap 409C is put on the opening portion 409A of the toner bottle 409 which has remained opened until that point. The cap 409C is moved toward the side of the opening potion 409A in response to the pinion gear 419 engaged with the rack 416 being driven by the driving motor 418, and then the cap 409C is inserted into the opening portion 409A by being grabbed by the click 416A of the chuck 416 so as to be installed. In this example, the toner bottle 409 is stopped by the stopper 420 and therefore it is kept to be fixed even if pressure is applied on it at the insertion of the cap 409C.

The toner bottle 409 closed by the cap 409C at the opening portion 409A is removed from the holder 411 by being released from the engagement with the fastening projection 409F of the toner bottle 409 by lifting the stopper 420 as indicated by a two-dotted and dashed line in FIG. 41.

According to this embodiment, when toner T is discharged from the toner supplying apparatus 408, an operator is made aware that there is no toner to be supplied in the toner tank 409 whether an arbitrary toner bottle 409 is selected by the control section or the operator, and therefore a toner supply error can be avoided.

Further, according to this embodiment, some toner bottles 409 do not rotate among the plurality of toner bottles 409, whereby it is possible to suppress deterioration of toner to the utmost which is caused by frictional charging in toner generated by a rotation of the toner bottles 409, so as to prevent toner from aggregating due to a rise of a temperature caused by the friction.

FIGS. 42 to 47 show features of another embodiment of the present invention. A toner discharging operation of toner bottles is the same as for the above described embodiments (FIGS. 35 to 41), and thus an explanation will be omitted here. The same reference numerals designate corresponding parts in the above and these embodiments.

The toner supplying roller 403B shown in FIG. 35 supplies toner into the developing container 402 by being rotated by a required rotation amount in response to a signal from the control section C (See FIG. 42) as a controlling mechanism.

Figure 43A:
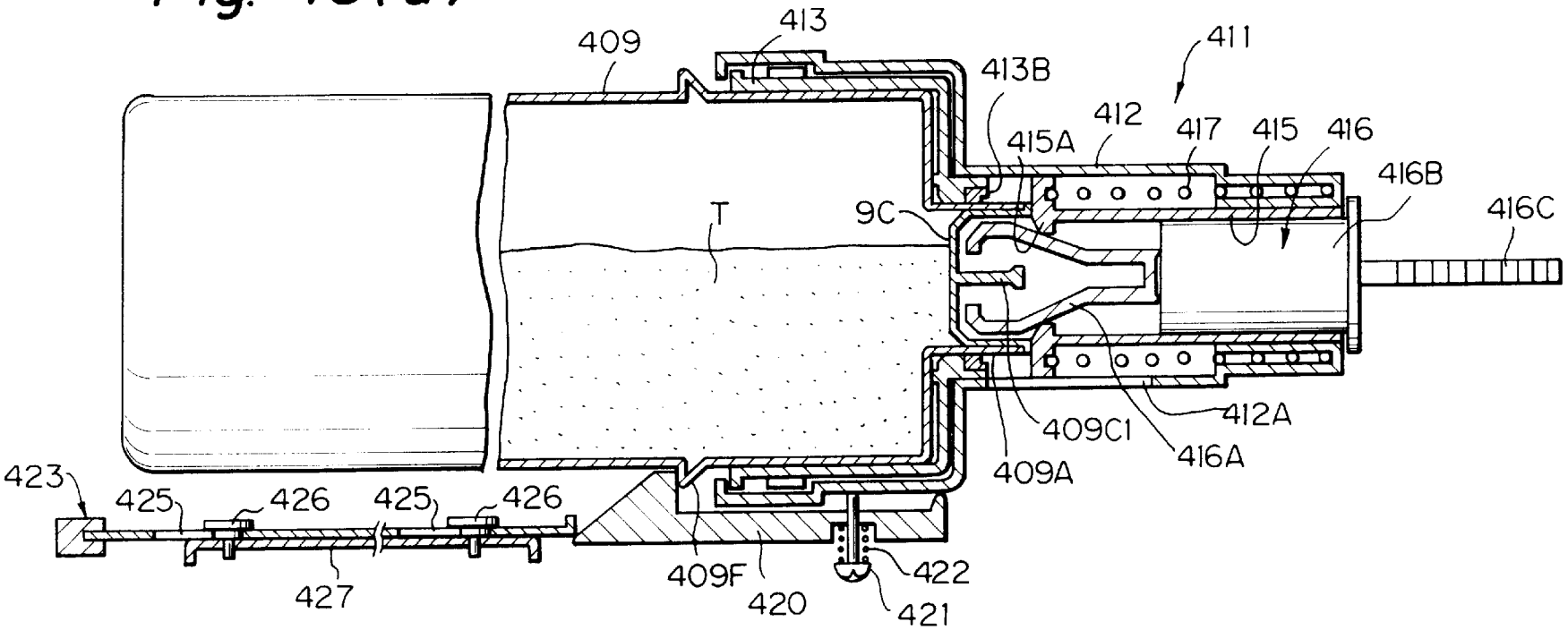
FIG. 43 is a sectional view illustrating a mode of removal of the toner bottle in the toner supplying apparatus in the embodiment shown in FIG. 42.
Figure 43B:
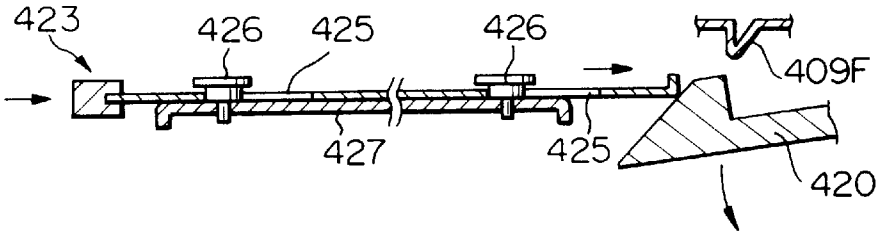

On the outer peripheral surface of the holder member 412, as shown in FIG. 43 (a), there is arranged a stopper 420 as a toner bottle fastening member for preventing a toner bottle 409 from coming off when a cap 409C is put on an opening portion 409A of the installed toner bottle 409, when driving a rotation of the toner bottle 409, or when the toner bottle 409 is uncapped.

At an end of the side of the fastening projection 409F of the stopper 420, there is an inclined portion having an acute angle opposite to the side of the toner bottle 409.

In FIG. 43(*a*), a reference numeral 423 designates a lever as an operating member for releasing engagement between the stopper 420 and the engaging projection 409*a*. The lever 423 has an oblong hole 425 and a head rivet 426 is passed through the oblong hole 425 so as to be fixed to a fixed wall 427, whereby the lever 423 can slide along the fixed wall 427.

Figure 44:
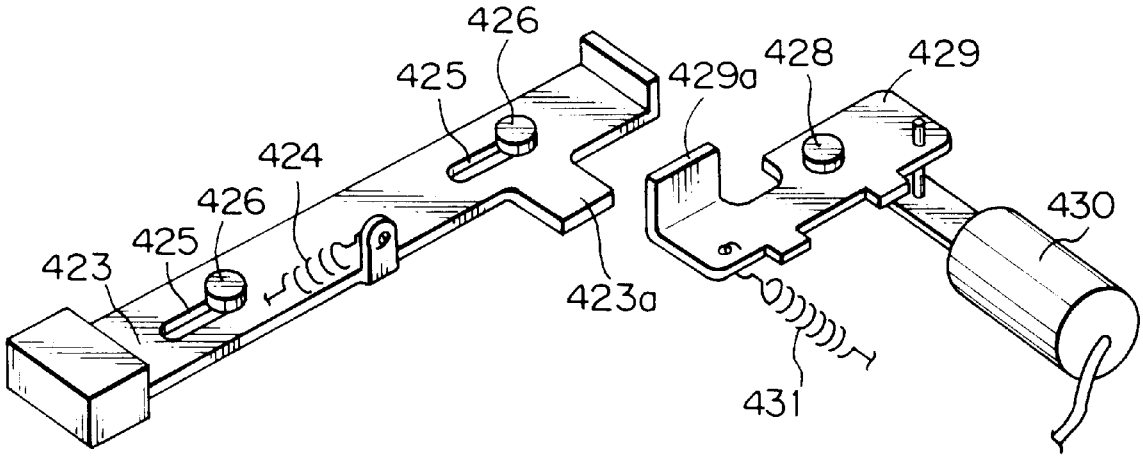
FIG. 44 is a perspective view illustrating a mechanism which enables restrictions on a removal of a toner bottle.

As shown in FIG. 44, the lever 423 is energized in a direction such that it recedes from the stopper 420 by a tension spring 424 with one end fixed to the lever 423 and the other end to a fixed member which is not shown, whereby the lever 423 is held at a given distance from the stopper 420 in a state that external pressure is not applied on it.

Figure 45:
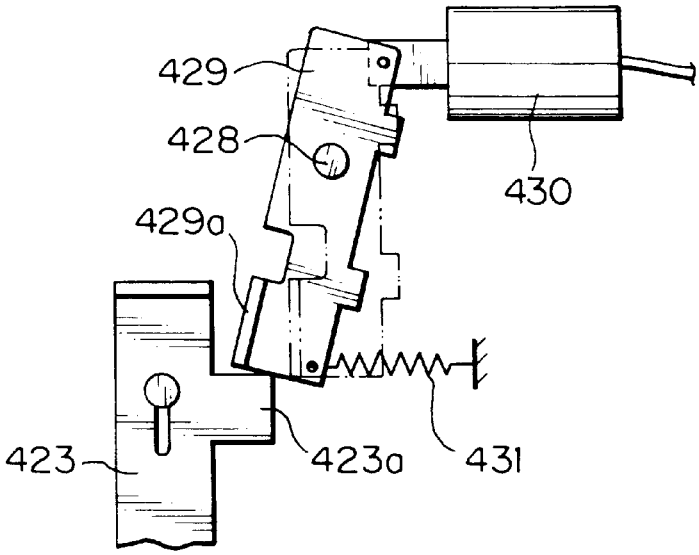
FIG. 45 is a main portion top view of the mechanism shown in FIG. 44.

In FIG. 45, as indicated by a solid line, a projection 423*a* on a side of the lever 423 is engaged with an end portion 429*a* of a lever stopper 429 as a locking member supported by a shaft 428 (a first state) The first state is set when the opening portion 409A of the toner bottle 409 is opened (See FIG. 39).

The other end of the lever stopper 429 is connected to a solenoid 430. Although a tension spring 431 has an end near the end portion 429*a* of the lever stopper 429 and the other end of the spring is fixed to a fixed member which is not shown and biases the end portion 429*a* of the lever stopper 429 in a direction such that it recedes from the projection 423*a* of the stopper 423, the solenoid 430 is working in the first state and therefore the end portion 429*a* of the lever stopper 429 is engaged with the projection 423*a* of the stopper 423 against a tension of the tension spring 431.

In a state that the opening portion 409A of the toner bottle is closed by the cap 409C, the solenoid 430 is released from the operation and the lever stopper 429 is pivoted to the position indicated by a two-dotted and dashed line, so as to release the engagement between the end portion 429*a* of the lever stopper 429 and the projection 423*a* of the stopper 423 as shown in FIG. 44 (a second state).

In the first state, the lever 423 is not operable due to the lever stopper 429, and therefore a toner bottle 409 cannot be changed, for example, when toner is supplied with its cap 409C removed. In other words, toner bottles cannot be exchanged unless the opening portion 409A of the toner bottle 409 is closed by the cap 409C. In the second state, the end portion 429*a* of the lever stopper 429 is released from the engagement with the projection 423*a* of the stopper 423, and therefore, as shown in FIG. 43(*b*), a tip of the lever 423 is engaged with the inclined portion of the stopper 420 so as to press down the stopper 420 by pressing the lever 423 toward the stopper 420 and the stopper 420 is released from the engagement with the fastening projection 409F, whereby the toner bottle can be changed. In this embodiment, unless the opening portion 409A of the toner bottle 409 is closed by the cap 409C, the lever 423 is made inoperable by way of the lever stopper 429 to inhibit a removal of the toner bottle. Instead, however, it is possible to use a mechanism to inhibit a movement of the stopper 420 itself.

The toner supplying apparatus 408 is driven based on a signal from the control section C when a toner residue detecting sensor 407 (See FIG. 35) detects that there is almost or completely no toner T residue in the toner supplying section 403 as a supplying start time. In the toner supplying apparatus 408, if a toner bottle 409 is installed in the holder 411 with its cap 409 pulled out, the toner bottle 409 is rotated so as to supply toner.

When the toner bottle 409 is rotated, the toner T in the toner bottle 409 is gradually discharged.

Figure 46:
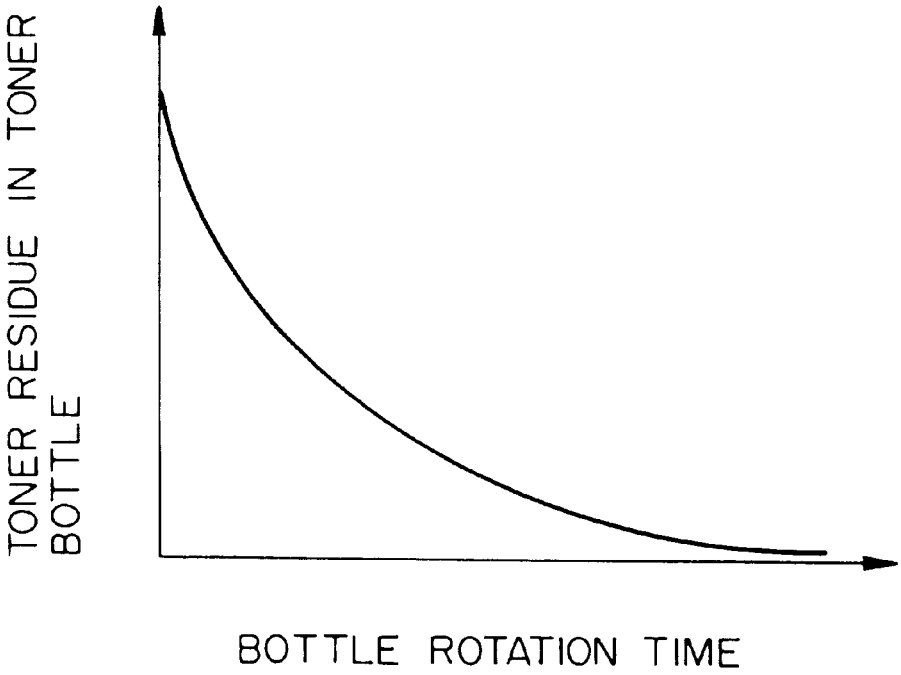
FIG. 46 is a correlation diagram illustrating a correlation between toner residue in a toner bottle and a toner discharge amount per unit time.

As shown in FIG. 46, when toner residue in a toner bottle 409 is decreased, a toner discharging amount of the toner bottle per hour is decreased and the toner residue of the toner supplying section 403 is continuously lower than a predetermined amount. Accordingly, the toner residue detecting sensor 7 detects that the toner residue of the toner supplying section 403 is lower than the predetermined amount in spite of a rotation of the toner bottle 409 selected by the toner supplying apparatus 408. The detecting information is output to the control section C. If this detection state continues for a predetermined time, it is determined that there is almost or completely no toner T in the toner bottle 409, whereby a toner supply is started from another toner bottle 409 which is not used yet while the rotation of the toner bottle is continued.

The condition of the toner supply from two toner bottles is continued for a certain time. After that, the toner bottle 409 of the first toner supply is stopped from rotating, the opening portion 409A is closed by the cap 409C, and the control section C displays a message or indication that there is no toner T in the toner bottle 409, on the display. From this information, the operator can determine whether the toner bottle 409 contains toner T so as to change the toner bottle, if necessary.

When the control section C determines whether the toner bottle 409 contains almost or completely no toner T, the amount of toner in the toner bottle significantly depends on a state of preserving the toner bottle, an amount of usage, or the like. As described above, however, if it is checked that the detection state has been continued for a certain time, it is possible to prevent the control section from determining that the toner residue is low though the toner bottle contains sufficient toner. In addition, a time for proving toner from two toner bottles is set to a relatively longer period of time in consideration of a variation of a toner discharging speed and a variation of sensitivity of the toner density sensor, and therefore toner in the toner bottle which has first supplied toner is almost completely discharged.

Although two toner bottles are used in this embodiment, it is possible to use three or more bottles. If so, toner supplied from a plurality of toner bottles occurs two or more times. In this case, it is possible to display information about a lack of toner residue in the toner bottles either every time or when there is only a last toner bottle containing toner, for example.

The toner bottle 409 closed by the cap 409C at the opening portion 409A is, as shown in FIG. 43(*b*), released from engagement with the fastening projection 409F of the toner bottle 409 by a depression of the stopper 420 made by the lever 423 released from the engagement with the lever stopper 429, so that it is removed from the holder 411.

According to this embodiment, when toner T is discharged from the toner supplying apparatus 408, it is possible to determine that there is no toner to be supplied in the toner tank 409 whether an arbitrary toner bottle 409 is selected by the control section C or an operator, and therefore a toner supply error can be avoided.

Figure 47:
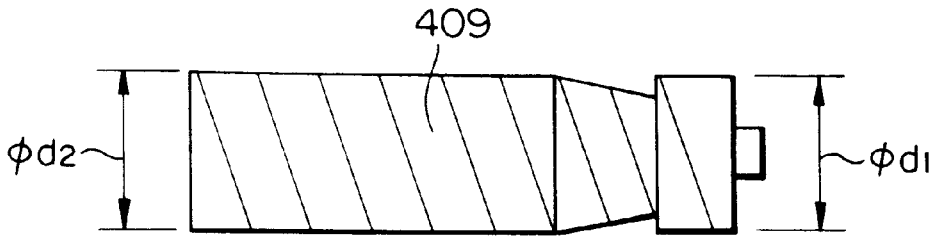
FIG. 47 is a side view illustrating a shape of a toner bottle.
Figure 48:
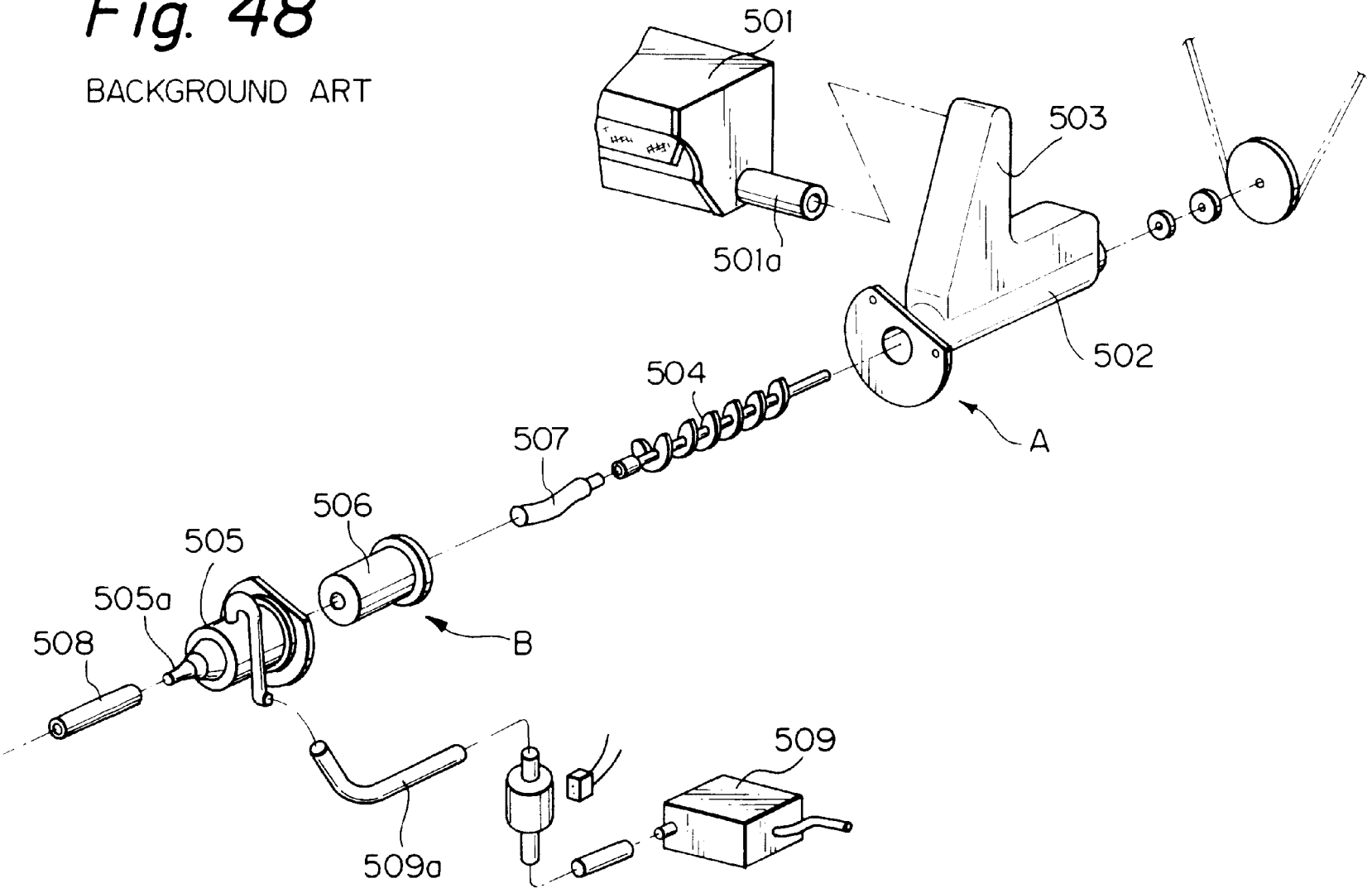
Fig. 48 BACKGROUND ART
FIG. 48 is an exploded perspective view of a conventional toner delivering apparatus.
Figure 49:
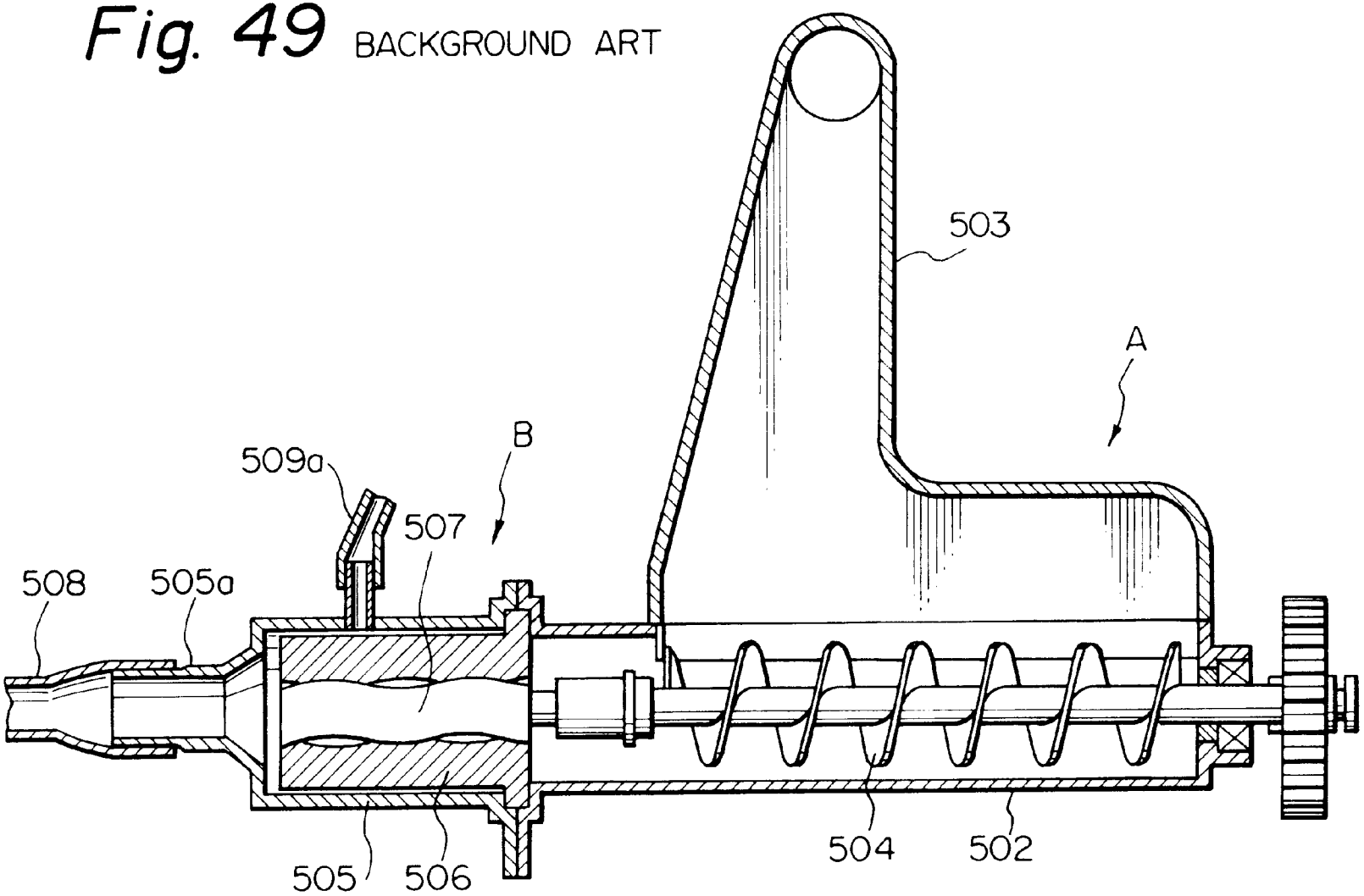
Fig. 49 BACKGROUND ART
FIG. 49 is a longitudinal sectional view of the conventional toner delivering apparatus.
Figure 50:
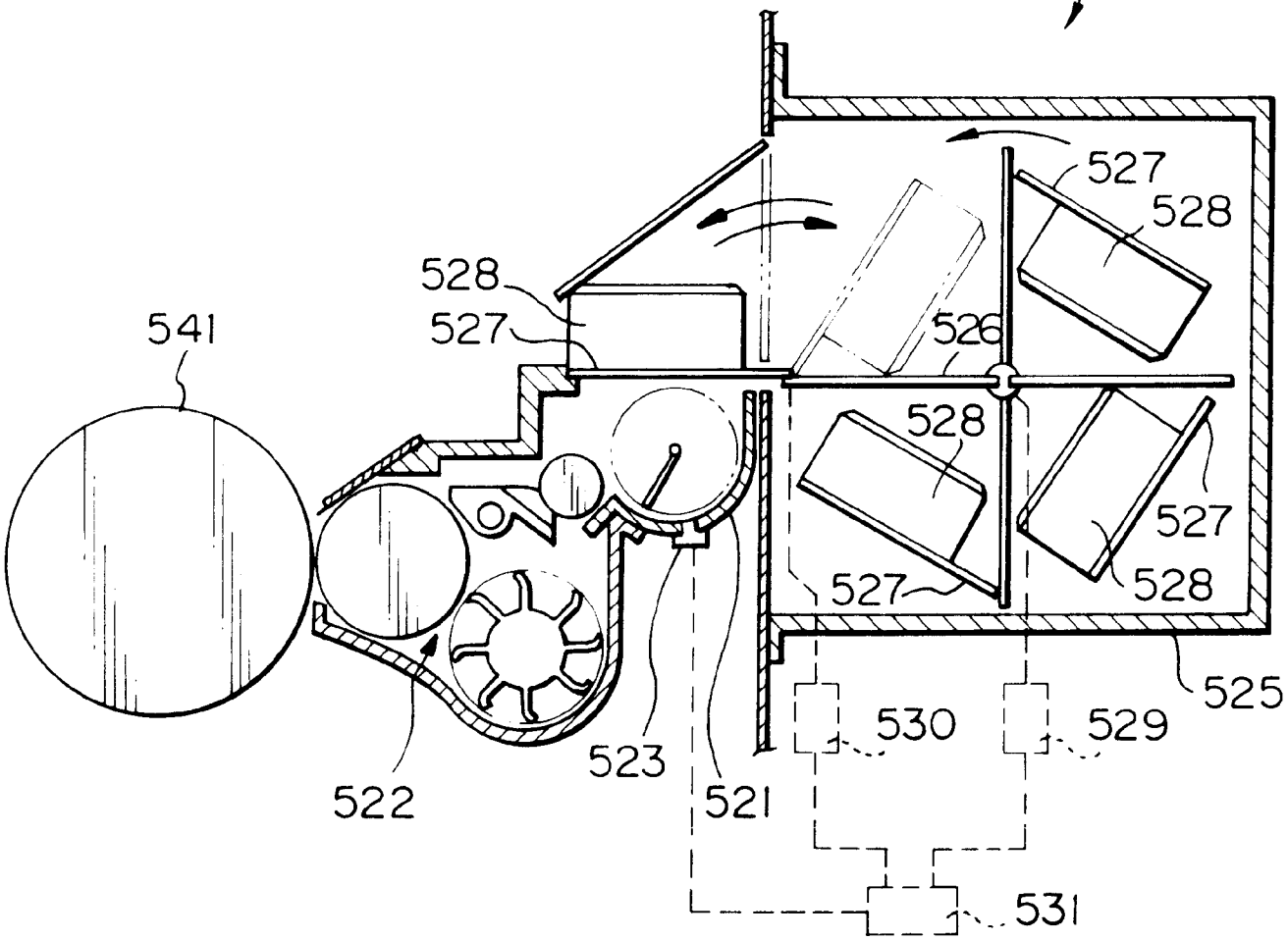
Fig. 50 BACKGROUND ART
FIG. 50 is a schematic sectional view of the conventional toner supplying apparatus.

In addition, the toner bottle 409 in this embodiment has a shape in which a diameter ϕd2 at a rear end is greater than a diameter ϕd1 around the opening portion as shown in FIG. 47, so that the toner bottle 409 can be easily inserted into an opening of an inner cover on this side of the toner bank. Furthermore, when the toner bottle is pulled out of the toner bank, the rear end portion having a relatively larger diameter is pulled out with being in contact with the cover supporting the toner bottle 409, and therefore the fastening projection 409F does not get caught on the cover or other members.

Obviously, numerous (additional) modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An image forming apparatus in an electrophotographic system configured to deliver toner within said apparatus, comprising:

a toner supply having said toner therein; and a powder pump comprising, an inlet portion configured to receive said toner from said toner supply, an outlet portion through which said toner is passed, and a rotor configured to rotate and urge said toner from said inlet portion to said outlet portion, said rotor having a stirring member disposed in an end portion thereof proximate said outlet portion, said stirring member configured to rotate with said rotor.

2. The image forming apparatus of claim 1, wherein said stirring member comprises a wire wound in a spiral shape that urges said toner toward said outlet portion when said wire is rotated with said rotor.

3. An image forming apparatus in an electrophotographic system, comprising:

a toner bank having at least two toner bottles configured to hold toner therein;

a latent image carrier configured to carry a latent image thereon;

a developing apparatus that develops said latent image into a toner image with said toner from said toner bank, said toner bank being arranged in a position spaced apart from said developing apparatus; and toner delivering means for delivering toner from said toner bank to said developing apparatus, said toner delivering means having air-assisted pumping means for pumping said toner with air introduced into said toner delivering means, and means for stirring said toner at an output of said air-assisted pumping means.

4. The image forming apparatus of claim 3, wherein:

a plurality of said at least two toner bottles in said toner bank each have an opening through which said toner is dispensed therefrom and a cap removably disposed at said opening, each of said cap being arranged to face a same direction; and said plurality of toner bottles being arranged vertically and comprising at least one of means for opening and means for closing respective of said caps for said plurality of toner bottles.

5. The image forming apparatus of claim 3, wherein:

said toner bank comprises a bottom; and said toner delivering means transfers said toner along a single toner delivering path, said single toner delivering path including said bottom of said toner bank.

6. An image forming apparatus in an electrophotographic system, comprising:

a toner bank having at least two toner bottles configured to hold toner therein;

a latent image carrier configured to carry a latent image thereon;

a developing apparatus that develops said latent image into a toner image with said toner from said toner bank, said toner bank being arranged in a position spaced apart from said developing apparatus; and a powder pump configured to transfer toner from said toner bank to said developing apparatus along a single toner delivering path that includes a bottom of said toner bank and does not have independent delivery paths for respective of said at least two toner bottles.

7. The image forming apparatus of claim 6, wherein said powder pump comprises:

an inlet portion configured to receive said toner from said toner bank, an outlet portion through which said toner is passed, and a rotor configured to rotate and urge said toner from said inlet portion to said outlet portion, said rotor having a stirring member disposed in an end portion thereof proximate said outlet portion and configured to rotate with said rotor.

8. An image forming apparatus comprising:

a latent image carrier configured to carry a latent image thereon;

a developing apparatus that develops said latent image into a toner image with toner; and a toner supplying apparatus configured to supply said toner to said developing apparatus, comprising a toner bank including, a plurality of toner bottles each of which include an opening portion through which said toner is dispensed therefrom, and a flexible toner delivering means for delivering said toner from the toner bank to said developing apparatus via a single common flexible toner delivery path.

9. An image forming apparatus comprising:

a latent image carrier configured to carry a latent image thereon;

a developing apparatus comprising, a developing container including a developing means for developing said latent image into a toner image with toner, a toner supplying section for storing toner to be supplied to the developing container, and a toner residue detecting means for detecting whether an amount of toner in the toner supplying section is less than a predetermined amount; and a toner bank including, a plurality of cylindrical toner containers each configured to hold toner therein and each having an opening portion at respective ends thereof through which said toner is dispensed, and a flexible toner delivering means for delivering said toner from the toner bank to said toner supplying section of said developing apparatus, wherein said toner delivering means is controlled by said toner residue detecting means.

10. The image forming apparatus of claim 9, wherein said toner containers are arranged so that respective of the opening portions of the toner containers have a direct path between said opening portions and a dropping position in said toner bank such that none of the opening portions of the toner containers interfere with toner being dropped from one of the portions to said dropping position.

11. The image forming apparatus of claim 9, wherein:

said opening portions of said toner containers are configured to be sealed with removable caps; and said toner bank further comprises means for opening and closing the removable caps.

12. An image forming apparatus comprising:

a latent image carrier configured to carry a latent image thereon;

a developing apparatus configured to develop said latent image into a toner image by applying toner thereto; and a toner supplying apparatus that supplies said toner to the developing apparatus, said toner supplying apparatus comprising, a plurality of toner bottles configured to hold toner therein, each of said bottles having an opening portion through which toner is dispensed, said plurality of toner bottles comprising a first toner bottle and a second toner bottle, a detecting means for detecting whether a residual amount of toner in respective of said toner bottles exceeds a predetermined level and for dispensing toner from said second bottle when said residual amount of toner in said first bottle is detected as no longer exceeding said predetermined level and said residual amount of toner in said second bottle is detected as exceeding said predetermined level, and toner delivering means for delivering toner from said plurality of toner bottles to said developing apparatus, said toner delivering means having air-assisted pumping means for pumping said toner with air introduced into said toner delivering means, and means for stirring said toner at an output of said air-assisted pumping means.

13. An image forming apparatus in an electrophotographic system, comprising:

a latent image carrier configured to carry a latent image thereon;

a developing apparatus configured to develop said latent image into a visible image with toner;

a toner bank that stores toner and supplies toner to the developing apparatus, said toner bank being located a predetermined distance away from said developing apparatus, comprising, a toner delivering means for delivering toner from said toner bank to said developing apparatus;

a plurality of toner containing members configured to hold toner therein and being arranged vertically with respect to each other in a toner bottle containing section, comprising individually removable toner bottles arranged so as to be individually removed from said containing section at a same time when said visible image is being formed, said individually removable toner bottles comprising a first toner bottle and a second toner bottle; and a toner-end detector configured to detect whether an amount of toner in respective of said first toner bottle and said second toner bottle is less than a predetermined amount and for supplying toner from said second toner bottle at a time when said amount of toner from said first toner bottle is detected as being less than said predetermined amount and when said amount of toner in said second toner bottle is not detected as being less than said predetermined amount.

14. The image forming apparatus of claim 13, further comprising a toner-end indicating mechanism configured to indicate whether said amount of toner in at least one of said toner bottles is less than said predetermined amount, said toner-end indicating mechanism being positioned near said toner bottle containing section.

15. The image forming apparatus of claim 13, further comprising:

an operation display; and an empty bottle indicating mechanism configured to display on said operation display respective positions of said toner bottles that are detected by said toner-end detector as having less than said predetermined amount of toner.

16. An image forming apparatus comprising:

a latent image carrier configured to carry a latent image thereon;

a developing apparatus configured to develop said latent image into a visible image with toner; and a toner supplying apparatus configured to supply said toner to the developing apparatus, comprising, a plurality of toner bottles for holding toner that is to be supplied to said developing apparatus, each of said toner bottles having an opening portion through which toner is dispensed therefrom, and each of said toner bottles having an axis, and a toner containing section configured to hold said toner bottles in a vertical arrangement with respect to one another and configured to rotate each of said toner bottles around said axis so as to dispense toner from respective of said opening portions.

17. An image forming apparatus comprising:

a latent image carrier configured to carry a latent image thereon;

a developing apparatus configured to develop said latent image into a visible image with toner; and a toner supplying apparatus configured to supply said toner to the developing apparatus, comprising, a plurality of toner bottles vertically arranged at an upper portion of said developing apparatus, each of said toner bottles having an axis and being configured to hold toner and having an opening portion through which said toner is discharged, an opening means for opening said opening portions, said opening means arranged so as to oppose the opening portions of said toner bottles, and a toner discharging means for discharging toner from said toner bottles comprising, a means for rotating said toner bottles around said axis of respective of said toner bottles, and a means for driving said opening means, wherein said toner discharging means discharges toner from said toner bottles by rotating said toner bottles when said opening portions of said toner bottles are opened.

18. The image forming apparatus of claim 17, further comprising:

a toner residue detecting sensor arranged in a toner moving path and configured to produce a control signal when an amount of toner is detected as being less than a predetermined amount, wherein said toner discharging means is set to discharge said toner from said opening portion of respective of said toner bottles by rotating respective of said toner bottles in response to receiving said signal from said toner residue detecting sensor.

19. The image forming apparatus of claim 18, wherein:

said toner discharging means arbitrarily selects one of said plurality of toner bottles and drives a means for rotating said selected bottle and for driving said opening means for the selected toner bottle so that said selected toner bottle is set to supply toner independently of others of said plurality of toner bottles; and said opening means is also for closing said opening portions.

20. The image forming apparatus of claim 19, wherein said toner discharging means externally indicates which of said toner bottles have less than a predetermined amount of toner in response to receiving a signal from said toner residue detecting sensor.

21. An image forming apparatus comprising:

a latent image carrier configured to carry a latent image thereon;

a developing apparatus configured to develop said latent image into a visible image with toner; and a toner supplying apparatus configured to supply said toner to the developing apparatus, comprising, a plurality of vertically arranged toner bottles for holding toner that is supplied to said developing apparatus, each of said toner bottles having an opening portion through which toner is dispensed therefrom when rotated into a common toner delivery path, said plurality of toner bottles comprising a first toner bottle and a second toner bottle, and a detecting means for detecting whether an amount of toner in respective of said toner bottles is less than a predetermined amount, and wherein when said detecting means detects that said amount of toner in said first toner bottle is less than said predetermined amount, said detecting means produces a signal which actuates an operation to dispense toner from said second bottle.

22. An image forming apparatus comprising:

a developing apparatus that applies toner to a latent image so as to produce a visible toner image, comprising, a toner sensor configured to produce a signal when an amount of toner is detected as being less than a predetermined amount;

a plurality of toner bottles configured to hold toner therein and having opening portions through which said toner is dispensed and supplied to said developing apparatus, said plurality of toner bottles comprising a first toner bottle and a second toner bottle;

an opening means for opening said opening portions of said toner bottles;

a toner discharging means for discharging toner from said toner bottles to supply the toner to said developing apparatus; and a controlling means for driving and controlling said opening means and said toner discharging means based on said signal produced by said toner sensor, said controlling means for controlling said opening means to open said opening portions of said toner bottles by driving said opening means and supplying toner to said developing apparatus by driving said toner discharging means, wherein said controlling means starts to supply toner from the second toner bottle in addition to toner supplied from the first toner bottle in response to receiving said signal from said toner sensor indicating that the amount of toner in said first toner bottle is less than said predetermined amount.

23. An image forming apparatus as defined in claim 22, wherein:

respective of said toner bottles comprise inner walls having spiral shaped projections formed thereon; and said toner discharging means is for rotating said toner bottles such that toner within said toner bottles is urged to exit through said opening portions.

24. The image forming apparatus of claim 22, wherein said controlling means is for stopping a toner supply from said first toner bottle by halting said toner discharging means from rotating said toner bottles after an elapse of a predetermined time measured from when toner from said second toner bottle was first caused to dispensed therefrom.

25. The image forming apparatus of claim 24, wherein said controlling means causes said opening means to close said opening portion of said first toner bottle after another predetermined amount of time has elapsed.

26. The image forming apparatus of claim 22, wherein:

said opening means is also for closing said opening portions; and said image forming apparatus further comprises a restriction mechanism configured to restrict said toner bottles from being removed from said image forming apparatus unless said opening portions of said toner bottles are closed by said opening means.

27. The image forming apparatus of claim 26, wherein said restriction mechanism comprises:

a toner bottle fastening member changeably arranged in one of a first position so as to be engaged with at least one of said toner bottles and a second position so as to be disengaged from said at least one of said toner bottles;

an operating member configured to shift said toner bottle fastening member from said first position to said second position; and a locking member arranged to inhibit said toner bottle fastening member from being shifted to said second position by said operating member.

28. The image forming apparatus of claim 22, further comprising an indicating means for indicating that one of said toner bottles has an amount of toner that is less than a predetermined amount.

* * * * *